US005384082A

United States Patent [19]

Frankfort et al.

[11] Patent Number: 5,384,082

[45] Date of Patent: Jan. 24, 1995

[54] PROCESS OF MAKING SPIN-ORIENTED POLYESTER FILAMENTS

[75] Inventors: Hans R. E. Frankfort, Kinston, N.C.; Benjamin H. Knox, Wilmington; Girish A. Pai, Newark, both of Del.

[73] Assignee: E. I. Du Pont de Nemours and Company, Wilimington, Del.

[21] Appl. No.: 85,266

[22] Filed: Jun. 29, 1993

Related U.S. Application Data

[60] Division of Ser. No. 35,988, Mar. 23, 1993, and Ser. No. 753,529, Sep. 3, 1991, Pat. No. 5,229,060, and Ser. No. 753,769, Sep. 3, 1991, Pat. No. 5,261,472, each is a continuation-in-part of Ser. No. 338,251, Apr. 14, 1989, Pat. No. 5,066,447, which is a continuation-in-part of Ser. No. 53,309, May 22, 1987, abandoned, which is a continuation-in-part of Ser. No. 824,363, Jan. 30, 1986, abandoned, said Ser. No. 85,266, is a continuation-in-part of Ser. No. 5,672, Jan. 19, 1993, Pat. No. 5,228,553, and a continuation-in-part of Ser. No. 15,733, Feb. 10, 1993, Pat. No. 5,250,245, each is a continuation-in-part of Ser. No. 647,381, Jan. 29, 1991, abandoned, and a continuation-in-part of Ser. No. 860,766, Mar. 27, 1992, abandoned, which is a continuation-in-part of Ser. No. 647,371, Jan. 29, 1991, abandoned, said Ser. No. 85,266, is a continuation-in-part of Ser. No. 786,585, Nov. 1, 1991, Pat. No. 5,223,198, and a continuation-in-part of Ser. No. 786,582, Nov. 1, 1991, Pat. No. 5,244,616, and a continuation-in-part of Ser. No. 786,584, Nov. 1, 1991, Pat. No. 5,223,197.

[51] Int. Cl.[6] ..... D01D 5/088; D01D 10/02; D01F 6/62; D02J 1/22

[52] U.S. Cl. ..... 264/103; 28/254; 28/271; 57/287; 57/289; 57/310; 57/350; 57/908; 264/168; 264/171; 264/177.13; 264/210.8; 264/211.12; 264/211.15; 264/211.17; 264/234; 264/235; 264/237; 264/342 RE

[58] Field of Search ..... 264/103, 168, 177.13, 264/210.8, 211.12, 211.15, 211.17, 234, 235, 237, 342 RE, 171; 28/254, 271; 57/287, 288, 289, 310, 350, 908

[56] References Cited

U.S. PATENT DOCUMENTS 4,415,521 11/1983 Mininni et al. ..... 264/211.15
4,909,976 3/1990 Cucolo et al. ..... 264/211.15

FOREIGN PATENT DOCUMENTS 207489 1/1986 European Pat. Off. .

*Primary Examiner*—Leo B. Tentoni

[57] ABSTRACT

Polyester filaments of high shrinkage and high shrinkage tension may be prepared by heat treatment of undrawn crystalline filaments of low shrinkage and shrinkage tension, and may be used for making polyester yarns of mixed shrinkage and bulky polyester yarns and fabrics therefrom.

26 Claims, 20 Drawing Sheets

COLD CRYSTALLIZATION TEMPERATURE (Tcc),°C
140
130
120
110
100
90
80
a
b
c
d
0
.02
.04
.06
.08
AMORPHOUS BIREFRINGENCE (RDDR)/(min)½
300
250
200
150
100
50
0
2
1
15
10
5
0
Mpy, g/dd
0
.04
.08
.12
.16
.20
BIREFRINGENCE (△n)

PROCESS OF MAKING SPIN-ORIENTED POLYESTER FILAMENTS

CROSS-REFERENCE TO RELATED APPLICATIONS

This is a continuation-in-part of application Ser. No. 07/786,585, filed by Frankfort et al, Nov. 1, 1991, now U.S. Pat. No. 5,223,198, and of the following two applications, that were also filed Nov. 1, 1991, 07/786,582, filed by Hendrix et al, now U.S. Pat. No. 5,244,616, and 07/786,584, filed by Boles et al, now U.S. Pat. No. 5,223,197, and of Divisional application Ser. No. 08/035,988, filed by Boles et al, Mar. 23, 1993, now allowed and of the following two applications Ser. Nos. 07/753,529 and 07/753,769, both filed by Knox et al, Sep. 3, 1991, and now U.S. Pat. Nos. 5,229,060 and 5,261,472, all filed as continuations-in-part (directly or indirectly) of application Ser. No. 07/338,251, filed Apr. 14, 1989, now U.S. Pat. No. 5,066,447, sometimes referred to herein as the "parent application", but also itself a continuation-in-part application of now abandoned application Ser. No. 07/053,309, filed May 22, 1987, as a continuation-in-part of now abandoned application Ser. No. 824,363, filed Jan. 30, 1986; and is also a continuation-in-part of applications Ser. Nos. 08/005,672 (now U.S. Pat. No. 5,228,553) and 08/015,733 (now U.S. Pat. No. 5,250,245) both filed by Collins et al, on Jan. 19, 1993 and Feb. 10, 1993, respectively, as continuations-in part of now abandoned applications Ser. Nos. 07/647,381, filed Jan. 29, 1991, and 07/860,766, filed Mar. 27, 1992, as continuation-in-part of now abandoned application Ser. No. 07/647,371, also filed Jan. 29, 1991.

TECHNICAL FIELD

This invention concerns improvements in and relating to polyester (continuous) filaments, especially those prepared as-spun in the form of flat yarns, a capability to provide from the same feed stock such polyester continuous filament yarns of various differing deniers shrinkage properties, tensiles, dyeability and of other useful properties as desired; polyester flat yarns, as well as filaments, generally, including tows, resulting from such processes; mixed-filament yarns, bicomponent filament yarns, biconstituent filament yarns and bulky yarns prepared therefrom; and downstream products from such filaments and yarns, including textured products, and including new processes for preparation of these new filaments and products therefrom.

It may be helpful, in view of differences in terminology in various literature, to indicate that the terminology, symbols and expressions used herein are intended generally to follow those in copending application Ser. No. 08/015,733 (Collins et al), mentioned above, the disclosure of which is incorporated herein by reference, including, e.g., the listing of such near the end of the description therein.

BACKGROUND OF PARENT APPLICATION (U.S. Pat. No. 5,066,447)

Textile designers are very creative. This is necessary because of seasonal factors and because the public taste continually changes, so the industry continually demands new products. Many designers in this industry would like the ability to custom-make their own yarns, so their products would be more unique, and so as to provide more flexibility in designing textiles.

Polyester (continuous) filament yarns have for many years had several desirable properties; but, hitherto, there has been an important limiting factor in the usefulness of most polyester flat yarns to textile designers, because only a limited range of yarns has been available from fiber producers, and the ability of any designer to custom-make his own particular polyester flat yarns has been severely limited in practice. The fiber producer has generally supplied only a rather limited range of polyester yarns because it would be more costly to make a more varied range, e.g. of deniers per filament (dpf), shrinkage properties, tensiles, and dyeability, and to stock an inventory of such different yarns.

Conventional flat polyester filament yarns used to be typically prepared, for example, by melt-spinning at low or moderate speeds to make undrawn yarns and then drawing and heating to increase tensiles (especially, modulus and yield point) and to decrease shrinkage. Conventional polyester filaments have combinations of properties that, for certain end-uses, could desirably be improved, as will be indicated hereinafter. It is important to recognize that what is important for any particular end-use is the combination of all the properties of the specific yarn (or filament), sometimes in the yarn itself during processing, but also in the eventual fabric or garment of which it is a component. It is easy, for instance, to reduce shrinkage by a processing treatment, but this modification is generally accompanied by other changes, so it is the combination or balance of properties of any filament (or staple fiber) that is important.

Generally, we refer herein to untextured filament yarns as "flat" yarns and to undrawn flat yarns as "feed" or as "draw-feed" yarns. Filament yarns which can be used as a "textile" yarn without need for further drawing and/or heat treatment are referred herein as "direct-use" yarns. For textile purposes, a "textile" yarn must have certain properties, such as sufficiently high modulus and yield point, and sufficiently low shrinkage, which distinguish these yarns from conventional feed yarns that require further processing before they have the minimum properties for processing into textiles and subsequent use. It will be recognized that, where appropriate, the technology may apply also to polyester filaments in other forms, such as tows, which may then be converted into staple fiber, and used as such in accordance with the balance of properties that is desirable and may be achieved as taught hereinafter.

From the parent application (now U.S. Pat. No. 5,066,447, the disclosure of which is hereby incorporated herein by reference), it is known that conventional polyester undrawn spin-oriented yarns (SOY) (and SOF, i.e., spin-oriented filaments) draw by a necking operation; i.e., that the undrawn polyester filaments have a natural draw-ratio NDR (and that drawing such polyester filaments at draw-ratios less than the NDR (herein referred to as partial-drawing) produces irregular "thick-thin" filaments which are considered inferior for most practical commercial purposes (unless a specialty yarn is required, to give a novelty or special effect). For filament yarns, the need for uniformity is particularly important, more so than for staple fiber. Fabrics from flat yarns show even minor differences in uniformity from partial drawing of conventional polyester undrawn SOY as defects, especially when dyeing these fabrics. Thus, uniformity in flat filament yarns is extremely important. Undrawn polyester filaments have been unique in this respect because nylon filaments and polypropylene filaments have not had this defect. Thus, it has been possible to take several samples of a nylon undrawn yarn, all of which have the same denier per filament, and draw them, using different draw-ratios, to obtain correspondingly different deniers in the drawn yarns, as desired, without some being irregular thick-thin filament yarns, like partially drawn polyester filament yarns.

So far as is known, it had not previously been suggested, prior to the parent application, that a draw process be applied to a polyester textile yarn, i.e., one that was itself already a direct-use yarn, such as having shrinkage and tensile properties that made it suitable for direct use in textile processes such as weaving and knitting without first drawing and heat setting. Indeed, to many skilled practitioners, it might have seemed a contradiction in terms to subject such a yarn to draw-warping, for example, because such a yarn was already a textile yarn, not a feed yarn that needed a drawing operation to impart properties useful in textile processes such as weaving or knitting.

According to the parent application, processes were provided for improving the properties of feed yarns of undrawn polyester filaments (especially undrawn polyester filament feed yarns that have the shrinkage behavior of spin-oriented polyester filaments such as have been disclosed by Knox in U.S. Pat. No. 4,156,071, and by Frankfort & Knox in U.S. Pat. Nos. 4,134,882 and 4,195,051 (discussed hereinafter). Such processes (according to the parent application) involve drawing with or without heat and with or without post heat-treatment, and are most conveniently adapted for operation using multi-end drawing, such as draw-warping; but such benefits may be extended to other drawing operations, such as preparing drawn flat yarns by split and coupled drawing of single-ends (or of a small number of ends, typically corresponding to the number of spin packages per winder or spin position of a small unit of winders) and to various draw (and no-draw) texturing processes for providing bulky filament yarns, such as by draw false-twist and air-jet texturing and no draw air-jet and stuffer-box texturing.

BACKGROUND OF THE PRESENT INVENTION

It has long been desired to make filaments of differing shrinkage behaviors, such as boil-off shrinkage (S), maximum shrinkage tension ($ST_{max}$), shrinkage power ($P_s$), and shrinkage modulus ($M_s$), especially from one and the same filament feed stock; and especially of $P_s$ sufficient to overcome the high internal fabric matrix restraints and permitting the development of the desired level of shrinkage even when the filaments are in a fabric; e.g., such as being used as a high shrinkage filament yarn in a form-fitting fabric used in upholstery, as a component in a mixed-shrinkage filament yarn such as would be capable of developing bulk by differential filament length (DFL) on heating, as a component in a bicomponent polyester filament yarn and as a component in a biconstituent polyester/nylon filament yarn such as would be capable of developing bulk by torque-free helical crimping of the filaments on heating, even in tightly-woven fabrics. There has been a long-standing need for a practical way to make filaments, differing in shrinkage and tensile properties from a single feed stock, and previous suggestions have not been satisfactory.

Shrinkage power ($P_s$) herein is the product of the boil-off shrinkage (S)×($ST_{max}$), the maximum shrinkage tension, whereas shrinkage modulus ($M_s$) is 100 times the maximum shrinkage tension divided by the shrinkage, i.e. ($ST_{max}$/S%)×100.

Shrinkage of undrawn SOY initially increases with increasing spin speed (i.e., with increasing stress-induced orientation (SIO) as represented, in part, by decreasing elongation-to-break, $E_B$), and then beyond a critical SIO level, shrinkage decreases at higher spin speeds due to the onset of stress-induced crystallization (SIC) which prevents the maximum shrinkage potential ($S_m$) for a given level of SIO from developing (see discussion of FIGS. 2A and 2B hereinafter). Increased shrinkage of SOY may be accomplished by changing known process parameters; such as, lower polymer LRV, increased polymer temperature, increased capillary shear rate (smaller capillary diameter), increased capillary pressure drop (increased capillary L/D), lower extensional "Trouton" viscosity (hotter quench air, lower quench air velocity, delay quench, longer convergence distance), higher denier per filament, reduced spin-orientation (lower spin speeds), reduced crystallization rate with modified copolymers, and other process parameters. However, increasing shrinkage by reducing the SIC, has resulted in undesirable changes in other properties, such as lower tensiles (e.g., $T_7$) and lower $ST_{max}$; higher values of both are desirable so that the desired fabric aesthetics can be developed during dyeing and finishing (see discussion of FIGS. 4 and 5 hereinafter).

A process to prepare polyester filaments of high shrinkage S and high $P_s$ directly in as-spun filaments, i.e., merely by melt spinning, without drawing, has not been disclosed in the prior art. Prior art processes that incorporate drawing, such as "cold drawing" of SOY and aerodynamic "space-draw" of SOY may offer routes to high $P_s$ yarns of sufficient tensiles but have had serious disadvantages. Such draw processes have not provided the desired combination of properties, i.e., a desirable balance of shrinkage S and $ST_{max}$, as expressed by $M_s$ and $P_s$, as will be discussed hereinafter (Example XIX). Also, and importantly, these draw processes have not provided yarns with good dyeability (i.e., high relative disperse dye rates, RDDR), and drawn polyester yarns have had poor thermal stability (herein defined by high shrinkage differential ($\Delta S_1$) as measured by rapid increase in dry heat shrinkage with increasing temperature and also expressed by a significant difference ($\Delta S_2$) between the dry heat shrinkage (DHS) at elevated temperatures (180° C.) and the boil-off-shrinkage (S); drawn yarns, therefore, have required use of high fabric finishing treatment temperatures for proper fabric stabilization (e.g. at least to temperatures of T($ST_{max}$), e.g., about 150°–180° C.). Also these draw processes have not provided simple direct routes to mixed-shrinkage, bicomponent and biconstituent filament yarns.

Crystalline SOY used as "direct-use" textile yarns, such as those prepared by Knox, Frankfort & Knox, and Collins et al (referred to hereinbefore) are characterized by good dyeability (high RDDR), good thermal stability (characterized herein by low $\Delta S_1$ and $\Delta S_2$-values, and reach $ST_{max}$ at T($ST_{max}$) typically less than about 100° C. (i.e., that can be achieved during boil-off, such in a dyebath); i.e., properties that are generally very desirable for "textile" yarns; but such crystalline SOY do not have "high shrinkage power", but are of low shrinkage S and low $ST_{max}$. Thus, the prior art has not taught how to solve the problem of providing polyester SOY having the combination of high values of shrinkage S, $ST_{max}$, $P_s$, and low values of $M_s$ combined with the desirable dyeability (RDDR), thermal stability. ($\Delta S_1$ and $\Delta S_2$), and other properties associated with Crystalline SOY.

SUMMARY OF THE INVENTION

The present invention provides such long-desired high shrinkage spin-oriented filaments, SOF (herein referred to as B-filaments, filaments (B) or as filaments Type B), by novel and simple direct processes involving essentially increasing the shrinkage of crystalline low shrinkage SOF capable of being used as direct-use "textile" filaments (herein referred to as A-filaments, filaments (A) or as filaments Type A), such as were used as "feed" yarns in the parent application. Such processes can transform the crystalline low shrinkage SOF (Type A) into new SOF (Type B), characterized by high $P_s$ and low $M_s$ without reducing other desirable properties, including thermal stability (low $\Delta S_1$ and $\Delta S_2$) and dyeability (RDDR). We believe that no one has previously suggested that the long-standing problem could be solved by using crystalline low shrinkage direct-use textile SOF as "feed" filaments (i.e., as intermediates) for preparing SOF of the desired high shrinkage S and high $ST_{max}$. Indeed, to many skilled practitioners, it might have seemed a contradiction in terms to begin with crystalline thermally "stable" SOF as intermediate for obtaining a precursor of high shrinkage SOF (i.e., that are not so stable thermally). It may indeed seem very surprising that the shrinkage can be increased while maintaining such desirable properties. It may seem especially surprising to some practitioners that the shrinkage values can be increased, while maintaining thermal stability (i.e., low $\Delta S_1$ and $\Delta S_2$ values) and without reducing dyeability (i.e., low RDDR values).

According to a first aspect of the invention, a treatment process is provided for preparing polyester SOF of high shrinkage (S), high $ST_{max}$, high $P_s$ and low $M_s$ by treating the crystalline low shrinkage SOF (Type A) by rapidly heating the A-filaments to a temperature above the polyester polymer glass-transition temperature $T_g$ (defined herein by $\{0.65(T_m^o+273)-273\}$) and temperature $T_3$, defined as the mid-point between the onset temperature of crystallization ($T_c^o$) and the onset temperature of major crystallization, $T_{c,\frac{1}{2}}$ as measured on the polyester polymer and expressed by $[(\{0.75(T_m^o+273)-273\}+\{0.80(T_m^o+273)-273\})/2=\{0.775(T_m^o+273)-273\}]$, and then immediately and rapidly cooling the treated filaments to below the polymer $T_g$, and ensuring that the heating and cooling are carried out at rates sufficiently rapid to provide the desired B-filaments [shown as Areas A and B in FIG. 1] having:

1) a residual draw-ratio (RDR) of about 1.4 to about 1.9, a post-yield modulus ($M_{py}$ of less than about 12 g/dd, and a high shrinkage S such that the value of $(1-S/S_m)$ is between about 0.25 and about 0.9; where RDR is defined by $(1+100/EB,\%)$ and $S_m$ is defined by $[(6.5-RDR)/6.5]\times 100\%$;

2) a high $ST_{max}$ of about 0.1 g/d to about 0.5 g/d at a $T(ST_{max})$ between about the polymer $T_g$ and about temperature $T_1$ (defined herein by $\{0.725(T_m^o+273)-273\}$);

3) a $M_s$ up to about 5 g/d; and a $P_s$ of about 1.5 to 12 (g/d) %;

it being important that the A-filaments (before such heat treatment process) be low shrinkage spin-oriented crystalline undrawn A-filaments characterized by:

1) a RDR between about 1.4 and about 1.9 and a shrinkage S such that the value of $(1-S/S_m)$ is at least about 0.9;

2) a $ST_{max}$ less than about 0.15 g/d at a $T(ST_{max})$ between about the polymer $T_g$ and the polymer liquid-liquid transition temperature $T_{11}$ defined herein by $\{0.70(T_m^o+273)-273\}$;

and desireably having, 3) a $M_s$ less than about 5 g/d; and a $P_s$ less than about 1.5 (g/d) %.

One embodiment of the treatment process of the invention (herein called Type I) is characterized by rapidly heating said A-filaments to temperatures between the $T_{11}$ and about temperature $T_2$, defined herein as the mid-point between $T_{11}$ and the onset of crystallization $T_c^o$, i.e. $\{0.725(T_m^o+273)-273\}$, and then immediately and rapidly cooling the treated filaments to below the polymer $T_g$; wherein said heating and cooling are carried out at rates sufficiently rapid to provide B-filaments from said A-filaments.

Another variation of the treatment process of the invention (herein called Type II) is characterized by rapidly heating said A-filaments to a temperature between about $T_2$ and about $T_3$; and then immediately and rapidly cooling the treated filaments to below $T_g$; wherein said heating and cooling are carried out at rates sufficiently rapid to provide B-filaments from said A-filaments.

Treatment processes Type I and Type II of the invention may be carried out in a split process (sp), such as in air-jet texturing, and in the form of a weftless warp sheet, provided that the heating and cooling are carried out at rates sufficiently rapid to provide B-filaments from said A-filaments.

Treatment processes Type I and Type II may be coupled (cp) with first preparing polyester A-filaments by melt-extruding and rapid attenuating and quenching the polymer melt streams at withdrawal speeds in the range of about 2 to about 6 km/min to provide filaments (Type A) at temperatures below the polymer $T_g$ and then treating the A-filaments by either process Type I or Type II to provide B-filaments, followed by high speed winding into packages.

B-filaments of the invention as prepared by Type I and Type II treatment processes of the invention, as described hereinabove, have a Ps between about 1.5 and about 12 (g/d)%, a $M_s$ less than 5 g/d, and shrinkage S, such that $(1-S/S_m)$ is at least about 0.25 and less than about 0.9 for RDR values between about 1.4 to about 1.9; a $T(ST_{max})$ between about the $T_g$ and about the $T_1$ of the polyester polymer; and a $ST_{max}$ between about 0.1 and 0.5 g/d (as indicated by Areas A and B in FIG. 1); and the B-filaments of the invention are further characterized by a tenacity-at-10% extension (T10) less than about 3 g/d, a post-yield modulus ($M_{py}$), defined by $\{(1.2T_{20}-1.07T_7)/(1.2-1.07)\}$ between about 2 and about 12 g/dd (where g/dd is grams per drawn denier) which approximately corresponds to a birefringence ($\Delta_n$) between about 0.04 and about 0.12 providing good dyeability as indicated by RDDR values of at least about 0.08; and sufficient tensiles for use as textile filaments as indicated by an initial yield point $T_y$ (herein approximated by the value of the tenacity-at-7% extension $T_7$) of at least about 0.1 g/d.

Preferred B-filaments of the invention as prepared by Type I and Type II treatment processes of the invention, as described hereinabove, are further characterized by a shrinkage S, such that $(1-S/S_m)$ is at least about 0.4 and less than about 0.9; a $T(ST_{max})$ between about the $T_g$ and about the $T_{11}$ of the polyester polymer; a $T_{10}$ less than about 2.5 g/d, a $M_{py}$ between about 2 and about 10 g/dd which approximately corresponds to a birefringence ($\Delta_n$) between about 0.04 and about 0.10 providing good dyeability as indicated by RDDR values of at least about 0.10; and sufficient tensiles for use as textile filaments as indicated by $T_7$ of at least about 0.15 g/d.

Especially preferred B-filaments of the invention are further characterized by a $\Delta S_1$ value of less than 5 degrees over the temperature range of the polymer $T_{11}$ and $T_{c,max}$; and a $\Delta S_2$ less than +3%.

The invention also provides B-filaments being especially suitable for improved draw texturing feed yarns [Area A in FIG. 1] for developing higher bulk at conventional texturing speeds or maintaining current levels of bulk at higher texturing speeds; wherein the B-filaments are prepared by heat treatment Type I of Type A filaments; wherein the B-filaments are characterized by having a RDR between about 0.4 and 0.9; a shrinkage S, such that $(1-S/S_m)$ is less than about 0.25 and at least about 0.9 with a $ST_{max}$ between about 0.1 and 0.15 g/d and a $M_s$ less than about 1.5 g/d; and further characterized by a $T(ST_{max})$ between about the $T_g$ and about the $T_{11}$ of the polyester polymer.

The invention also provides for B-filaments of enhanced tensiles (such as a $T_7$ of at least about 0.15 g/d and an initial modulus $M_i$ of at least about 60 g/d) by low temperature drawing without post heat treatment (herein referred to as process Type III) of B-filaments (as represented by Areas A and B in FIG. 1 and described hereinbefore) at draw temperatures $T_D$ between temperatures $T_g$ and $T_1$ of the polyester polymer; wherein the drawn B-filaments of higher tensiles are further characterized by a $T(ST_{max})$ between about $T_g$ and about $T_2$ of the polyester polymer, with a $ST_{max}$ between about 0.5 and 0.7 g/d; and a shrinkage S such that $(1-S/S_m)$ is at least about 0.4 and less than about 0.9; a $P_s$ between about 5 and 12 (g/d)% and a $M_s$ between about 1.5 and about 5 g/d; while retaining a $M_{py}$ less than about 12 g/dd which approximately corresponds to RDDR-values greater than about 0.08.

The invention also provides improved flat "A-filament" yarns, especially suitable for tightly constructed woven fabrics [Area D in FIG. 1], by treating thermally stable Type A' filaments by Type II process of the invention (herein referred to as process Type IV) wherein the changes in the thermal properties on the "thermally stable" A'-filaments are small, but sufficient to make the filaments suitable for both knitting and weaving where untreated A'-filaments were only suitable for knit fabrics); wherein the improved flat yarns are characterized by having a RDR between about 1.4 and 1.9, a $T_7$ of at least about 0.15 g/d; a shrinkage S, such that $(1-S/S_m)$ is between about 0.95 and 0.9 and a $ST_{max}$ between about 0.15 and 0.5 g/d such to provide a $P_s$ between about 1.5 and 5 (g/d)% with a $M_s$ between about 1.5 and 5 g/d; and further characterized by a $T(ST_{max})$ between about the $T_g$ and about the $T_1$ of the polyester polymer.

The process of the invention also provides a simple route to mixed-shrinkage filament yarns (herein denoted as AB and as A'B yarns) comprised of A(or A') filaments and B-filaments wherein the A (or A') filaments and the B-filaments may be co-mingled, for example in a separate split process to form a mixed filament bundle (e.g., prior to air-jet texturing) or may be formed in a coupled spin/treatment process (cp) wherein the freshly spun A-filaments are, for example, divided into two bundles with one bundle being treated by process Type I or Type II to form B-filaments which are then combined with the untreated A-filament bundle to form a mixed-shrinkage AB filament yarn; or by treating in a split or coupled process a mixed A'A-filament bundle comprised of A' and A-filaments, where A' filaments are of such thermal stability that their shrinkage properties are not significantly affected by the treatment step (Type I or Type II) of the invention, while the A-filaments are transformed, as described hereinbefore, to B-filaments, such that treatment of the A'A mixed-filament bundle provides an A'B mixed-shrinkage filament yarn. The A' filaments achieve their thermally stability , for example, by being of lower denier, odd cross section of significant surface-to-volume ratio; or the A and A'-filaments may be of the same dpf and cross-section, but are differentiated by their extrusion conditions; e.g., prior to extrusion, the polyester melt stream is divided into two melt streams, wherein one of the two melt streams is treated, for example, via injection of an agent into the melt stream that either enhances crystallization thus forming A'-filaments from A-filaments or injection of any agent that suppresses crystallization and thus forming A-filaments from A'-filaments on extrusion and attenuation, or alternatively, one the melt streams may be of different melt viscosity by use of higher shear spinneret extrusion capillaries fitted with metering capillaries such that the total pressure drop of the A forming capillaries is equal to that of the A' forming capillaries in order to maintain the same dpf of A and A'-filaments. The filaments extruded at the lower melt viscosity will achieve lower SIC and become the A-filaments, while the filaments extruded at the higher melt viscosity will achieve higher SIC and become the A'-filaments. Spinning of melt streams which differ in polymer RV or in the degree to which they are modified by copolyester units may also be used to form A and A'-filaments.

The process of the invention also provides for mixed-filament post-bulkable BC'-yarns comprised of B-filaments and of companion thermally stable C'-filaments of a different polymer substrate, such as of nylon by a coupled melt spinning/treatment process wherein the mixed filament bundle of B and C'-filaments may be prepared by co-spinning A and C'-filaments, forming a mixed-filament AC' bundle followed by co-treating the mixed-filament AC' bundle wherein in the A-filaments are transformed into B-filaments according to the invention and the nylon C'-filaments remain of low shrinkage.

Alternatively the B and C'-filament bundles may be formed in separate steps and co-mingled to provide a post-bulkable BC' mixed-filament yarn. The bulking of these mixed-filament yarns (AB, A'B, BC') occurs on heat relaxation at temperatures above about $T_{11}$ but less than $T_{c,max}$ (preferably less than about $T_{c,\frac{1}{2}}$) of the polyester polymer; and may take place in yarn form, such as in a hot air-jet texturing process or in the form of a weftless warp sheet in a warping process wherein the weftless warp sheet is permitted to hot relax before winding onto a beam or prior to being fed directly into a warp knitting machine or into a weaving loom or the bulk may be developed in fabric or garment form during dyeing and finishing.

The processes of the invention may be extended to bicomponent filaments comprised of one component being thermally stable under the conditions of either process Type I or Type II and a second component being less thermal stability; e.g., an (A'/A) bicomponent filament which when treated according to the treatment processes of the invention (Type I or Type II) provides a (A'/B) bicomponent filaments which on exposure to heat will spontaneously provide filaments of torque-free helical crimp. An analogous biconstituent filament is also provided by the process of the invention wherein the thermally stable component is of polyamide polymer (C') and the second component of lesser thermal stability is of polyester polymer (A) to provide a (A/C') biconstituent filaments which when treated according to the treatment processes of the invention (Type I or Type II) provide (B/C') biconstituent filaments which on exposure to heat will spontaneously provide filaments of torque-free helical crimping. The bicomponent and biconstituent filaments may be of a side-by-side (SBS) or of a sheath/core (S/C) configuration. Further, mixed deniers and/or cross-sections may be used to disrupt the tendency of helical crimped filament yarns from forming "follow-the-leader crimp" and thereby by provide for improved bulk and coverage (opacity).

The treatment processes of the invention (Type I through IV) may incorporate a pretreatment step, wherein the untreated A, A', A/A', A/C', AA', and AC' filament bundles are passed under sufficient tension and velocity over a surface of selected roughness to provide sufficient thermal fictional heat to provide the treated filaments with asymmetric thermal stability (as described in part by Frankfort in U.S. Pat. Nos. 3,816,992, 3,861,133, and 3,905,077). The treated filaments having irregular and asymmetric shrinkage behavior along-end are then treated by Type I, II, or III processes of the invention to provide on heat relaxation along-end filament crimping and filament bulk of a different nature than that achieved by mixed shrinkage filament yarns and by bicomponent or by biconstituent filament yarns This pretreatment process used in conjunction with Type I, II, or III processes of the invention is herein referred to as process Type V.

The treatment processes (Type I, II, or III) of the invention may by applied to filaments of asymmetric cross-section, such as a "lop-sided peanut-shaped" filament wherein one side being larger has the shrinkage characteristics more like that of an A-filament while the smaller side has the shrinkage characteristics more like that of a thermally stable A'-filament such that the asymmetric filament is likened to an A/A' bicomponent filament yarn in its shrinkage behavior.

The treatment processes (Type I, II, or III) of the invention may by applied to filaments of symmetric or asymmetric cross-section being comprised of an off-center longitudinal void of at least 10% (preferably at least 20%) by volume of the filament; wherein, the "solid" side of the filament has the shrinkage characteristics more like that of an A-filament while the side of the filament containing the void has the shrinkage characteristics more like that of a thermally stable A'-filament such that the hollow filament is likened to an A/A' bicomponent filament yarn in its shrinkage behavior. Refer to Example G for details

Figure 1:
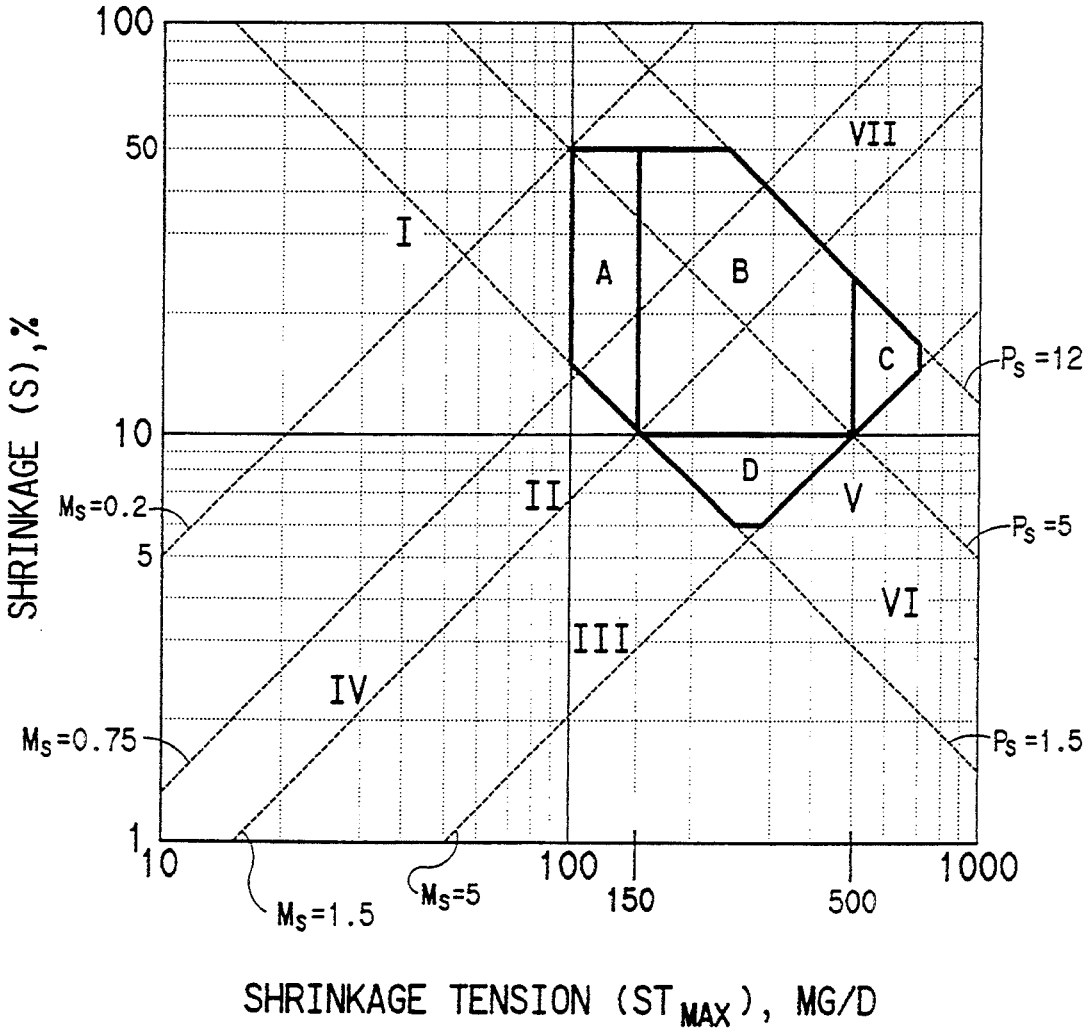
FIG. 1 is a log-log (base 10) plot of percent shrinkage (S) versus the maximum shrinkage tension $ST_{max}$ expressed in mg/d (i.e., g/d×1000), wherein the left diagonal grid dashed lines represent different values of shrinkage power $P_s[=(ST_{max})(S\%)]$ increasing from bottom left to top right of the plot; and the right diagonal grid dashed lines represent different values of shrinkage modulus $M_s[=(ST_{max}/S\%)\times 100\%]$ increasing from top left to bottom right. The solid lines outline combinations of shrinkage properties that characterize various spin-oriented B-filaments of the invention (Areas A and B); B-filaments of higher tensiles through low temperature drawing of spin-oriented B-filaments of Areas A and B (Area C); and low shrinkage flat filaments of improved tensiles by treatment of A'-filaments by process Type IV (Area D). B-filaments of Area B are especially suited for use in mix-shrinkage post-bulkable filament yarns, draw texturing feed yarns for improved bulk development, and where high shrinkage filament yarns for developing fabrics of more tight constructions than are possible by direct knitting or weaving of conventioal flat textile filament yarns. B-filaments of Area A are especially suited for use as draw texturing feed yarns where higher bulk is desireable. Low temperature drawn B-filaments of Area C are of higher tensiles without loss in dyeability as indicated by RDDR-values of at least 0.08. Improved low shrinkage flat yarns formed by treating Type A' filament yarns by process IV (Area D) are especially suited for woven fabrics and for obtaining fabrics of tigher construction than possible by direct knitting or weaving of conventional low shrinkage flat yarns.

Various conventional spin-oriented filaments spun over a spin speed range of about 500 m/min to about 7500 m/min are represented in FIG. 1 as follows: Area I for high shrinkage spin-oriented yarns (e.g., commercial POY); Area II for low shrinkage high speed spun direct-use yarns according to Knox; Area III for especially thermally stable highly oriented yarns, HOY (indicative of Type A'-filaments, described hereinbefore) as taught by Frankfort and Knox, and Collins et al.; Area IV for highly annealed (and/or relaxed) spun, drawn and draw-textured yarns; Area V for conventional spin/drawn (fully drawn yarns, FDY) textile yarns; Area VI for high shrinkage modulus "space-drawn" yarns, such as those disclosed by Davis et al in U.S. Pat. No. 4,195,161; and Area VII for high shrinkage filament yarns with high orientation (and thereby poor dyeability), such as disclosed by, Teijin (Shimazu et al) in EPA-0207489.

Figure 2A:
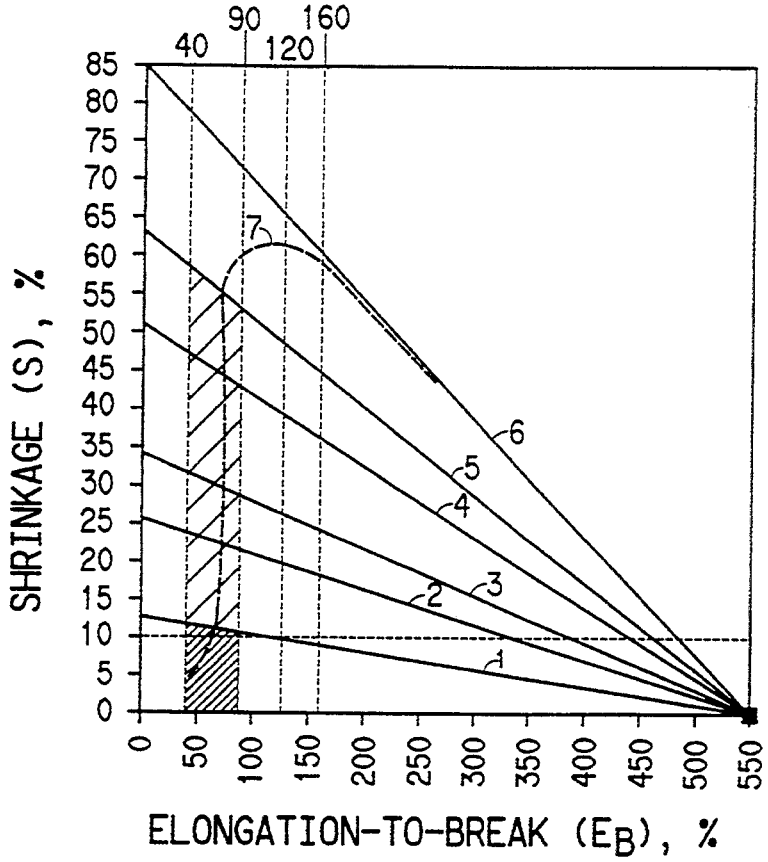

FIG. 2A is a representative plot of percent shrinkage S versus percent elongation-to-break (EB) wherein Lines 1, 2, 3, 4, 5, and 6 represent $(1-S/S_m)$-values of 0.9, 0.7, 0.6, 0.4, 0.25 and 0, respectively; and the curve shaped Line 7 represents a typical shrinkage versus elongation-to-break relationship for a series of yarns formed by increasing spinning speed, for example, wherein all other process variables remain unchanged. Changing other process variables (such as dpf, polymer viscosity, capillary $L/D^4$) produces a "family" of similar S-shaped curves, essentially parallel to each other. The spin-oriented B-filaments of the invention are denoted by the "widely-spaced //////-area bordered by $E_B$-values between about 40% and about 90% and $(1-S/S_m)$ values at least about 0.25(Line 5) and less than about 0.9 (Line 1). The A-filaments used to form the B-filaments of the invention are denoted by the "densely-spaced"///////- area bordered by $E_B$-values between about 40% and 90% and $(1-S/S_m)$ values at least about 0.9 (Line 1). The A'-filaments typically have $(1-S/S_m)$ values greater than 0.95 (i.e., are further below Line 1).

Figure 2B:
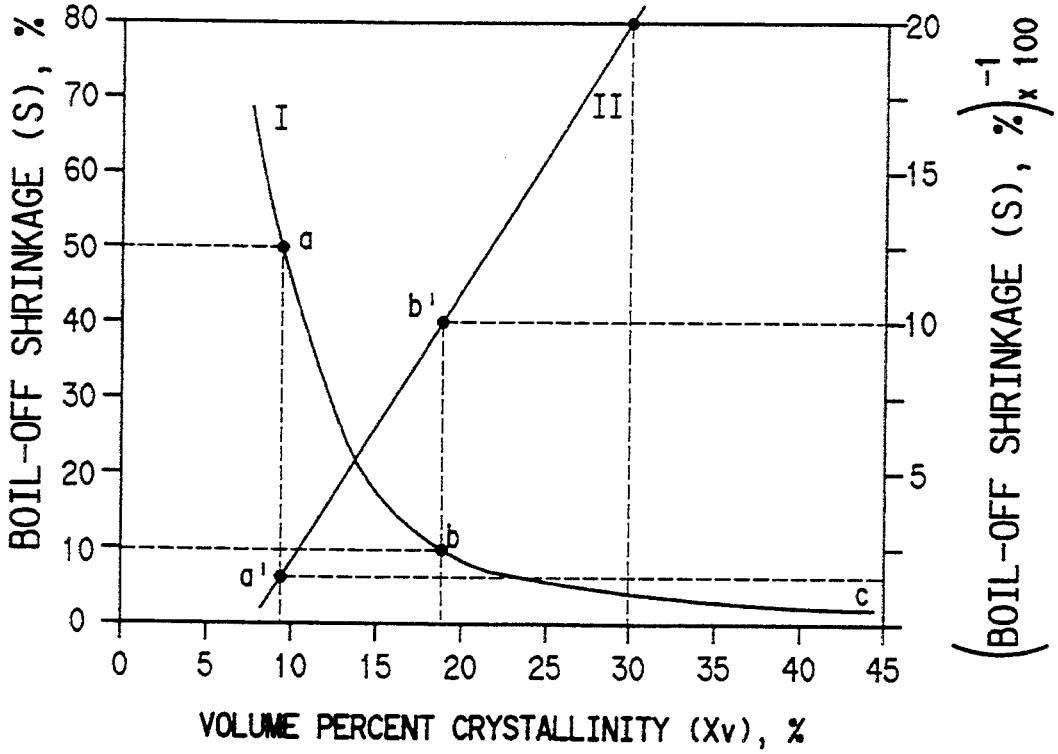

FIG. 2B (Curve I) is a representative plot of shrinkage S of SOF having a wide range of elongations-to-break $E_B$ from about 160% to about 40% (corresponding to RDR-values of 2.6-to 1.4), spun using a wide range of process conditions (e.g., filament denier and cross-section, spin speed, polymer LRV, quenching, capillary dimensions, and polymer temperature $T_p$), versus percent volume crystallinity (Xv) from measured density, corrected for density of % pigment). The singular relationship between S and Xv (i.e., extent of stress-induced crystallization SIC) obtained for SOF prepared by such differing process parameters supports the view that the degree of SIC is the primary structural event and that the degree of SIO is a secondary structural event in this range of $E_B$-values for determining the degree of shrinkage S. Curve II is a plot of the reciprocal of shrinkage $[(1/S)\times 100\%]$ and plotted versus percent crystallinity providing a linear relationship that is useful in estimating percent crystallinity from shrinkage.

Figure 3A:
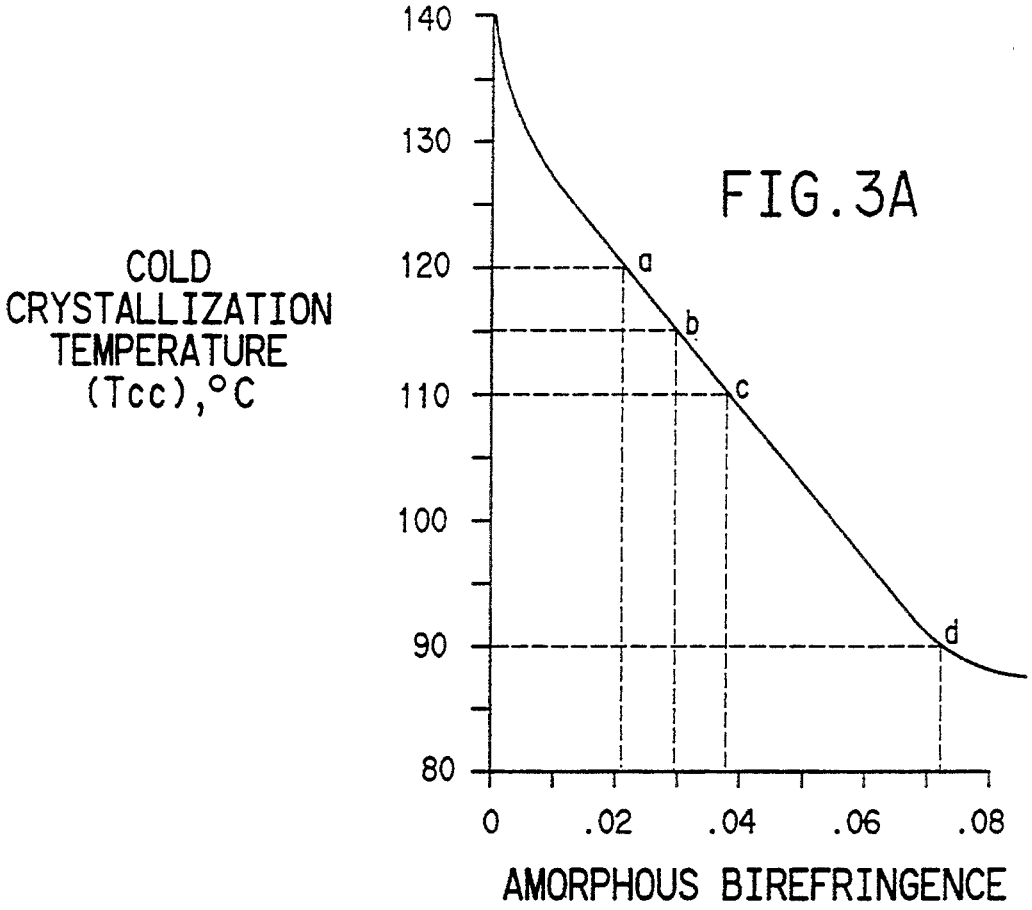

FIG. 3A is a representative plot of the peak temperature of "cold crystallization" ($T_{cc}$), as measured by Differential Scanning Calorimetry (DSC) at a heating rate of 20° C. per minute (refer to FIG. 12), versus amorphous birefringence (as defined in Frankfort and Knox); thus, the value of $T_{cc}$ is a useful measure of the amorphous birefringence (orientation) for filaments where measurement of birefringence is difficult. The A-filaments used herein to prepare the B-filaments of the invention have $T_{cc}$ values between about 90° C. and about 110° C.

Figure 3B:
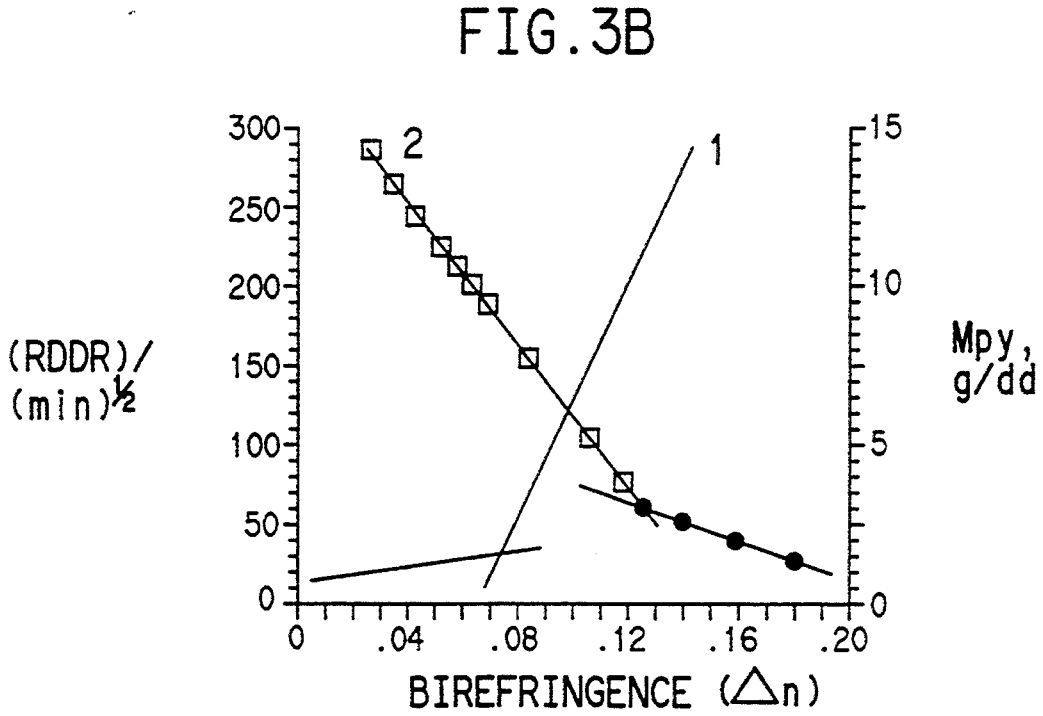

FIG. 3B Line 1 is a representative plot of the $M_{py}$ versus total birefringence ($\Delta_n$); thus, for $M_{py}$ values above about 2 g/d, the $M_{py}$ is a useful measure of total birefringence of spin-oriented, drawn, and textured filaments. The break in the linear relationship between $M_{py}$ and total birefringence is found to correspond to onset of major crystallization for spun yarns with increasing spin speed; but for a series of cold drawn yarns, the break represents the onset of significant increase in interchain order as noted by an increase in trans isomer content in the anorphous phase (determined by polarized infared spectroscopy).

Line 2 is a plot of RDDR values, normalized to 1 dpf after-boil-off and to an amorphous density of 1.335 g/cc, versus total birefringence ($\Delta_n$). Filaments of the invention have birefringence values between about 0.04 and 0.12, and RDDR-values at least about 0.08. The RDDR-values may be greater than the linear relationship of Line 2 because of the affect of crystal size and percent crystallinity, in addition to orientation (i.e., birefringence) on dyeability of polyester yarns.

Figure 4A:
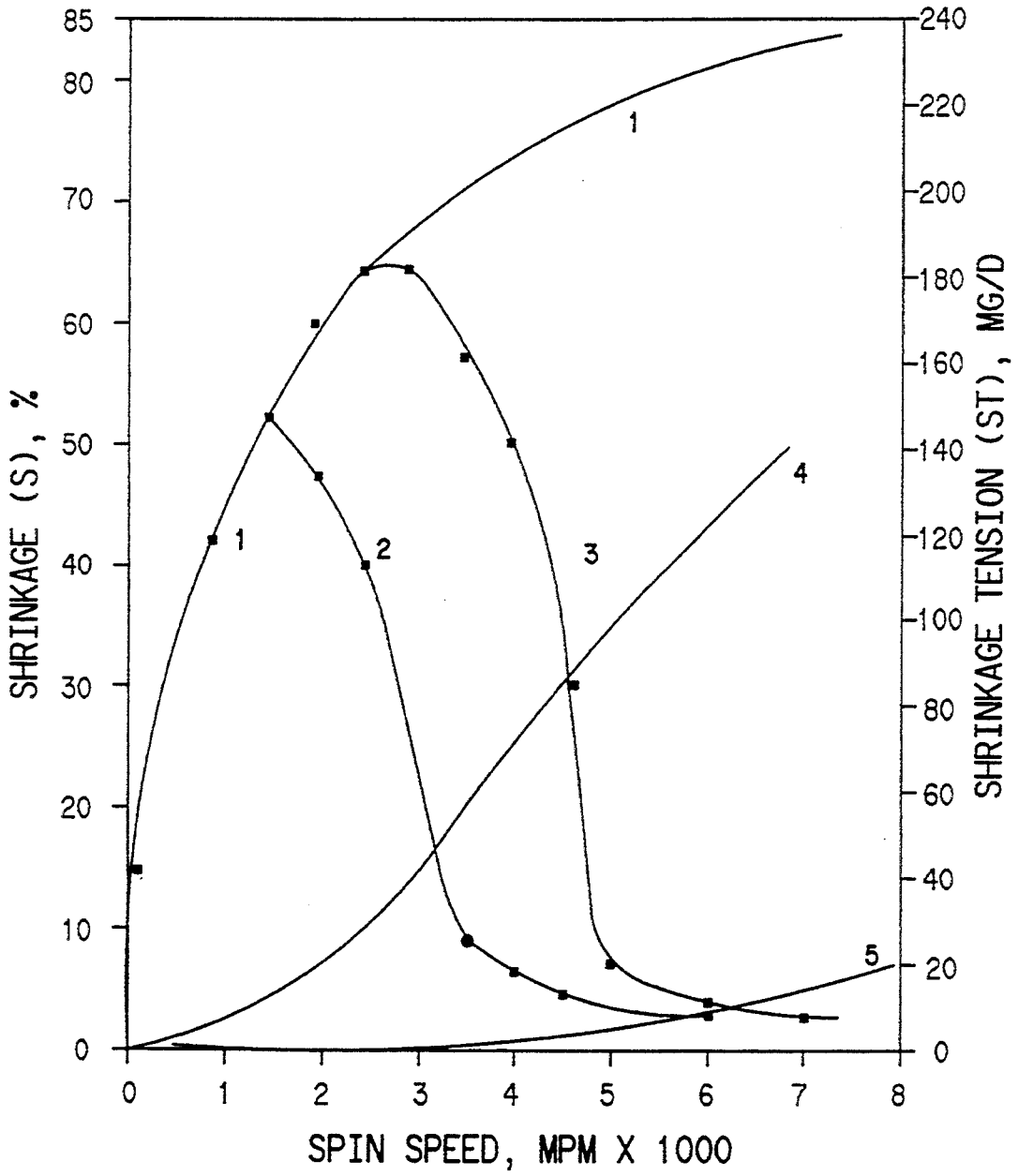

FIG. 4A is a plot of percent shrinkage S (or $ST_{max}$ for Curve 4) versus spin speed (mpm), taken as a measure of increasing SIO; where Curve 1 represents increasing shrinkage (i.e., $S_m$) in absence of SIC; Curve 2 represents shrinkage S versus spin speed with shrinkage decreasing (i.e., departing from Curve 1) at the onset of SIC which reduces shrinkage with increasing spin speed (typical of commercial POY); and Curve 3 represents shrinkage S versus spin speed wherein process conditions have been selected to "force" the onset of SIC at lower levels of SIO and is typical of the process used to form the A-filaments of the invention. Curve 4 is representative of the $ST_{max}$ for Curves 1, 2 and 3 versus spin speed. Curve 5 is representative of the shrinkage of nylon 66 spun yarns after equilibrated to standard relative humidity of 65% at 70 F. The shrinkage of nylon 66 modified with 5–10% copolyamides and of nylon 6 homopolymer spun yarns is slightly higher than that represented by Curve 5. Even higher shrinkages are possible with increasing modification with copolyamides as described by Knox et al in U.S. Pat. No. 5,137,666 and by Boles, et in U.S. Pat. No. 5,219,503.

Figure 4B:
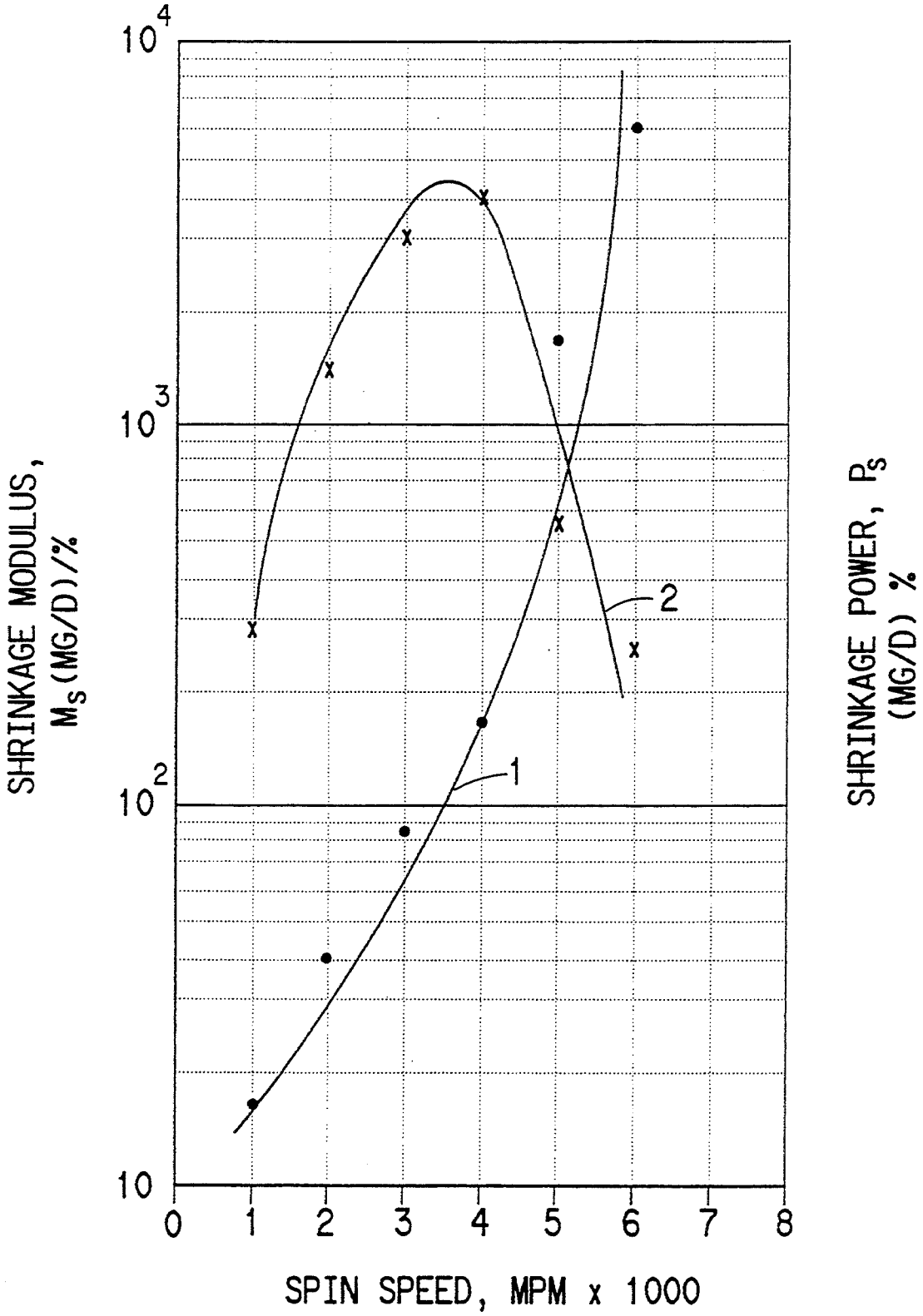

FIG. 4B is a semi-log (base 10) plot of the log of shrinkage modulus ($M_s$) and of shrinkage power ($P_s$) calculated from Curves 3 and 4 of FIG. 4A, versus spin speed (mpm); wherein $M_s$ (Curve 1) is defined, herein, as the result of dividing the values of Curve 4 by those of Curve 3 (of FIG. 4A) and plotting the result versus spin speed; and wherein $P_s$ (Curve 2) is defined, herein, as the result of the product of values of Curve 3 and of Curve 4 (of FIG. 4A) and plotting the results versus spin speed. The values of $P_s$ are observed to reach a maximum at spin speeds of about 3500–4000 mpm and then decrease rapidly with increasing spin speed, while $M_s$ increases with spin speed throughout this spin speed range. No spin-oriented filaments have been found to have the combination of shrinkage properties of the B-filaments of the invention. The fiber structure of the filaments represented by a decreasing $P_s$ with increasing speed (and decreasing elongation-to break) are characteristic of the A-filaments used herein for forming the B-filaments of the invention.

Figure 5B:
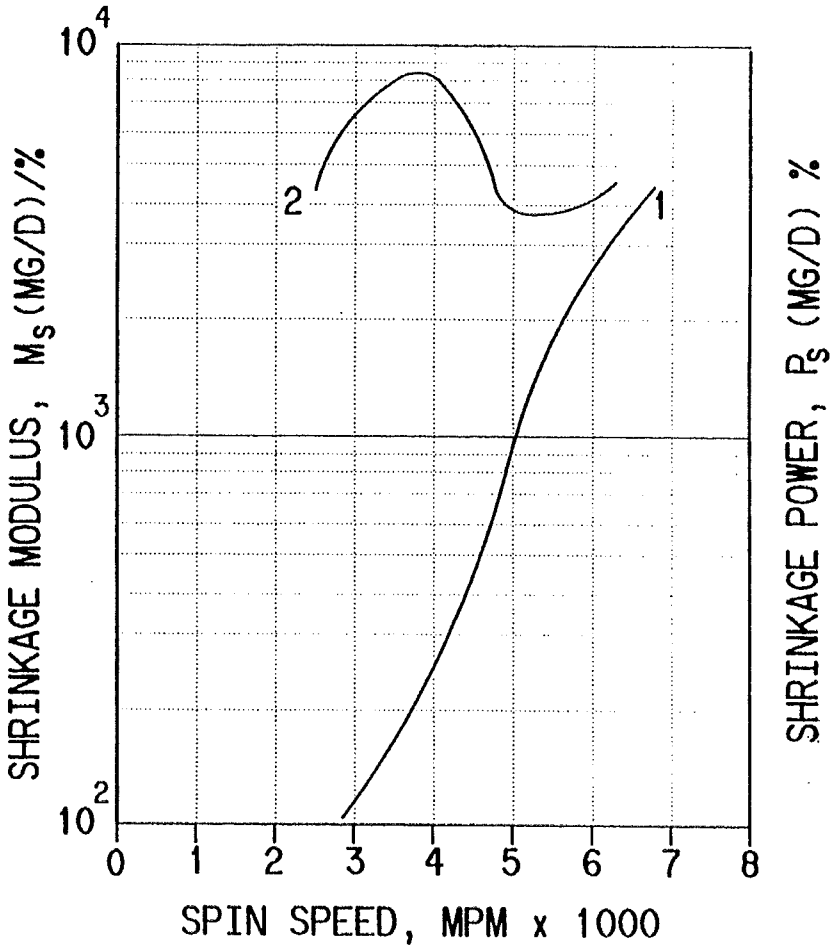
Figure 5A:
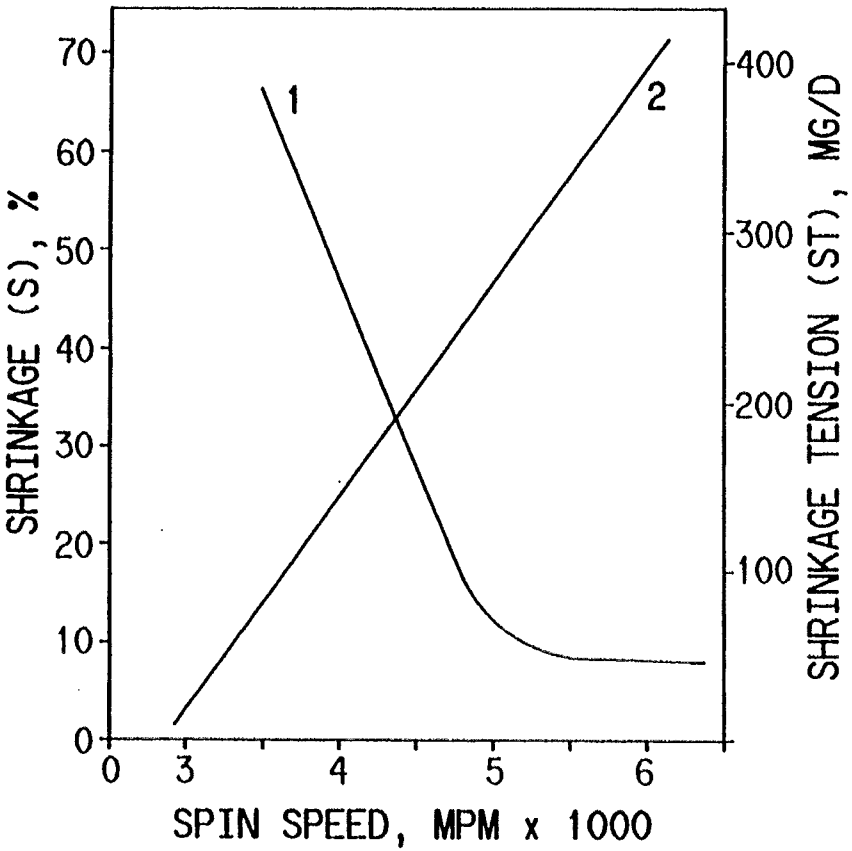

FIG. 5A is an analogous plot to FIG. 4A for B-filaments formed by treatment of A-filaments by Type I and II processes of the invention; wherein Curve 1 is the plot of shrinkage S for B-filament yarns formed by treating A-filaments at temperature $T_3$ versus the spin speed (mpm) used in the preparation of the A-filament yarns; and Curve 2 is representative of the $ST_{max}$ for the B-filaments corresponding to Curve 1 versus spin speed.

FIG. 5B is an analogous semi-log (base 10) plot of the log of $M_s$ and of $P_s$ to that of FIG. 4B; wherein the $M_s$ (Curve 1) is defined, herein, as the result of dividing the values of Curve 2 by those of Curve 1 (both from FIG. 5A) and plotting the result versus spin speed; and wherein $P_s$ (Curve 2) is defined, herein, as the result of the product of values of Curve 1 and of Curve 2 (both from FIG. 5A) and plotting the results versus spin speed. The values of $P_s$ are observed to reach a maximum as in FIG. 4B, but also is followed by an apparent minimum not observed in FIG. 4B; while $M_s$ (Curve 1) increases with spin speed throughout this speed range as it did for B-filaments in FIG. 4B (Curve 1). The minimum for $P_s$ is believed to be associated with the thermal stability of the B-filaments formed by treating of the A'-filaments; wherein A-filaments $->$A'-filaments with increasing spin speed (i.e. SIC); but where $ST_{max}$ continues to increase with spin speed by the process treatments of the invention.

Figure 6:
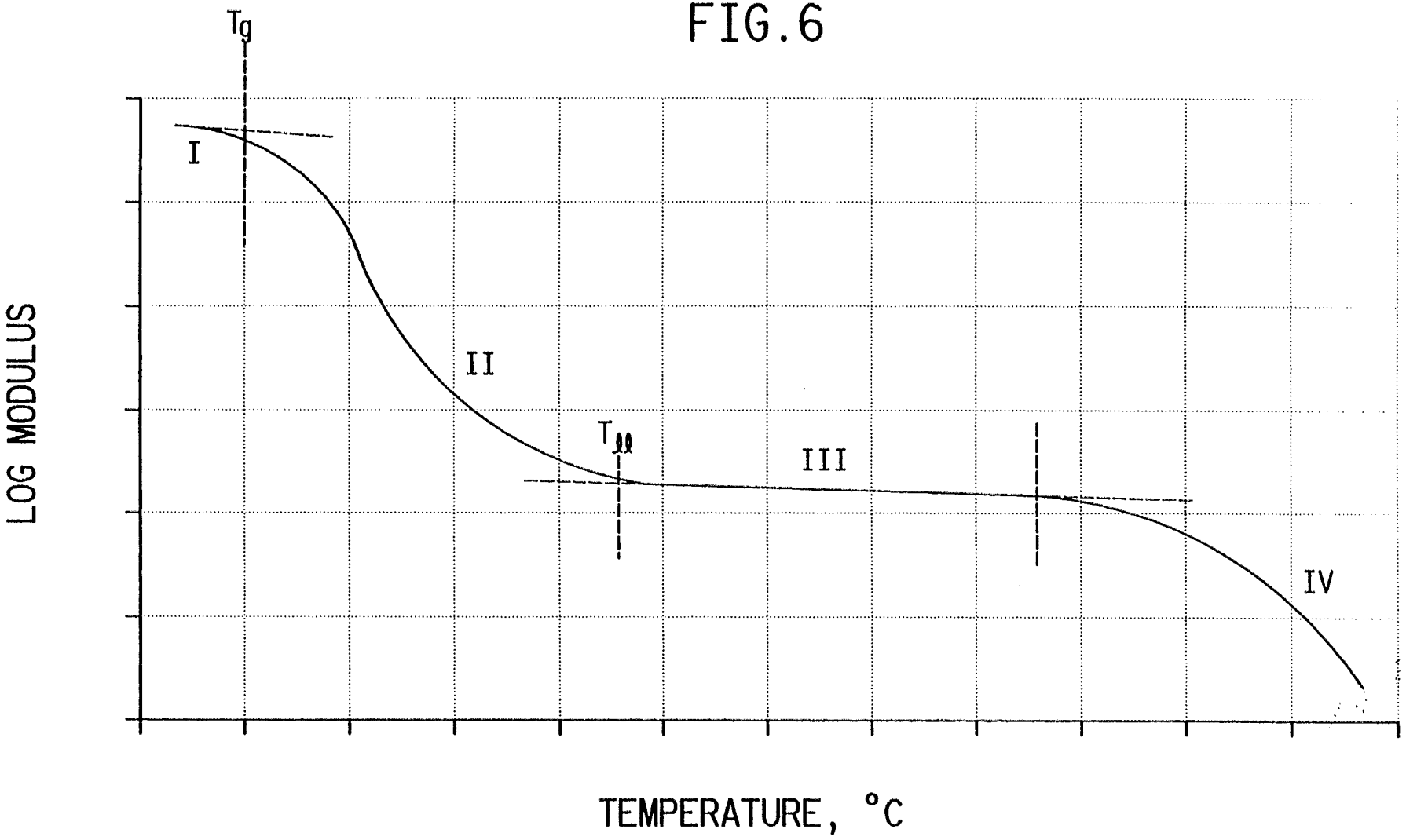

FIG. 6 is a plot of the logarithm of the modulus (stiffness) of a thermoplastic material, such as polyester, versus temperature. The modulus initially is relatively insensitive to temperature (denoted as the "glass" region (I) and begins to decrease at the (primary) glass-transition temperature $T_g$ and levels off at the secondary glass-transition temperature ($T_{11}$), where the region between $T_g$ and $T_{11}$ is often referred to as the "leather"

region (II) and the secondary glass-transition temperature $T_{11}$ is more commonly called the liquid-liquid transition temperature in open literature and also herein, and denotes the onset of the "ideal" rubber-like elastic region (III) and at higher temperatures the polymer begins to melt, noted as region IV. Polyester may be drawn between $T_g$ and $T_{11}$ without significant crystallization. Crystallization, however, occurs in region III making the crystalline yarns of region III not "ideal" as to their elastic properties.

Figure 7:
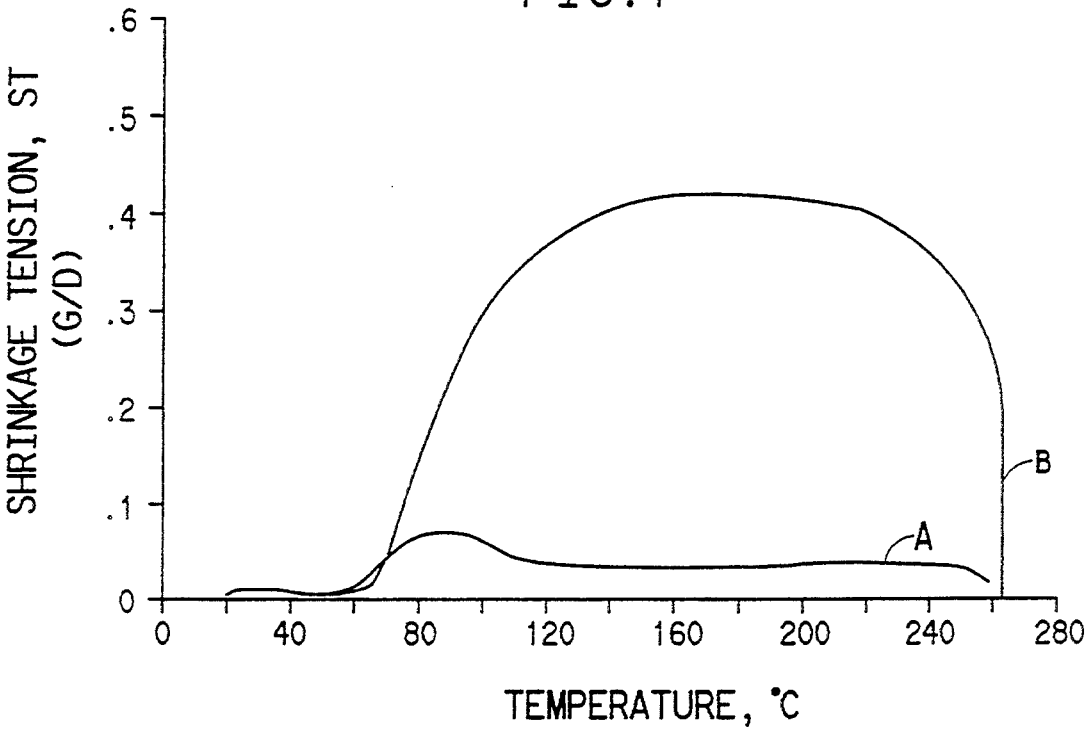

FIG. 7 is a superimposed plot of dynamic shrinkage tension (ST) values versus treatment temperature (T, C) for an undrawn POY (curve A) and for the corresponding drawn yarn (Curve B); wherein the undrawn POY (curve A) has a characteristic $T(ST_{max})$ below about 100° C. and the drawn product (curve B) has a characteristic $T(ST_{max})$ typically between about 150° C. and about 180° C. (that is in the range of the $T_{c,\frac{1}{2}}$ and $T_{c,max}$, where $T_{c\frac{1}{2}}$ is the temperature where the rate of crystallization is one-half of that at $T_{c,max}$ (refer to FIG. 14 for a more detailed discussion).

Figure 8:
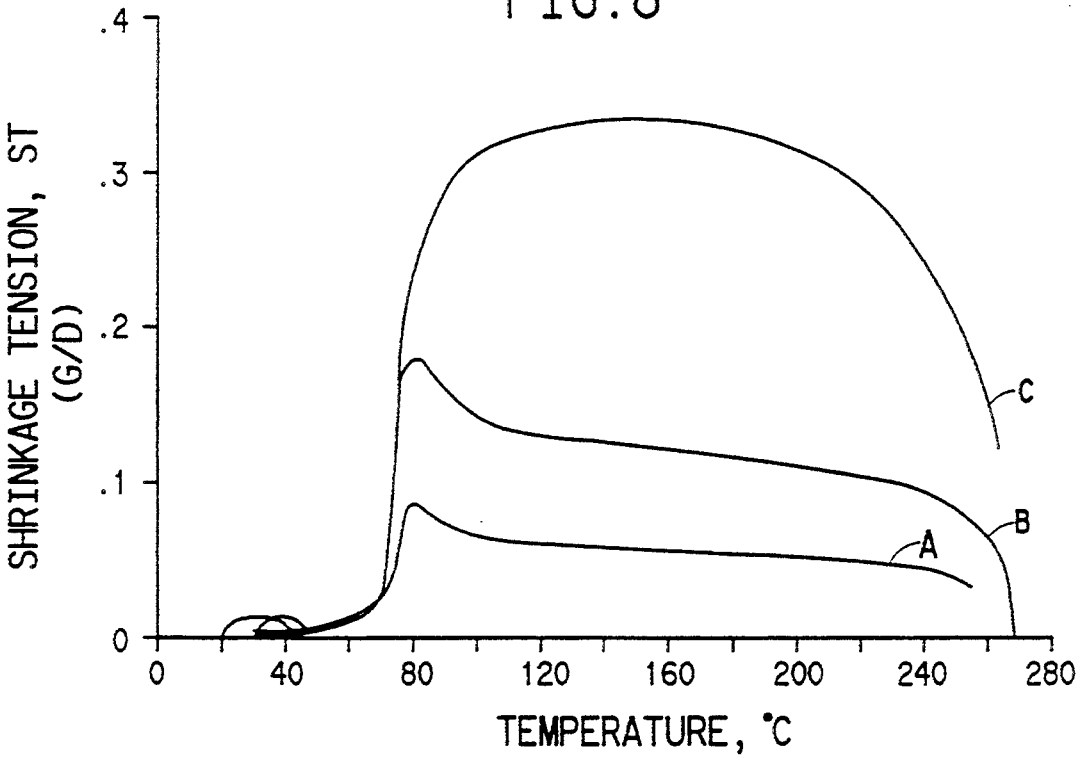

FIG. 8 is a similar superimposed plot, as in FIG. 7, of dynamic shrinkage tension (ST) versus treatment temperature (T) for undrawn A-filaments (Curve A); Curve B is of B-filaments prepared by treating A-filaments of Curve A per the invention at $T_c^o$ (i.e., about 120° C.); and Curve C is of undrawn B-filaments prepared by treating A-filaments at $T_{c,\frac{1}{2}}$ (i.e., about 150° C.). The yarns represented by Curves B and C are indicative of the B-filaments prepared by process Type I and II, respectively.

Figure 9:
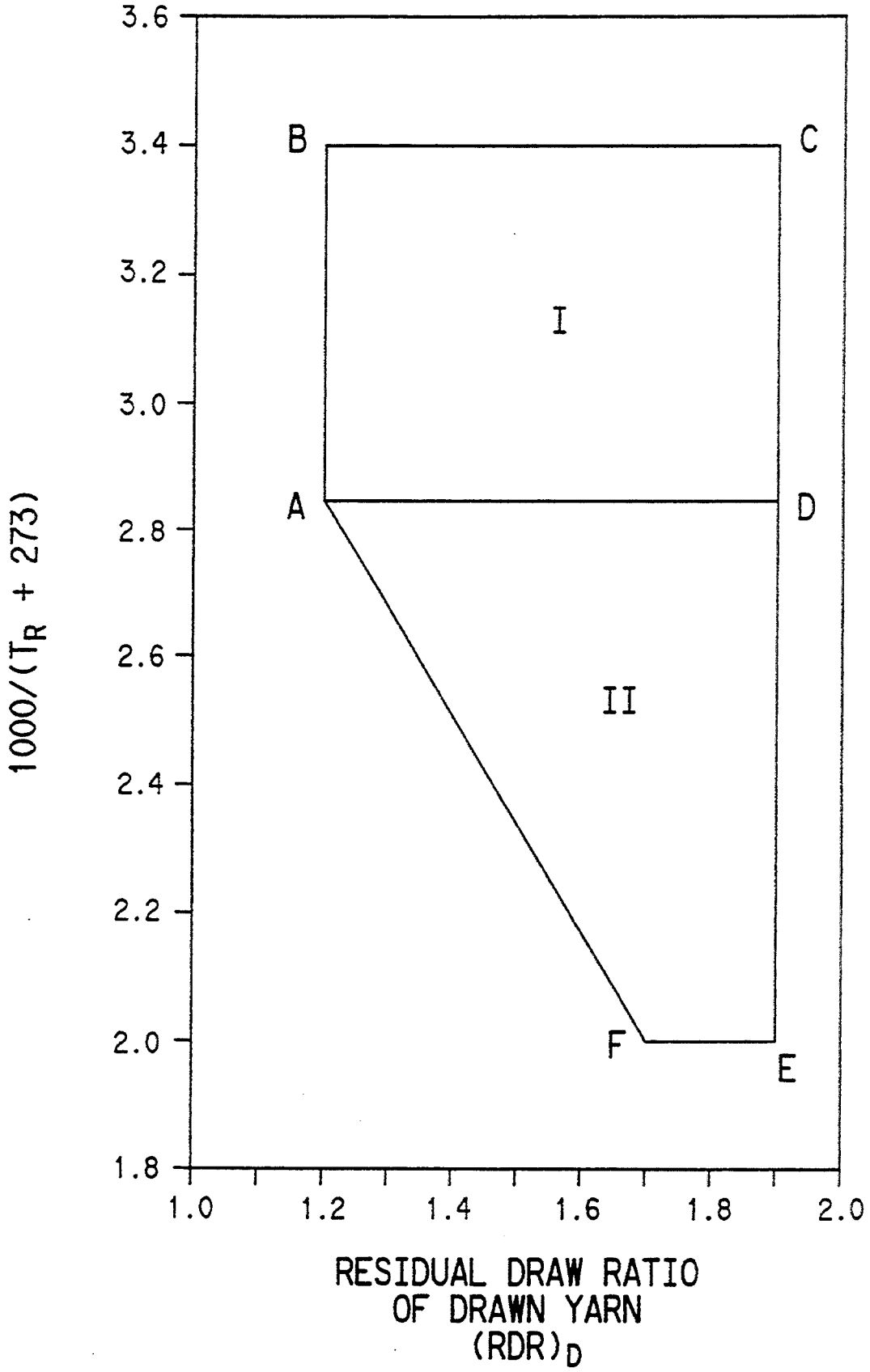

FIG. 9 shows the relationship between the relaxation/heat setting temperature ($T_R$) (where $T_R$ is measured in degrees C) and the residual draw-ratio of the drawn yarns $(RDR)_D$ for nylon 66 graphically by a plot of $[1000/(T_R+273)]$ vs. $(RDR)_D$ as described by Boles et al in U.S. Pat. No.5,219,503. Drawn filaments, suitable for critically dyed end-uses are obtained by selecting conditions met by the regions I (ABCD) and II (ADEF). Acceptable along-end dye uniformity is achieved if the extent of drawing and heat setting are balanced as described by the relationship: $1000/(T_R+273)>/=[4.95-1.75(RDR)_D]$. This relaxation temperature vs. $(RDR)_D$ relationship is also preferably applied when co-drawing and heat treating or heat treating previous drawn comingled mixed-filament yarns comprised of nylon and polyester filaments.

Figure 10:
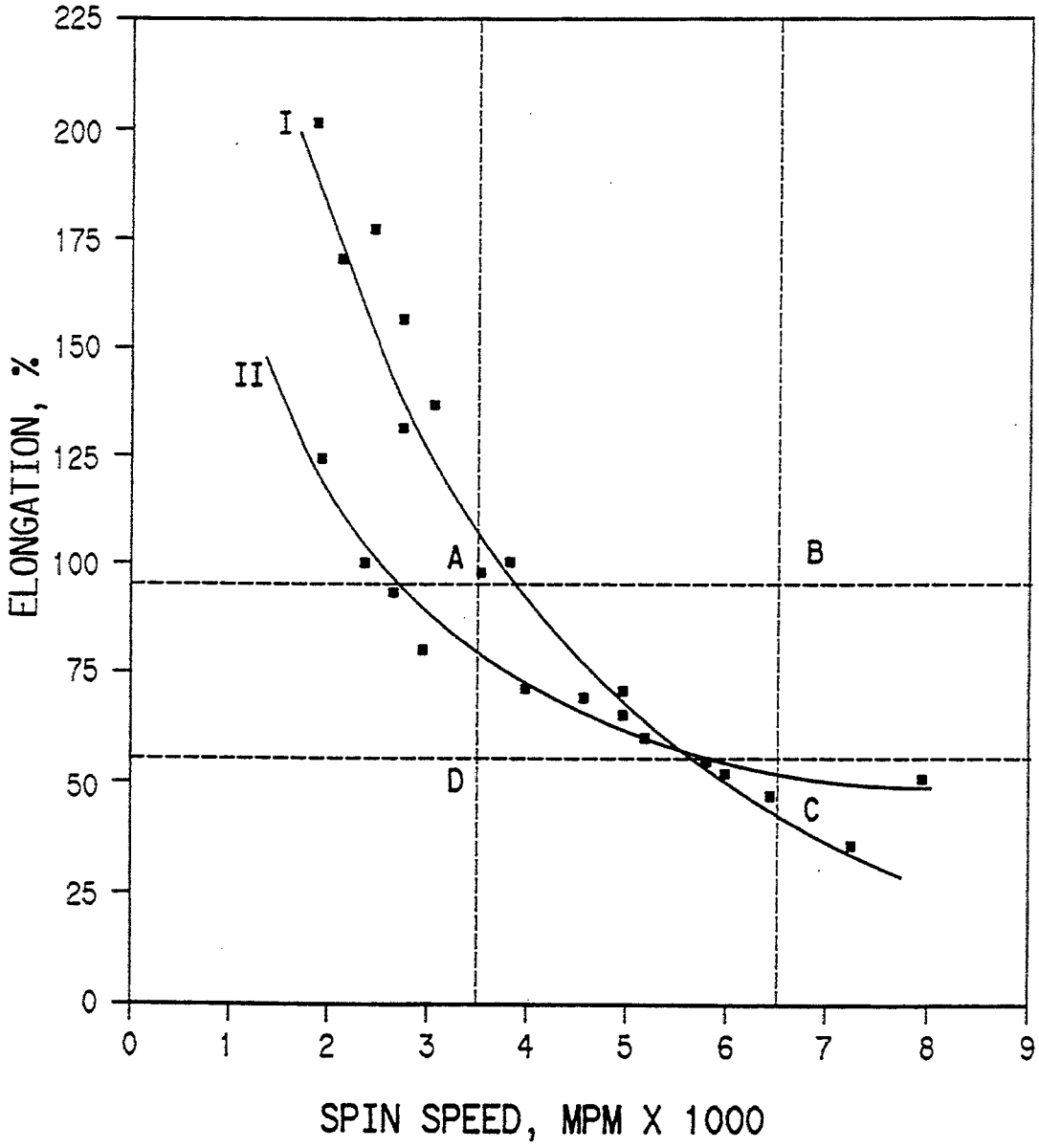

FIG. 10 is a representative plot of the elongations-to-break (EB) of spin-oriented undrawn nylon 66 and polyester filament yarns versus spinning speed. Between about 3.5 Km/min and 6.5 Km/min (denoted by region ABCD) and especially between about 4 and 6 Km/min, the elongations of undrawn polyester and nylon filaments are of the same order. The elongation of the undrawn nylon filaments may be increased by increasing polymer RV (Chamberlin U.S. Pat. Nos. 4,583,357 and 4,646,514), by use of chain branching agents (Nunning U.S. Pat. No. 4,721,650), or by use of selected copolyamides and higher RV (Knox et al in U.S. Pat. No. 5,137,666). The elongation of the undrawn polyester may be increased by lower intrinsic viscosity and use of copolyesters (Knox in U.S. Pat. No. 4,156,071 and Frankfort and Knox U.S. Pat. Nos. 4,134,882 and 4,195,051), and by incorporating minor amounts of chain branching agents (MacLean U.S. Pat. No. 4,092,229, Knox in U.S. Pat. No. 4,156,051 and Reese in U.S. Pat. Nos. 4,883,032, 4,996,740, and 5,034,174). The elongation of polyester filaments is especially responsive to changes in filament denier and shape, with elongation decreasing with increasing filament surface-to-volume (i.e., with either or both decreasing filament denier and non-round shapes).

Figure 11A:
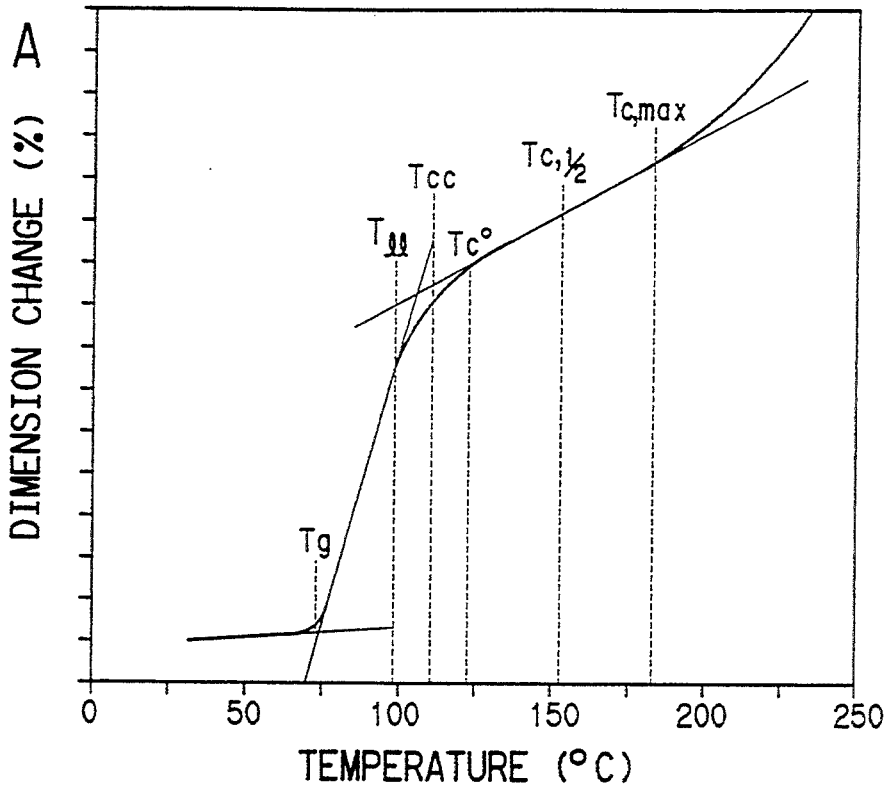

FIG. 11A is a representative dynamic Thermal Mechanical Analyzer (TMA) percent extension (ΔL) vs. temperature plot (also referred to in the literature as "creep") under a 300 mg/d load for A-filament yarn showing approximate values of the fiber $T_g$, $T_{11}$, $T_{cc}$, $T_c^o$, $T_{c,\frac{1}{2}}$ and $T_{c,max}$).

Figure 11B:
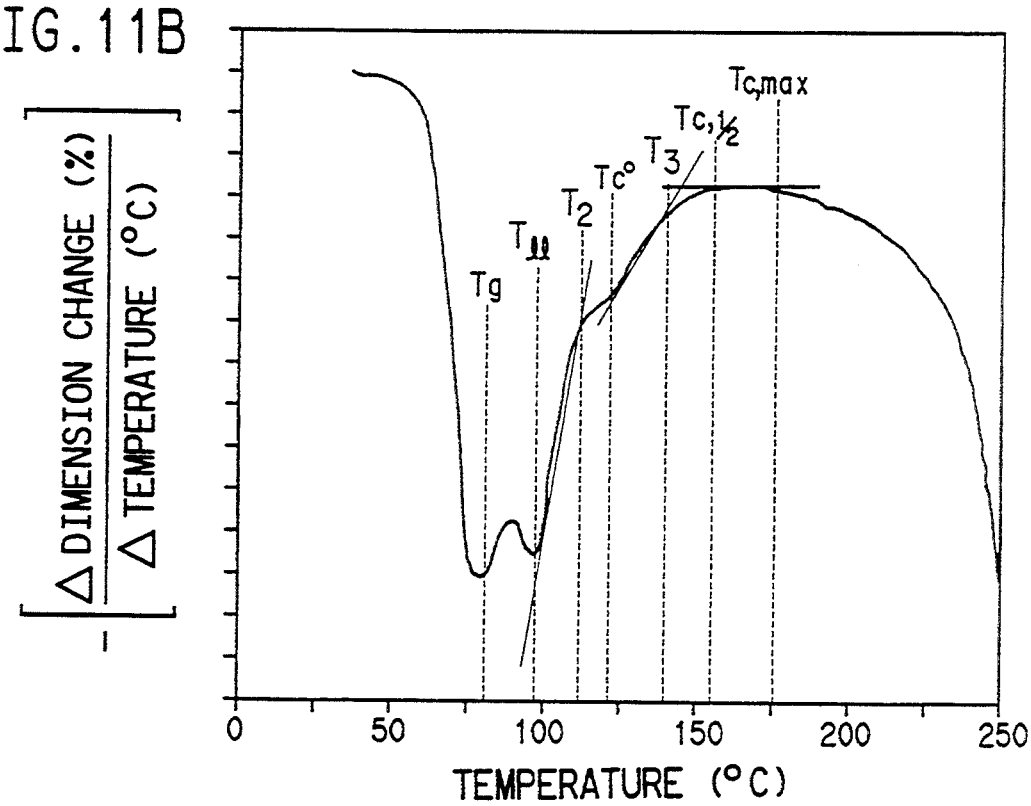

FIG. 11B is a representative plot of the derivative $(\Delta L)/\Delta T)$ of the ΔL (extension under load of 300 mg/d) value from FIG. 11A plotted versus temperature to show various thermal transition temperatures. FIG. 11B provides a very useful technique to visualize thermal changes occurring prior to major crystallization ($T_{c,\frac{1}{2}}$).

Figure 12:
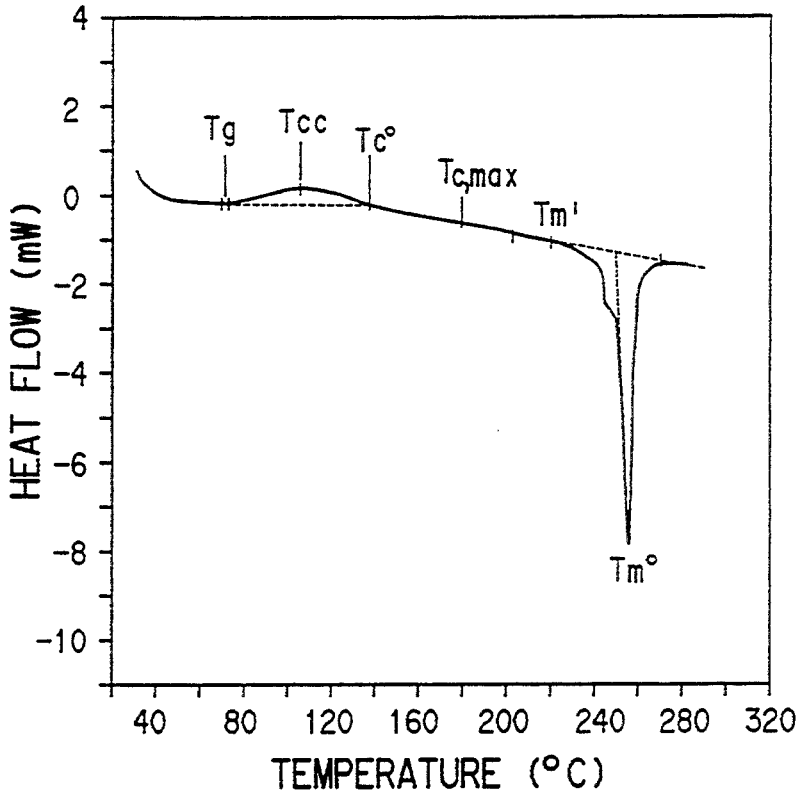

FIG. 12 is a representative DSC temperature scan of a Type A filament to show the glass-transition temperature ($T_g$), the peak temperature of cold crystallization ($T_{cc}$), the temperature of the onset of crystallization ($T_c^o$), the temperature of maximum rate of crystallization ($T_{c,max}$), the onset of melting ($T_m'$) and the zero-shear melting point ($T_m^o$).

Figure 13:
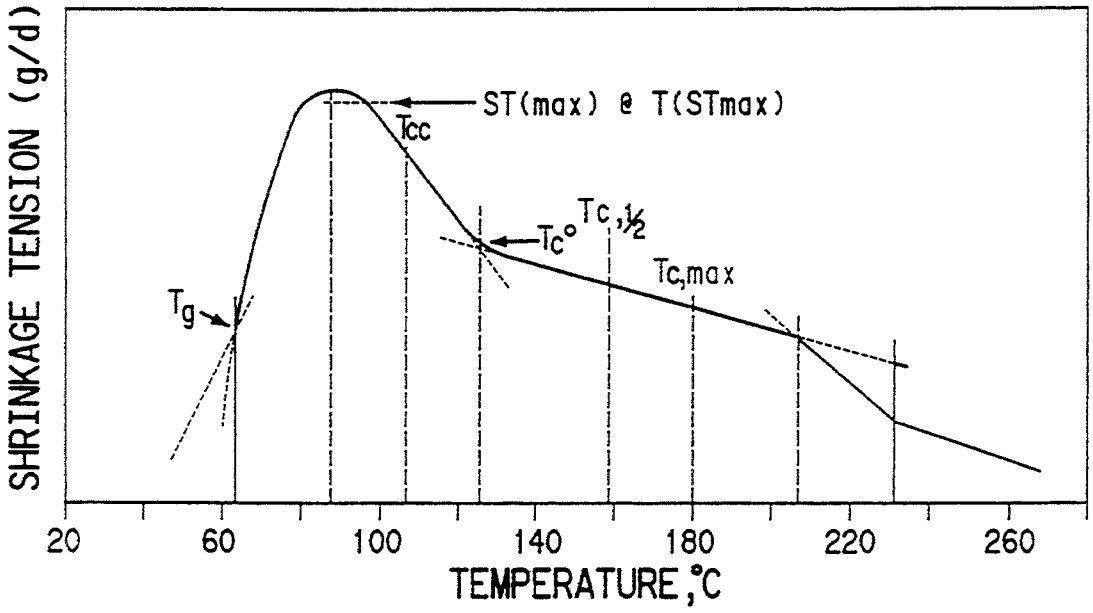

FIG. 13 is a representative dynamic shrinkage tension (ST) versus temperature scan of an A-filament; wherein the approximate values of the fiber $T_g$, $T(ST_{max})$, and $T_c^o$ are easily discernable and $T_{c,\frac{1}{2}}$ and $T_{c,max}$ are marked for reference. At very high levels of SIO and SIC, the ST vs. T scans look more like a rounded "table top" wherein the thermal transitions between $T(ST_{max})$ and $T_{c,max}$ are not so easily determined from such a plot without sophisticated peak resolution computer analysis.

Figure 14:
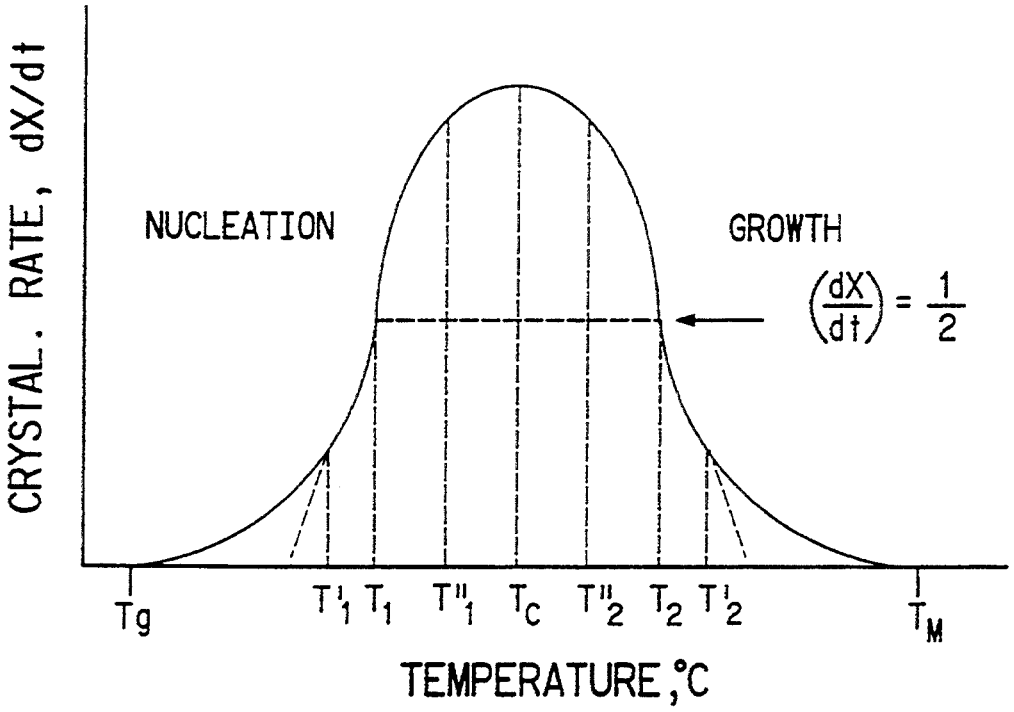

FIG. 14 is a representative plot of the crystallization rate versus temperature of polycondensation type polymers, such as polyesters and polyamides; wherein the values of $T_g$ and $T_m^o$ are marked and the values of $T_c^o$, $T_{c,\frac{1}{2}}$, and $T_{c,max}$, correspond to temperatures along the x-axis $T'_1$, $T_1$ and $T_c$, respectively. For 2GT polyester polymer of nominal textile viscosity (intrinsic viscosity of 0.65 and LRV of 20.8), the values of $T_g$, $T_{11}$, $T_c^o$, $T_{c,\frac{1}{2}}$, $T_{c,max}$, and $T_m^o$ are approximately: 65°–70° C., 95°–100° C., 120°–130° C., 150°–160° C., 180°–190° C., and 250°–260° C., respectively.

Figure 15:
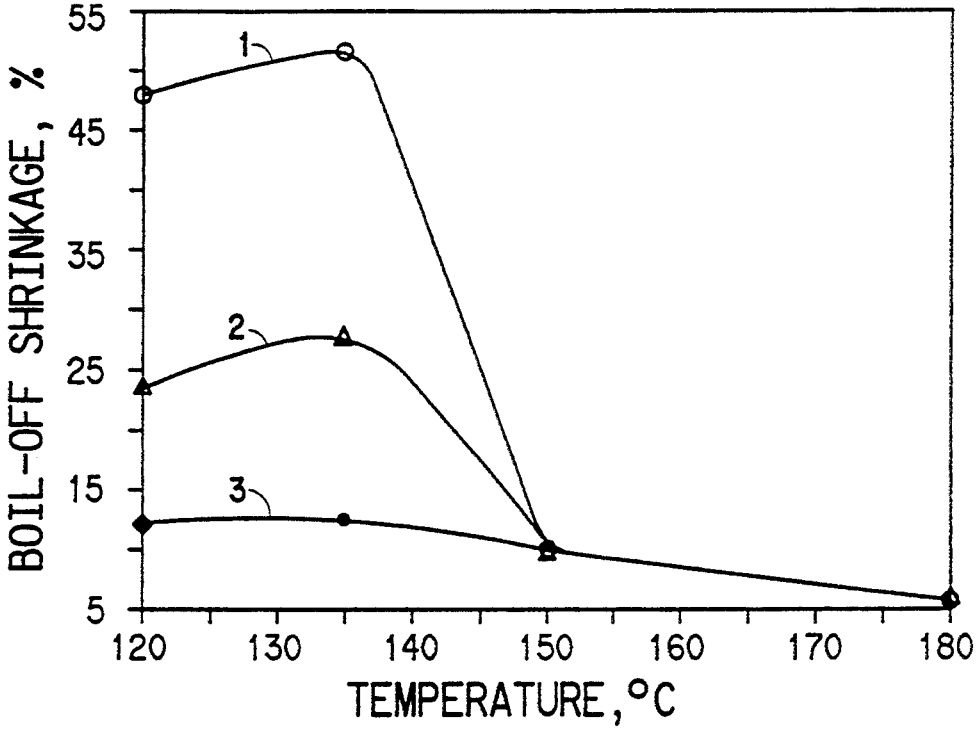

FIG. 15 is a representative plot of shrinkage (S) for B-filaments versus hot tube treatment temperature (not necessarily equal to yarn temperature due to less than perfect heat-transfer) for A-filament yarns spun at 4000 mpm ( Curve 1 ); 4500 mpm ( Curve 2 ) and 5000 mpm ( Curve 3).

Figure 16:
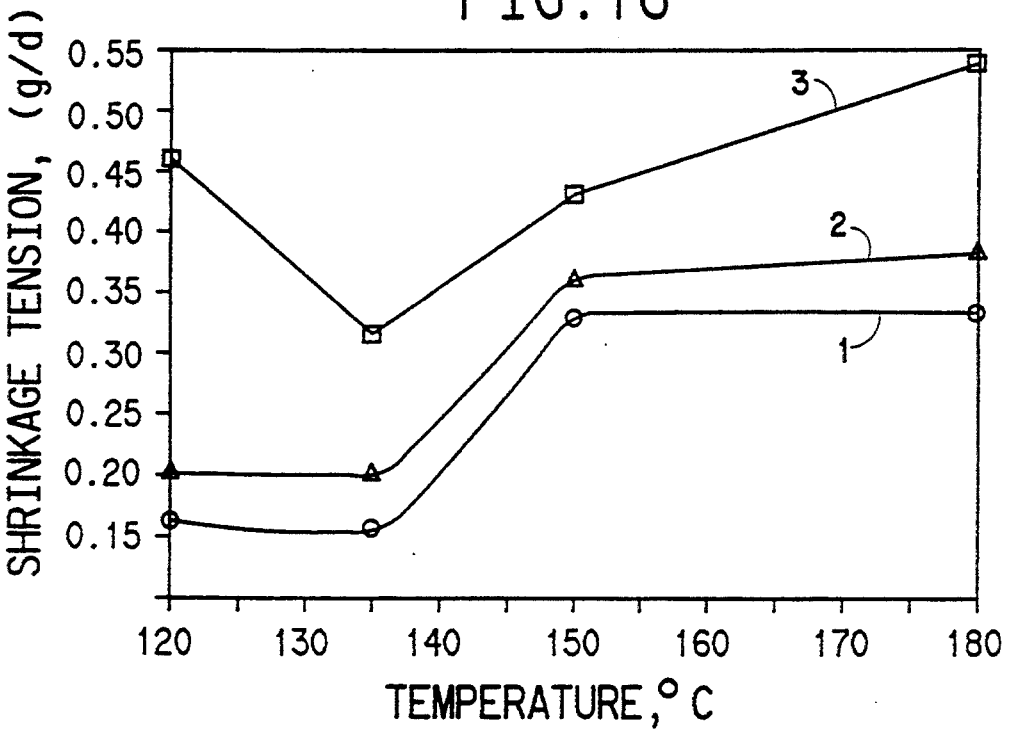

FIG. 16 is similar plot, but of STmax (g/d) for B-filaments versus hot tube temperature for A-filament yarns spun at 4000 mpm ( Curve 1 ); 4500 mpm ( Curve 2 ) and 5000 mpm ( Curve 3).

Figure 17:
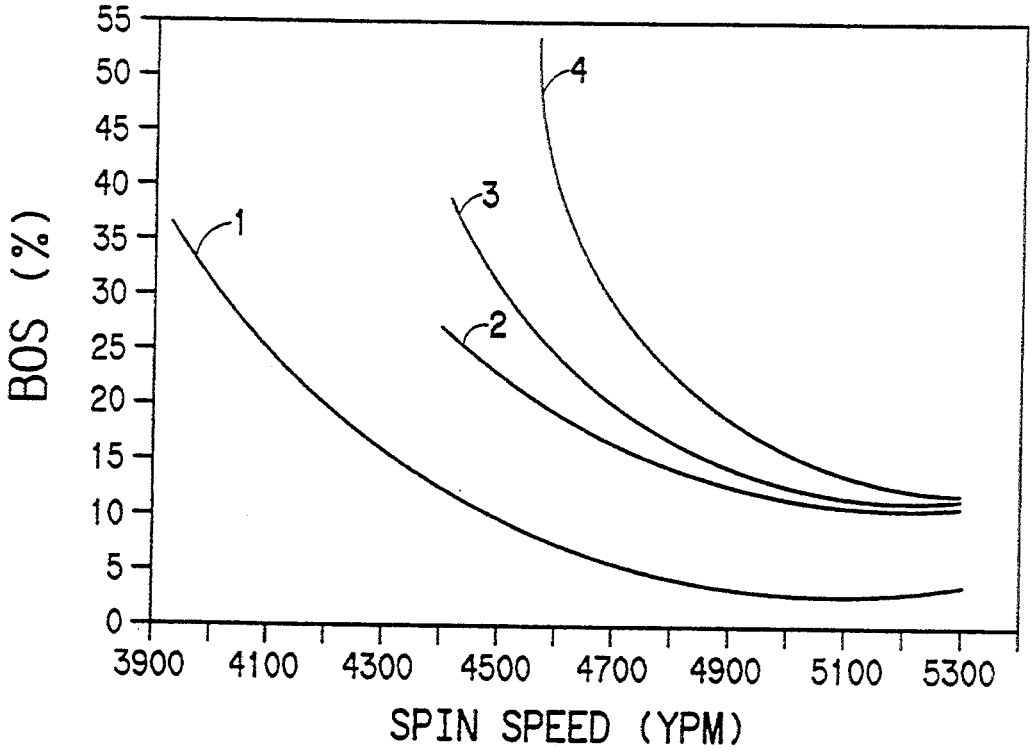

FIG. 17 is a representative plot of shrinkage (S) versus spin speed for A-filaments (curve 1 - control, without steam) and of B-filaments (curves 2 to 4) treated at 3 different pressures of superheated steam at 245° C.; thus curve 1=0 psi (0 kg/cm$^2$); curve 2=160 psi (54.6 kg/cm$^2$); curve 3=140 psi (47.7 kg/cm$^2$); and curve 4=120 psi (40.9 kg/cm$^2$).

Figure 18:
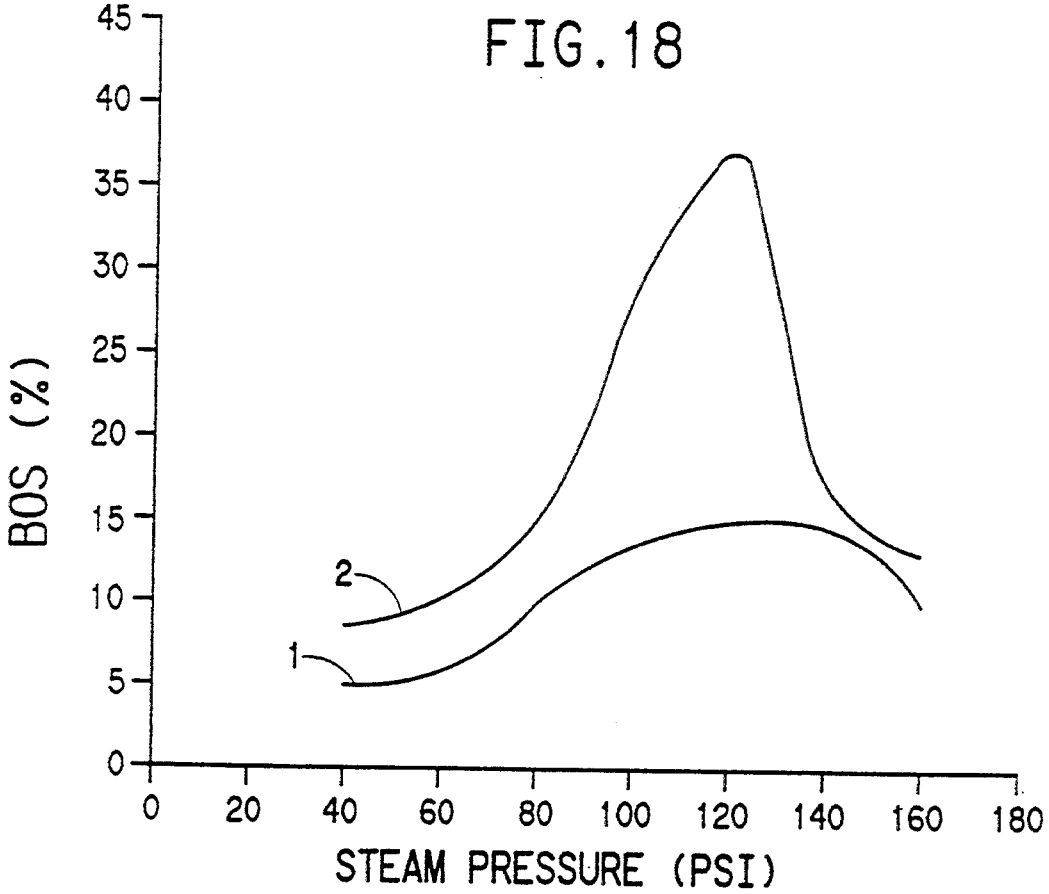

FIG. 18 is a representative plot of shrinkage S of B-filaments versus on-line steam treatment pressure expressed in units of psi (where 1 psi=0.314 kg/cm$^2$) spun at 4700 ypm (4296 mpm)–Curve 1; and at 4900 ypm (4479 mpm)–Curve 2. The peak shrinkage S vs. steam pressure appears to be obtained at higher steam pressures at high spinning speeds (e.g., reduced exposure times).

Figure 19:
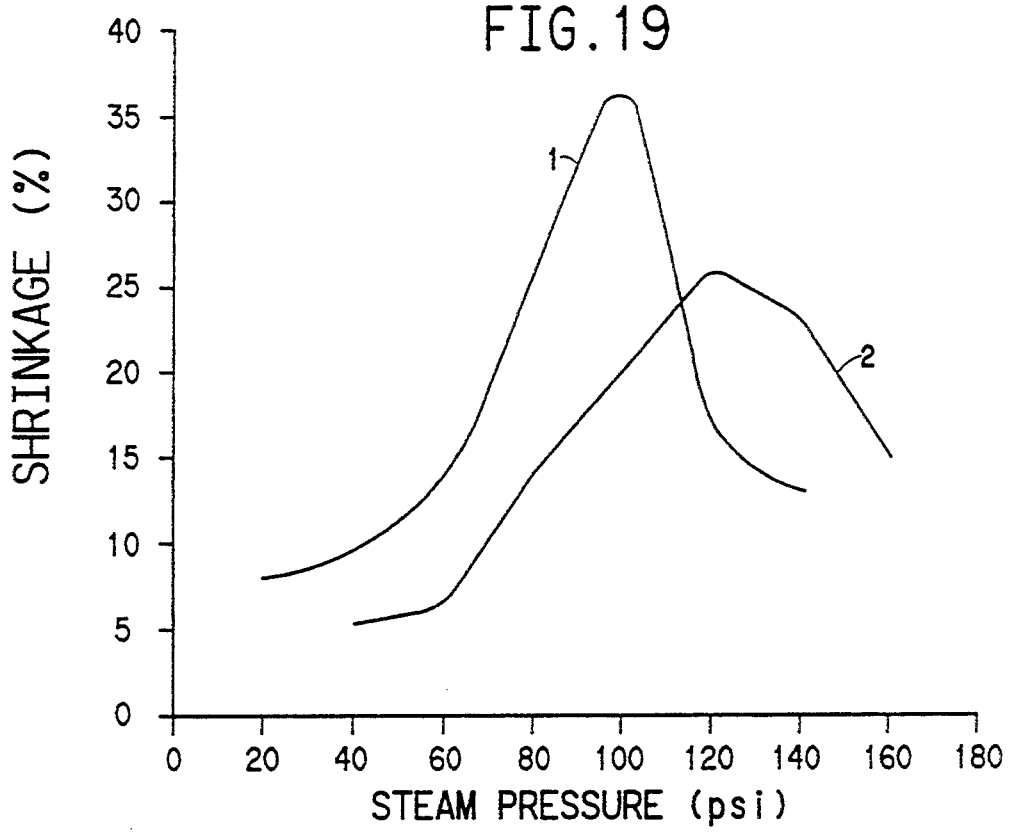

FIG. 19 is a similar plot of shrinkage (S) versus on-line steam treatment pressure expressed in units of psi (where 1 psi $=0.341$ kg/cm$^2$) for B-filaments spun at 4900 ypm (4479 mpm); where curve 1 is indicative of low dpf B-filaments and curve 2 is indicative of higher dpf B-filaments. The peak pressure moves upwards as dpf increases, most likely because of limits of heat transfer rates for the larger cross-section filaments.

Figure 20:
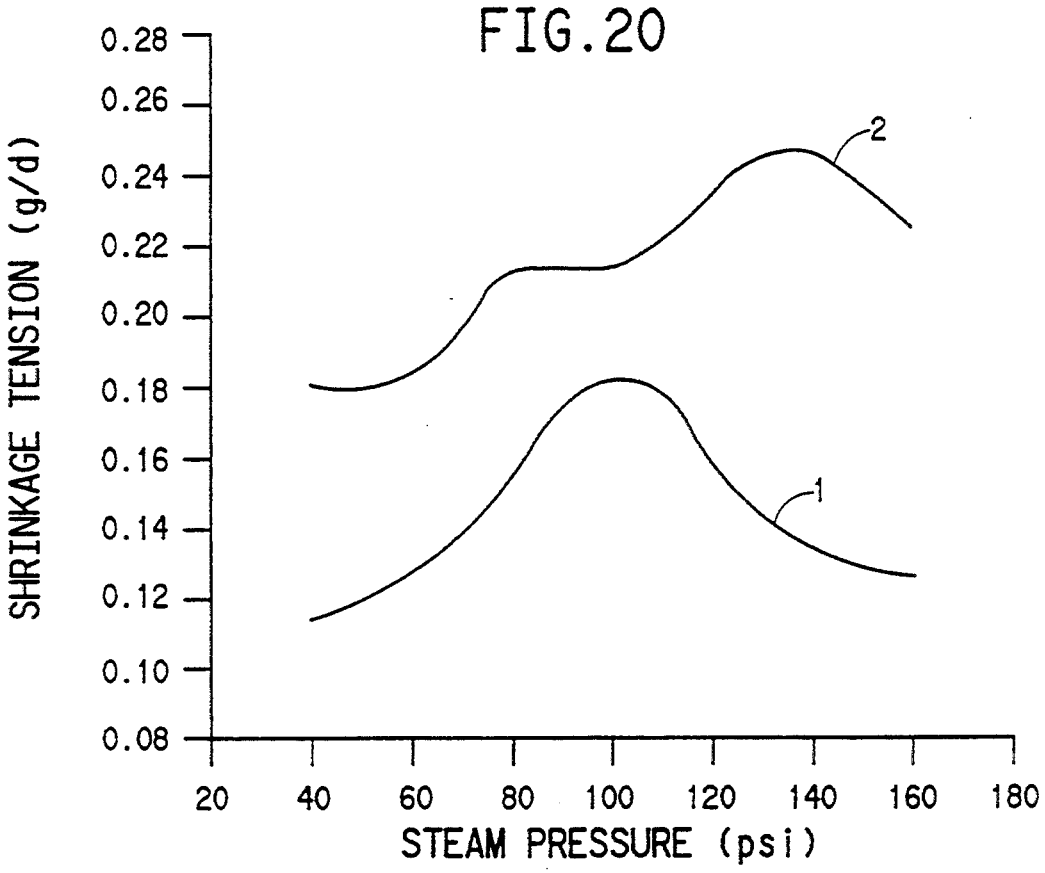

FIG. 20 is a similar plot, but of $ST_{max}$ (g/d) versus on-line steam treatment pressure in units of psi (1 psi$=0.341$ kg/cm$^2$) for B-filaments spun at 4900 ypm (4479 mpm); where curve 1 is indicative of low dpf B-filaments and curve 2 is indicative of higher dpf B-filaments. As in FIG. 19 the peak moves-to higher psi-values for the higher dpf B-filaments.

Figure 21:
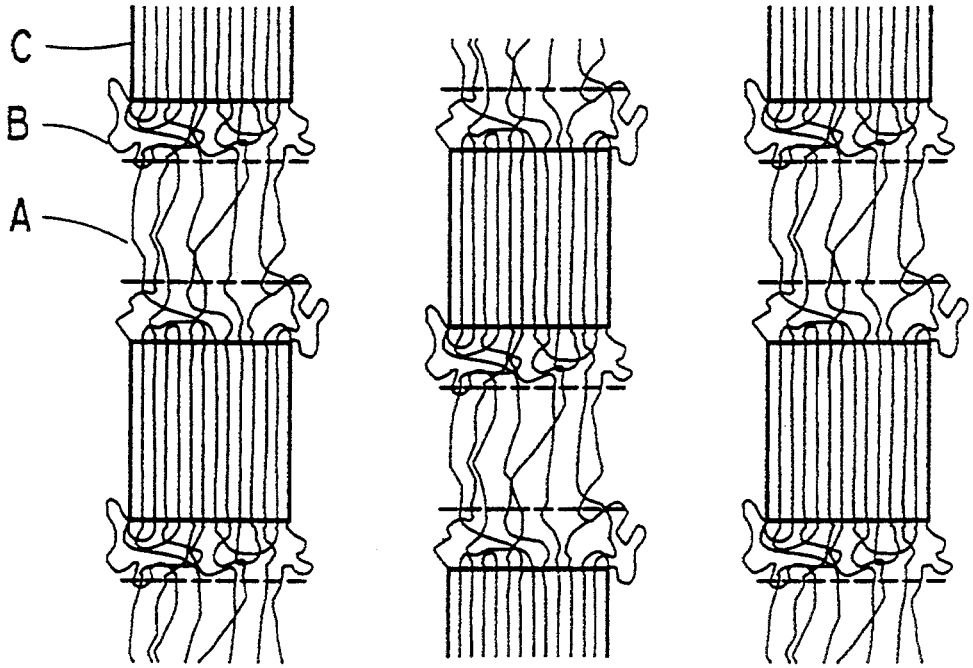

FIG. 21 is a schematic representation of a 3-phase fiber structure model to show crystalline regions (C), amorphous regions (A) and interface regions (B), herein referred to as "mesophase" which are meta stable, i.e., sensitive to low temperature treatments and may be either incorporated into the amorphous phase (A) or into the crystalline phase (C), depending on the treatment temperature, time at the treatment temperature, and the tension (or lack of tension) during the treatment.

Figure 22:
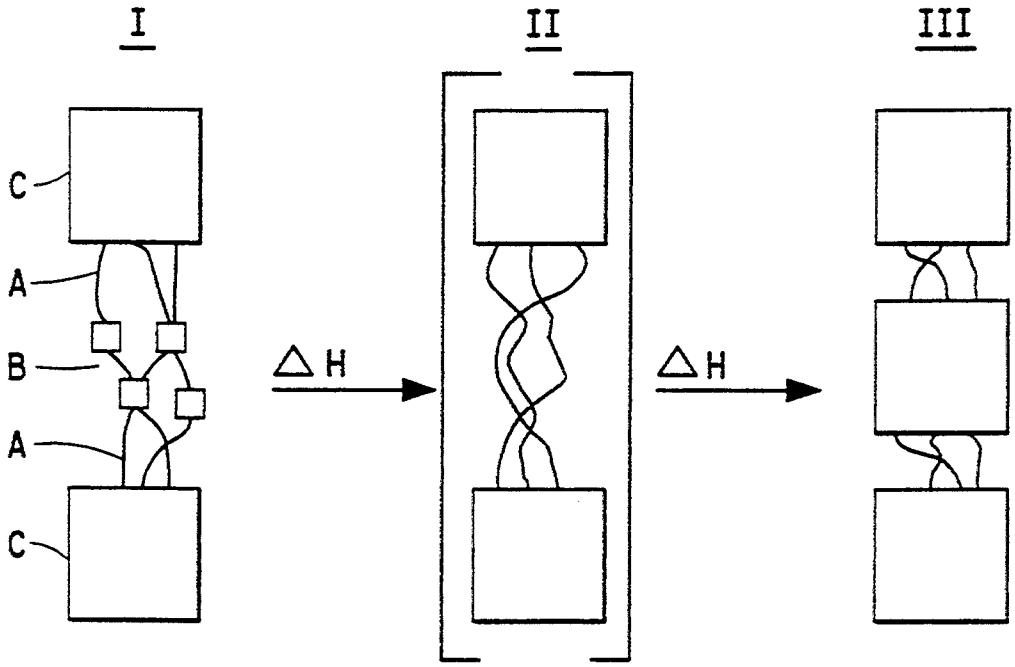

FIG. 22 shows different schematics of the fiber structure shown in FIG. 21. On the left, schematic I represents high speed spun crystalline filaments of Type A comprised of a primary crystal phase (C), a secondary crystal phase (B), referred to as mesophase, above and amorphous phase (A). Under the thermal treatments ($\Delta H$) of the invention it is believed the mesophase is melted-out, providing a thermally unstable amorphous phase held together by a primary crystal phase as represented in the center schematic II. On further heating ($\Delta H$), this structure is transformed into a re-crystallized phase represented in schematic III on the right. Under conventional heat treatments of A-filaments, the metastable phase (B) is not isolated, but readily goes to a conventional stable crystalline structure. The invention permits the isolation of this metastable phase B, and consequently the formation of the novel B-filaments that have surprising new properties.

Figure 23:
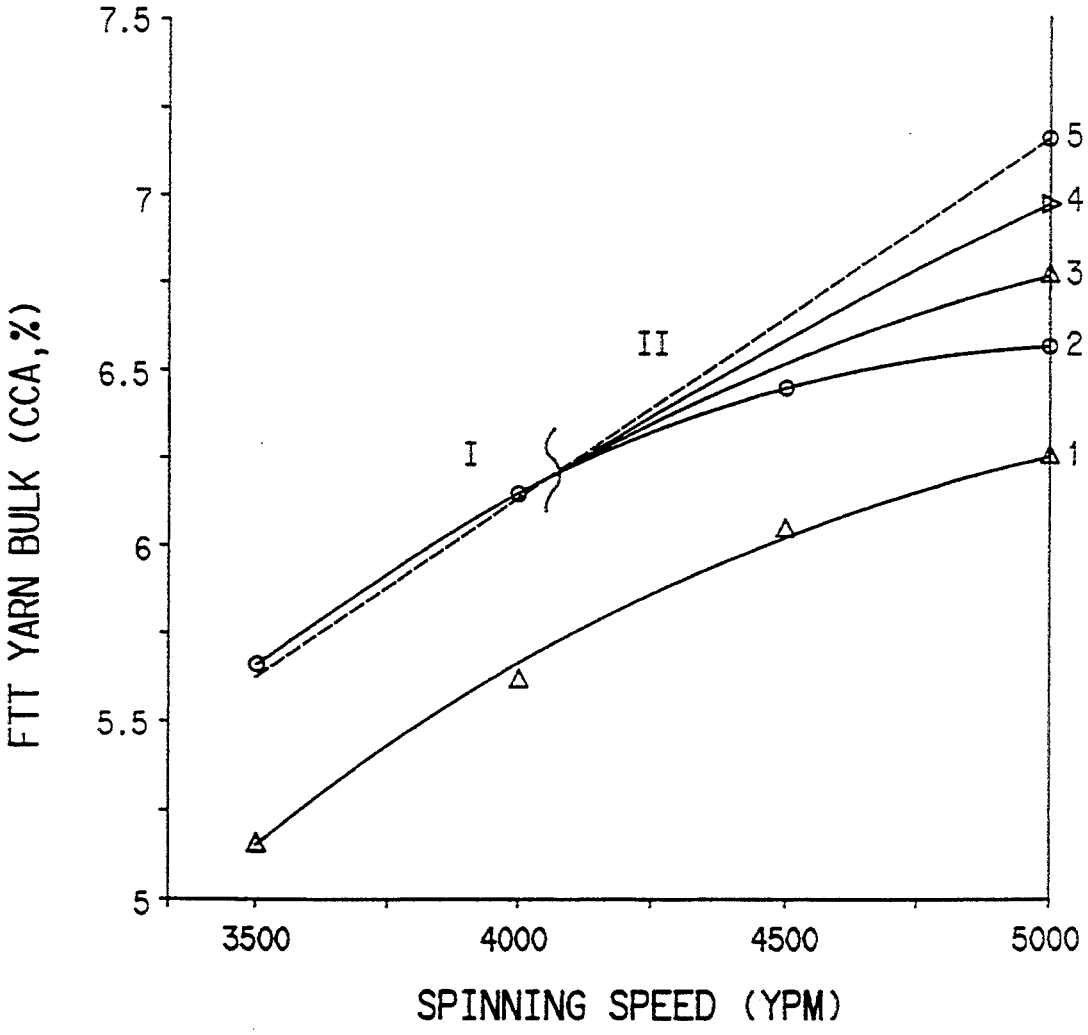

FIG. 23 represents an application of the existence of this metastable phase B. In FIG. 23 the FTT Yarn Bulk (i.e., of false-twist textured yarns) is plotted versus the spin speed of various precursor undrawn feed yarns. Despite an increase in crystallinity (density) and decrease in shrinkage S, the textured yarn bulk continually increases with increasing spin speed (Curve 1) with increasing spin speed. If the extent of crystallization is "totally" suppressed by use of water quenching (as described by Vassilatos in U.S. Pat. No. 4,425,293), higher bulk levels are obtained (curve 5) Intermediate levels of bulk can be obtained as the degree of shrinkage is suppressed (herein by higher spin temperatures and use of delay quench) so to provide lower spinline "extensional viscosity" and thereby lower SIC of the SOY as represented by Curves 2 through 4.

Surprisingly, the bulk increases (up to a point) (not shown here in FIG. 23) with increased texturing speed (i.e., shorter residence time). We believe this maybe associated with the lack of thermal stability of the "B" phase. If the treatment (e.g., texturing in this case) is too slow, then the re-crystallization of "B" phase begins prior to full twist insertion. This has been confirmed by in-line pre-setting high speed spun yarns of amorphous phase "A" prior to texturing and resulting in reduced bulk. On the other hand, if the extent of the "B" phase can be increased as indicated by an increase in the shrinkage of the feed yarn, there is observed an increase in textured yarn bulk as represented by points 1->2->3->4->5. The process of the invention provides uniform feed yarns of high shrinkage and shrinkage power especially suitable for high speed (low residence time) texturing. Alternatives, such as use of long delay quench zones and "too" hot polymer (used in FIG. 23) provide higher bulk but unacceptable along-end uniformity.

Figure 24A:
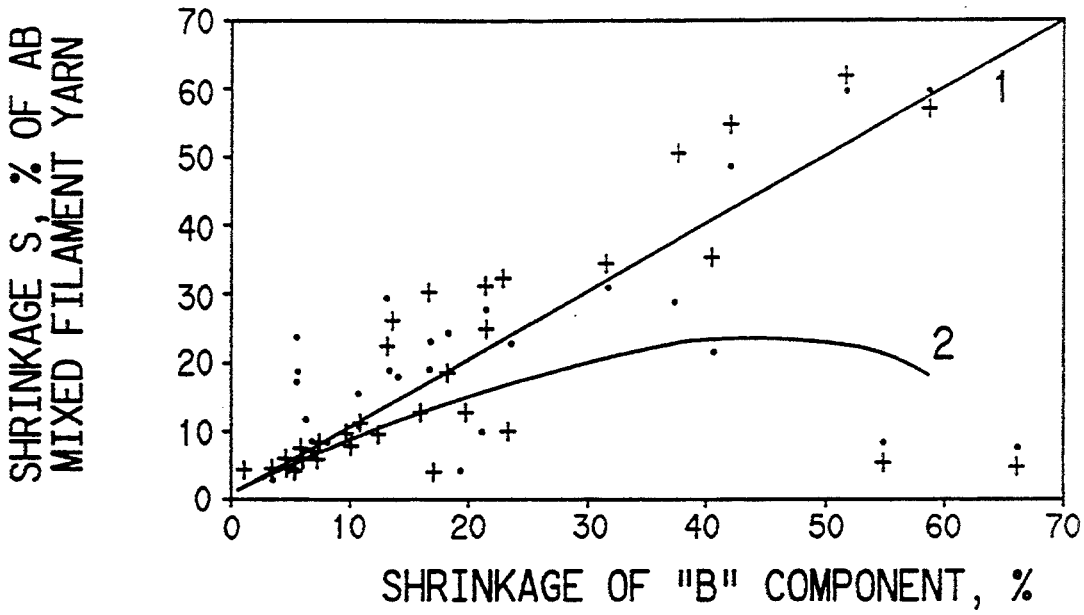

FIG. 24A is a plot of measured shrinkage S of a AB mixed filament yarn comprised of 70/17 denier B-filaments and 70/100 denier A-filaments versus the shrinkage of the B-filament component. Line 1 is the expected trend and Line 2 is observed for high shrinkage filaments of undesireably low $ST_{max}$, i.e., being incapable of overcoming the inter-filament friction and entanglements to develop the expected high shrinkage in a mixed AB filament yarn.

Figure 24B:
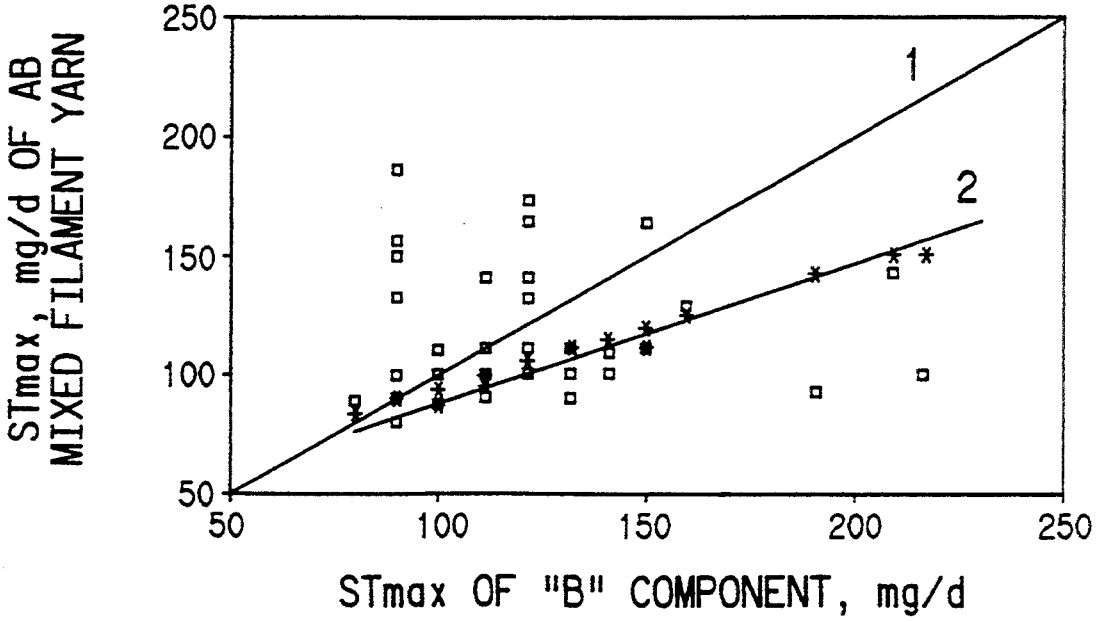

FIG. 24B (line 1) is the expected plot of measured STmax for AB mixed filament yarns vs. the $ST_{max}$ of the B-filament component; line 2 is a plot of calculated $ST_{max}$ values (weight average ST-values based on total denier of each component) versus the observed STmax-values. Line 2 shows that the expected $ST_{max}$ of a composite yarn is less than that of a single high $ST_{max}$ filament yarn and is well represented by the weighted average of A and B components.

Figure 25:
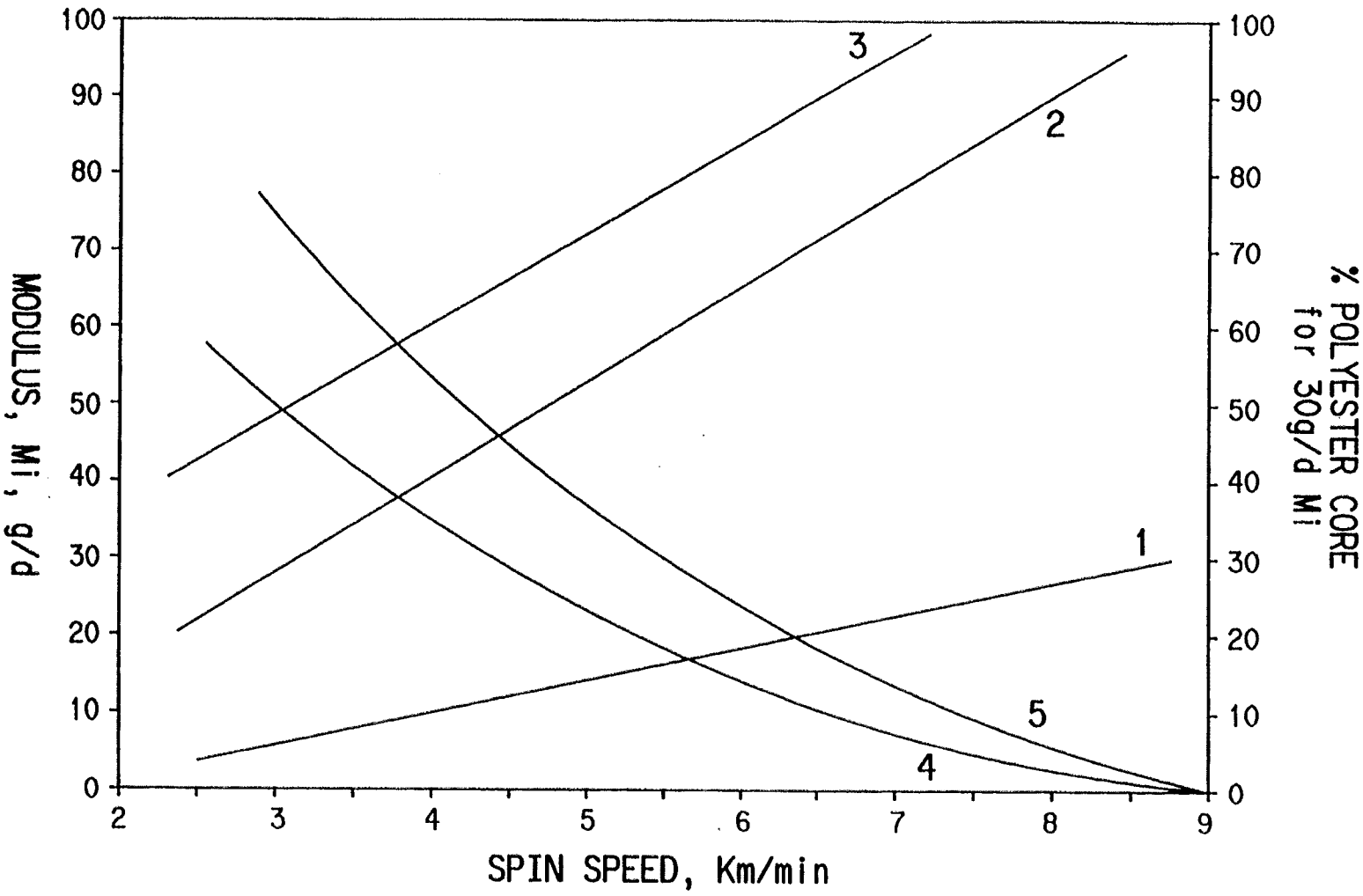

FIG. 25 is a representative plot of the initial modulus of 65 RV Nylon 66 SOY (Line 1) and of 21 LRV 2GT polyester SOY (Line 2), wherein the zero-shear (Newtonian) melt viscosity of 21 LRV polyester polymer is about the same 65 RV Nylon 66 polymer. Line 3 is a plot of the initial modulus of polyester filaments heat treated according to Type II process of the invention. Lines 4 and 5 are plots of the percent of the polyester core vs. spin speed required to obtain a 30 g/d composite nylon sheath/polyester core filament yarn corresponding to polyester filaments of Lines 2 and 3, respectively; where the composite modulus ($M_c$) is a linear weighted average of the modulus of the polyester ($M_p$) and nylon ($M_n$) components; i.e., $M_c=XM_p+(1-X)M_n$, where X is volume percent of the polyester component. By incorporating the higher modulus polyester phase into the nylon filament, the desired modulus of the nylon sheath SOY may be obtained at a lower spin speed or a higher modulus may be obtained at the same spin speed.

DETAILED DESCRIPTION OF THE INVENTION

The polyester polymer used for preparing spin-oriented filaments of the invention is selected to have an intrinsic viscosity IV in the range of 0.5 to 0.7, the IV is realted to the relative viscosity (LRV) through the expression:

$$IV=0.07238[1.28(LRV+1.2)]^{0.658};$$

a zero-shear melting point ($T_m{}^o$) in the range about 240° C. to about 280° C.; and a glass-transition temperature ($T_g$) in the range about 40° C. to about 80° C. (wherein $T_m{}^o$ and $T_g$ are measured from the second DSC heating cycle under nitrogen gas at a heating rate of 20° C. per minute). The said polyester polymer is a linear condensation polymer composed of alternating A and B structural units, where the A's are hydrocarbylenedioxy units of the form [—O—R'—O—] and the B's are hydrocarbylenedicarbonyl units of the form [—C(O)—R''—C(O)—], wherein R' is primarily [—$C_2H_4$—], as in the ethylenedioxy (glycol) unit [—O—$C_2H_4$—O—], and R'' is primarily [—$C_6H_4$—], as in the 1,4-benzenedicarbonyl unit [—C(O)—$C_6H_4$—C(O)—], such to provide a sufficient number of ethylene terephthalate, —O—$C_2H_4$—O—C(O)—$C_6H_4$—C(O)—] repeat groups so to maintain the $T_m$o between about 240° C. and about 280° C. Suitable poly(ethylene terephthalate), herein denoted as PET or 2GT, based polymer may be formed by a DMT-process, e.g., as described by H. Ludewig in his book "Polyester Fibers, Chemistry and Technology", John Wiley and Sons Limited (1971), or by a TPA-process, e.g., as described in Edging U.S. Pat. No. 4,110,316. Included are also copolyesters in which, for example, up to about 15 percent of the hydrocarbylenedioxy and/or hydrocarbylenedicarbonyl units are replaced with different hydrocarbylenedioxy and hydrocarbylenedicarbonyl units to provide enhanced low temperature disperse dyeability, comfort, and aesthetic properties. Suitable replacement units are disclosed, e.g., in Most U.S. Pat. No. 4,444,710 (Example VI), Pacofsky U.S. Pat. No. 3,748,844 (Col. 4), and Hancock, et al. U.S. Pat. No. 4,639,347 (Col. 3).

Polyester polymers, used herein, may, if desired, be modified by incorporating ionic dye sites, such as ethylene-5-M-sulfo-isophthalate residues, where M is an alkali metal cation, for example in the range of about 1 to about 3 mole percent, and representative chain branching agents used herein to affect shrinkage and tensiles, especially of polyesters modified with ionic dye sites and/or copolyesters, are described in part by Knox in U.S. Pat. No. 4,156,071, MacLean in U.S. Pat. No. 4,092,229, and Reese in U.S. Pat. Nos. 4,883,032; 4,996,740; and 5,034,174. To obtain undrawn feed yarns of low shrinkage from modified polyesters, it is generally advantageous to increase polymer viscosity by about +0.5 to about +1.0 LRV units and/or add minor amounts of chain branching agents (e.g., about 0.1 mole percent). To adjust the dyeability or other properties of the spin-oriented filaments and the drawn filaments therefrom, some diethylene glycol (DEG) may be added to the polyester polymer as disclosed by Bosley and Duncan U.S. Pat. No. 4,025,592 and in combination with chain-branching agents as described in Goodley and Taylor U.S. Pat. No. 4,945,151.

The treatment process of the invention improves (transforms) the shrinkage properties of low shrinkage crystalline spin-oriented (undrawn) direct-use filament yarns (Type A), by post-treating the A-filaments in split or coupled (on-line) processes by anyone of the hereinbefore mentioned processes ($I_{cp,sp}$ or $II_{cp,sp}$) to provide spin-oriented Type B filament yarns; i.e., yarns of high $P_s$ with all of the desired characteristics listed hereinbefore. The treatment process consists of rapidly heating followed by rapidly cooling Type A-filaments under tension prior to winding up the newly formed B-filament yarns into packages or into a beam of many yarns. During the treatment processes of Type I and II an increase tension is observed with essentially no permanent change in filament denier, wherein the increase in process tension is in the range of about the improvement in shrinkage tension ($ST_{max}$) of the treated A-filaments; i.e., about $ST_{max}$(B)-$ST_{max}$(A). The "heat" may be provided by steam jets, hot tubes, microwave, low friction heated surfaces, etc. Each will require careful selection of process variables (steam pressure and temperature, hot tube temperature, diameter, length, etc.) to achieve the desired rapid heat transfer (heating and cooling) necessary to transform Type A-filaments into Type B-filaments of desired shrinkage properties.

It is conjectured that the combination of high rate of heating followed immediately by a high rate of cooling "selectively melts" the "small" crystals, leaving a "strained" network held together by "large" thermally stable crystals (structure B in FIG. 22B) formed previously by the high speed spin orientation process used in the preparation of the low shrinkage crystalline Type A-filaments (structure A of FIG. 22A). The "strained" network, essentially free of the small crystals (or interchain order), provides for the combination of high shrinkage (S) and high $ST_{max}$, i.e., high $P_s$, as defined by the product of percent shrinkage (S) and $ST_{max}$. Conceptually, it is believed that the process of the invention provides a careful selection of heat treatment temperature and rates of heating and cooling that destabilize the crystalline structure of the A-filaments and prevents re-stabilization of the newly formed fiber structure (of the B-filaments). At conventional slow rates of heating and cooling, it is believed that the ongoing process of re-crystallization re-stabilizes the "intermediate" structure" (herein referred to as a "meso-structure") of the B-filaments such that the high shrinkage power of the treated A-filaments is not realized. The processes of the invention develop the desired "meso-structure" of the B-filaments and inhibit the rapid re-stabilization of the "meso-structure" from occurring and thereby improving the properties of undrawn low shrinkage power A-filaments to provide undrawn high shrinkage power B-filaments.

The Type I and Type II B-filaments differ in their T($ST_{max}$) and in their RDDR values. Type I B-filaments typically are of higher RDDR and T($ST_{max}$) of less than about 100° C. (i.e. less than about the polymer $T_{11}$); while Type II B-filaments typically have lower RDDR than the A-filaments from which they were formed and T($ST_{max}$) values are about 10° C. higher. Combining Type I and Type II B-filaments provides a simplified route to differential shrinkage and dye rate mixed $B_IB_{II}$-filament yarns when dyed under atmospheric conditions without dye carriers.

The high shrinkage B-filament yarns according to the invention may be used as direct-use textile yarns, but may also be used as preferred draw feed yarns as in draw-warping, draw air-jet texturing, and draw false-twist texturing wherein Type I B-filaments are selected if high dyeability is important and Type II B-filaments are selected where high $ST_{max}$ and T($ST_{max}$) values are important for providing for improved stability in especially high speed textile processing. The Type of B-yarn is selected based on specific needs of the textile processing and the end-use fabric requirements. The level of filament bundle interlace and type/level of finish are also selected based on the downstream processing needs and aesthetics desired.

Soft bulky yarns (and fabrics therefrom) are provided from use of mixed-filament yarns comprised of high shrinkage B-filaments of "high" dpf (typically about 2 dpf for top weight fabrics) and low shrinkage A'-filaments of "low" dpf (preferably less than about 1; e.g. about 0.2 to 0.8 dpf) with the low shrinkage fine denier A'-filaments providing the soft surface of the bulky yarn and the heavier dpf "core" filaments providing the fabric with improved "body" and "drape" (i.e., less "mushy"). Increasing the dpf of the B-filaments increases the firmness of the fabric made from the mixed A'B-filament yarns. The frictional characteristics may be enhanced to be more silk-like by use of silicon dioxide versus titanium dioxide delusterants. Other inert metal oxides may be used as delusterants. The hydrophilicity of the filaments may be enhanced by using undrawn filaments treated during spinning with caustic spin finish as taught by Grindstaff and Reese in U.S. Pat. No. 5,069,844).

Other variations of the invention are possible; for example, undrawn polyester/nylon mixed-filament yarns may be treated according to the invention to provide for polyester filaments of high shrinkage and high shrinkage tension, while the high speed spin-oriented nylon 66 filaments typically have shrinkages in the range of about 3–6%. On shrinkage, the low modulus nylon filaments will provide predominately form the surface of a bulky polyester/nylon filament yarn. Further, heat treating according to the processes of the invention of undrawn A/A'-bicomponent filaments provides a simple route to helical crimped bulky A'/B-bicomponent filament yarns by using filament components of different thermal stability (e.g., A/A' polyester bicomponent filaments and A/C' polyester/nylon biconstituent filaments (especially wherein the polyester (A) is modified per the teachings of Jennings in U.S. Pat. No. 4,702,875 which reduces the tendency of the polyester (A) and nylon (C) components to separate.

Single polymer torque-free helical crimp filaments may be provided by asymmetrically heating via localized friction, as described by Frankfort (U.S. Pat. No. 3,905,077) of crystalline low shrinkage polyester SOF and then passing said asymmetrically heated filaments through one of the heat treatment steps according to the invention or by providing asymmetric filaments such that they are characterized by differing radial shrinkage power and then passing such a filament yarn through one of the heat treatment step of the invention.

Advantageously, if desired, mixed-filament yarns may be prepared according to the invention from undrawn feed yarns by incorporating filaments of different deniers and/or cross-sections (including filaments of one or more longitudinal voids) to reduce filament-to-filament packing and thereby improve tactile aesthetics and comfort. Unique dyeability effects may be obtained by co-mingling filaments of differing polymer modifications, such as homopolymer polyester dyeable with disperse dyes and ionic copolymer polyester dyeable with cationic dyes or disperse dyeable polyester and acid dyeable nylon or cationic dyeable polyester and acid dyeable nylon. Sheath/core A/A' bicomponent filaments may be used to provide the desired helical crimp formation on treatment according the invention, but also provide a surface of desired dye chemistry (e.g., acid-dyeable nylon sheath and disperse dyeable polyester core or cationic-dyeable polyester sheath and acid-dyeable core). Chemically active liquid-film and plasmas may be incorporated in the treatment step of the invention to provide modified filament surfaces, e.g., for increase in hydrophilicity and stain resistance.

The fine filament yarns of this invention are also suitable for warp-drawing, air-jet texturing, false-twist texturing, gear crimping, and stuffer-box crimping, for example; and the improved low shrinkage filament yarns are desireable for use as direct-use flat textile yarns and as feed yarns for air-jet texturing and stuffer-box crimping wherein no draw need be taken and the low shrinkage is desireable so as not to lose tensiles during such no-draw texturing. The filaments (and tows made therefrom) may also be crimped (if desired) and cut into staple and flock. The fabrics made from these improved yarns may be surface treated by conventional sanding and brushing to give suede-like tactility. The filament surface frictional characteristics may be changed by selection of cross-section, delusterants, and through such treatments as alkali-etching. The improved combination of filament strength and uniformity makes these filaments, especially suited for end-use processes that require fine filament yarns without broken filaments (and filament breakage) and uniform dyeing with critical dyes. The fine denier filament polyester yarns of the invention are especially suitable for making of high-end density moisture-barrier fabrics, such as rainwear and medical garments.

The fine filament yarns, especially those capable of being cationic dyeable, may also be used as covering yarns of elastomeric yarns (and strips), preferably by air entanglement as described by Strachan in U.S. Pat. No. 3,940,917. The fine filaments of the invention may be co-mingled on-line in spinning or off-line with higher denier polyester (or nylon) filaments to provide for cross-dyed effects and/or mixed-shrinkage post-bulkable potential, where the bulk may be developed off-line, such as over feeding in presence of heat while beaming/slashing or in fabric form, such as in the dye bath. The degree of interlace and type/amount of finish applied during spinning is selected based on the textile processing needs and final desired yarn/fabric aesthetics.

Indeed, further modifications will be apparent, especially as these and other technologies advance. For example, any type of draw winding machine may be used; post heat treatment of the feed and/or drawn yarns, if desired, may be applied by any type of heating device (such as heated godets, hot air and/or steam jet, passage through a heated tube, microwave heating, etc.); finish application may be applied by convention roll application, herein metered finish tip applicators are preferred and finish may be applied in several steps, for example during spinning prior to. heat treatment and after said heat prior to winding; interlace may be developed by using heated or unheated entanglement air-jets and may be developed in several steps, such as during spinning and after heat treatment and other devices may be used, such by use of tangle-reeds on a weftless warp sheet of yarns.

TEST METHODS

The polyester parameters and measurements mentioned herein are fully discussed and described in the aforesaid Knox, Knox and Noe, and Frankfort and Knox patents, all of which are hereby specifically incorporated herein by reference, so further detailed discussion, herein would, therefore be redundant. The thermodynamic transition temperatures, such as $T_g$ are calculated according to the method of R. F. Boyer ["Order in the Amorphous State of Polymers", ed. S. E. Keinath, R. L. Miller, and J. K. Riecke, Plenun Press (New York), 1987]; i.e, $T_x$(degrees C $=\{K_x(T_m^o+273)-273\}$, where the constant "$K_x$" is 0.65, 0.7, 0.7125, 0.725, 0.75, 0.775, 0.80, 0.825, and 0.85, respectively for $T_x$ corresponding to: $T_g$, $T_{11}$, $T_1$, $T_2$, $T_c^o$, $T_3$, $T_{c,\frac{1}{2}}$, $T_4$, and $T_{c,max}$; wherein $T_m^o$ is the polymer zero-shear melting point measured by DSC at a heating rate of 20°

C./min. Test methods used herein for characterizing companion nylon polymer and filaments are given in Knox et al in U.S. Pat. No. 5,137,366 and in Boles et al in U.S. Pat.. No. 5,219,503.

Abbreviations used in the Tables are: initial modulus (MOD), boil-off shrinkage (S); dry-heat shrinkage (DS), tenacity-at-7% elongation (T7); tenacity-at-20% elongation ($T_{20}$); textile tenacity (TEN); break tenacity (TBK); post-yield modulus (PM); DPF=denier per filament; EB=percent elongation-to-break; RDR=residual draw-ratio; YPM=yards per minute; MPM=meters per minute; G/D or GPD=grams per denier; G/DD=grams per drawn denier; V=spin speed; C=degrees centigrade; K=degrees Kelvin; density (DEN. and also $\rho$) in units of g/cc=grams per cubic centimeter; SV=sonic velocity in units of KM/SEC=kilometers per second; $M_{sonic}$=sonic modulus in units of $10^{10}$ dynes per $cm^2$; COA=crystalline orientation angle in degrees; CS=average crystal size (width) in Angstroms; LPS=long period spacing in Angstroms; $X_v$=percent volume crystallinity by density; R(or RND)=round; T(or TRI)=trilobal; LRV=laboratory relative viscosity; IV (and also [$\eta$])=intrinsic viscosity; DDR=as measured disperse dye-rate; RDDR=relative disperse dye rate as defined in Knox (but normalized to 1 dpf); K/S =measure of dye depth by reflectance; $\Delta_n$=total birefringence; $T_p$=polymer melt temperature (C); DxL=capillary dimensions, diameter and length; XF=cross-flow quench; RAD=radial quench; DQ=delay quench; $L_D$=length of delay zone (cm); $L_c$=length of convergence zone (cm); DT=draw tension (g/d); DR=draw-ratio; Plate=heater plate (C); psi=pounds per square inch (=1 psi=0.07 kg/$cm^2$); DS=denier spread (%); OFF=no heat applied; RT=room temperature (taken as 21° C., unless specified); NA=not applicable; "---"=no data available. The Letter "C" when used with an Item No., as in Item 1C denotes a control or comparative yarn not of the invention For convenience, the different process types described herein before are listed below:

Type I and II: A-filament—>B-filament (Areas A and B in FIG. 1 ).

Type III: B-filament+low temp. draw—>higher tensile B-filaments (Area C in FIG. 1).

Type IV: A'-filament—>A' filament of higher shrinkage and shrinkage tension, but still having a (1-$S/S_m$) value greater than 0.9, via treatment by Process Type II.

Type V: Pretreatment of A, A/A', A/C, AC' filaments by asymmetric surface heating followed by Process Types I, II, or III.

Type VI: Relaxation of B, A'/B, B/C,' A'B, BC' filaments followed by redraw and second relaxation.

Type VII: Drawing of Type A-filaments at draw temperatures between the polymer $T_g$ and $T_{11}$ without post-heat treatment to provide uniform partially or fully drawn B-filaments.

The invention lends itself to further variations and ways to take advantage of the benefits of the yarns of the invention in various drawing and/or heat treatment processes as described hereinafter. The following examples further illustrate the invention and are not intended to be limiting.

EXAMPLE I

In Example I undrawn crystalline SOF yarns of Type A are prepared over a wide range of melt spinning process conditions and before winding up into a package of yarn, the A-filaments are rapidly heated by passing through a superheated steam chamber of varying temperatures and pressures. In Example I the polyester polymer of 20.8 LRV (0.65 IV) was melted to a temperature $T_p$ of 293°–295° C., approximately 40° C. above the polymer melting point $T_m$ of about 254°–256° C. The polymer contained 0.3% $TiO_2$ as a delusterant. The filament yarns were spun using 17-hole spinnerets of DXL of 15 mils (0.381 mm)×60 mils (1.905 mm). The mass flow rate (w, grams per minute) is metered to provide filaments of denier 2.1, 2.9, and 4.1 at withdrawal spin speeds (V) of 4500 ypm (4115 mpm) to 5300 ypm (4846 mpm). The freshly extruded filaments are protected with an unheated short 2-inch (5 cm) shroud to protect the face of the spinneret from being cooled by stray air currents and then rapidly quenched using radially directed room temperature air at a flow rate of 18.5 mpm using a radial quench chamber, as described in Knox, and the fully quenched filaments are converged into a filament bundle using a metered finish tip applicator guide at a distance $L_c$ of 32 inches (81 cm). The low shrinkage crystalline filament bundle at a temperature below the polymer $T_g$ is passed through a steam chamber of varying temperature and pressure, wherein the filaments are rapidly heated and then rapidly cooled; followed by application of interlace and then wound up into packages. Detailed process and product results are summarized in Tables 1A through 1E.

The shrinkage of the crystalline low shrinkage A-filaments is observed to increase with steam pressure and reach a maximum and then decrease with increasing pressure. The peak steam pressure increases as the spin speed increases for a given filament denier and increases with filament denier at a given spin speed. Except for Item 1A-8, all filaments have a T($ST_{max}$) of less than 100° C.; i.e., less than about the calculated thermal transition $T_{11}$ of about 96° C. for a polyester polymer $T_m^o$ of 254° C., and herein are said to have been treated by Process Type I versus Item 1A-8 filaments which are said to have been treated by Process Type II.

EXAMPLE II

Example II repeats Example I except for use of 27-hole spinnerets. In general the finer filaments provided by the 27-hole spinneret at the same mass flow rate provides for higher STmax, but also lower shrinkage S; hence giving comparable $P_s$, but higher $M_s$.

COMPARATIVE EXAMPLE III

In Example III the low shrinkage crystalline SOY were prepared according to Example I, except 34-capillary spinnerets were used to extrude polymer at $T_p$ of 290° C. and quenched by a cross-flow quench chamber fitted with an unheathed 2-inch (5 cm) screen mesh shroud, and the filament bundle being converged at 30-inches (76 cm). Process details are given in Table 3. None of the items of Example III had $ST_{max}$-value greater than 0.15 g/d and are not considered as preferred high shrinkage power yarns of the invention; but Items 3-2 and 3-3 are considered as useful as improved draw filament yarns of the invention for draw texturing with a combination of shrinkage parameters; namely, $ST_{max}$ of at least about 0.1 g/d, $M_s$ of at least about 0.2 g/d, and $P_s$ values of at least about 1.5 (g/d)% (as represented by Area A in FIG. 1).

COMPARATIVE EXAMPLE IV

Example IV repeats Example III, but at lower steam pressures and steam temperatures. Most of the conditions did not supply sufficient heat to alter the crystalline feed filament yarns (Type A). For good quality of steam (i.e., no condensation) steam temperature of 245° C. was selected. It is possible that if the residence time was increased that the conditions in Example 3 may have provided B-filaments. Detailed summary is given in Table 4.

EXAMPLE V

In Example V 20.1 LRV (0.64 IV) homopolymer polyester polymer containing about 0.3% $TiO_2$ as a delusterant was extruded at a $T_p$ of 297° C. through 48 capillaries of diameter (D) of 0.25 mm and of length (L) of 0.50 mm and the filaments were rapidly quenched using cross-flow air at 18° C. and the fully quenched filaments were converged into a filament bundle using a metered finish tip applicator guide and withdrawn at speeds between 3750 to 6000 mpm and then prior to winding into packages, the filament bundle at a temperature below the polymer $T_g$ was passed through a 200 cm hot air tube at temperatures from 120° C. to 180° C. Thermocouples indicated that for this particular tube design that for the exiting air (at these high withdrawal speeds) to reach 160° C., a 250 cm tube would be required and to reach 180° C. that a 300 cm tube would be required. It is believed that filament bundles treated at process temperatures in excess of about 150° C. were heated to temperatures of at least about $T_{c,\frac{1}{2}}$; and are not of the invention with an inferior combination of shrinkage and dyeability properties. The tension increase for filament bundles reaching temperatures less than about $T_{c,\frac{1}{2}}$ was on the order of the improvement in $ST_{max}$ versus the untreated crystalline SOY. The tension increase for filament bundles reaching temperatures in excess of $T_{c,\frac{1}{2}}$ of the yarn is greater than the improvement of the shrinkage tensions and suggests significant "aerodynamic draw" is taking place which decreases yarn dyeability and raises $T(ST_{max})$ to values greater than $T_{c,\frac{1}{2}}$, making these yarns very similar to fully drawn yarns (FDY) as described by Davis et al in U.S. Pat. No. 4,195,161; and not considered as yarns of the invention. The length of the hot tube, temperature of the air (especially the exiting temperature), diameter of the tube, spinning speed, total yarn denier, number of filaments, and percent finish-on-yarn (FOY) determines if the filaments are exposed to temperatures of at least about $T_{c,\frac{1}{2}}$ and therefore it is not readily possible to assume that based on tube temperature alone that the yarn has been treated at filament temperatures greater than $T_{c\frac{1}{2}}$. Detailed summary is given in Table 5

EXAMPLE VI

In Example VI, filament yarns were spun using conditions similar to that of Example V, except that a short 100 cm tube was used for treatment of the fully quenched yarns. Other process details are given in Table 6. All the items are characterized by $T(ST_{max})$ values less than 100° C. and therefore indicate that even at hot tube temperatures of 180° C., the actual filament temperatures most likely did not exceed $T_c^o$ (at least not for sufficient length of time) and did not exceed filament temperatures of $T_{c,\frac{1}{2}}$ and therefore all items of Example VI are considered to be of Process Type I.

EXAMPLE VII

In Example VII the treated yarns of Example VI were further improved by cold drawing to final elongations in the range of 30% to 50%. Low shrinkage yarns (i.e., characterized by a $(1-S/S_m)$ value of at least about 0.9) could be uniformly cold drawn to elongations over the entire range without "neck-drawing" as taught in Knox and Noe in U.S. Pat. No. 5,066,447; while high shrinkage treated yarns had to be cold drawn to elongations less than about 40% and preferably to about 20–40% to avoid the possibility of thick-thin sections leading to dye nonuniformities. Although the drawing increased the treated yarns shrinkage S and $ST_{max}$ values, their $T(ST_{max})$-values remained essentially unchanged. This process of coupling Process Type I followed by cold drawing without post heat treatment is designated, herein as Process Type III of the invention. Process III can be coupled with the on-line spin/treatment process of Type $I_{cp}$ or may be carried out in a separate step as in cold drawing of Type $I_{cp}$ B-filaments in the from of a weftless warp sheet or in air-jet texturing. The Process Type III yarns may be pre-bulked if desired, such as overfeeding in a heated relaxation step as part of the warp-draw and air-jet texturing processes.

EXAMPLE VIII

In Example VIII selected B-filaments formed in Examples 1 and 2 are warp-drawn using a wide range of conditions. Cold drawing increased STmax, but did not significantly increase shrinkage S. This cold-drawing B-filaments provides a simple route to flat yarns of very high STmax at low shrinkage S values versus conventional spin/draw technology. Details are summarized in Table 8.

COMPARATIVE EXAMPLE IX

Example IX is a summary of results of drawing Type A filament yarns (DUY) from Tables I-III in parent case, now a Patent U.S. Pat. 5,066,447. Warp-drawing results offer direct-use yarns. The conditions selected in the parent case did not provide B-filament yarns. Details are given in Table 9.

EXAMPLE X

In Example X Type A-filaments are drawn at speeds in the range of 200 to 300 mpm without post heat treatment. If the draw temperature $T_D$ is between about the polymer $T_g$ and the polymer $T_c^o$ (preferably about the polymer $T_{11}$), then improvements in the shrinkage properties of the low shrinkage crystalline Type A filaments are observed. However, if the draw temperature is above the cold crystallization temperature $T_{cc}$ of the filaments, which decreases with spin orientation of the amorphous regions (see FIG. 2A) and is between about $T_{11}$ and $T_c^o$ of the polymer then the improvement in shrinkage properties is reduced. Type B filaments formed by this drawing process are designated herein as Type VII and is especially suited for warp-drawing and for air-jet texturing. Process and product data are summarized in Table 10.

COMPARATIVE EXAMPLE XI

In Example XI a low shrinkage A'-filament yarn formed by spinning at 6000 ypm (5486 mpm) per Frankfort and Knox teachings was treated at various temperatures in the relaxed and taut conditions. Various fiber structure parameters were measured. None of the conditions transformed the spun A' filament yarn into a B filament yarn and the filaments of this example are considered to be of sufficient thermal stability that it would also not be affected significantly by Processes of Type I-V and hence are designated as A' filaments. The fiber structure data suggests that an A'filament is characterized by a density of at least about 1.38 g/cm$^3$ and an average crystal size of at least about 60 angstroms and a shrinkage less than about 4–5%. Details are summarized in Table 11.

COMPARATIVE EXAMPLE XII

In Example XII Type A filaments prepared according to Knox were relaxed and taut annealed over the temperature range of 60° to 240° C. dry heat; and relaxed and taut annealed in hot water. None of these treatments transformed the A filaments into B filaments supporting that rapid heating/cooling is required to "catch" the intermediate metastable mesophase structure, herein referred to as "B" before being stabilized into a A'-state (see FIG. 22–I,II,and III. Details are summarized in Table 12A and 12B.

COMPARATIVE EXAMPLE XIII

In Example XIII the A-filaments of Example XII were drawn at draw-ratios (DR) of 1.0, 1.05, and 1.1 to simulate commercial hot aqueous slashing and tenter frame finishing process steps. None of the conditions transformed the Type A-filaments into Type B-filaments confirming the results of Example XII. Details are summarized in Table 13.

COMPARATIVE EXAMPLE XIV

In Example XIV various spin-oriented filament yarns were spun to provide different levels of shrinkage S and cospun mixed-filament yarns comprised of filaments differing in shrinkage. These mixed-shrinkage filament spin-oriented yarns did not have sufficient $P_s$ to develop bulk in tight knit and woven fabric constructions and such filament yarns are not considered to be yarns of the invention. Results are summarized in Tables 14A and 14B, respectively.

EXAMPLE XV

In Example XV various mixed-filament yarns were prepared of the type A'A and treated to transform the mixed-filament yarns into Type A'B yarns. The difference in shrinkage S and $ST_{max}$ were measured. The yarns were knit into circular tubing and boiled off to develop bulk via mixed-shrinkage. A'B yarns having $P_s$ values of at least about 1.5 g/d was required to develop significant bulk. The B-filaments of the invention used for mix-shrinkage yarns are characterized by Ps values of at least about 1.5 g/d. Results are summarized in Table 15.

EXAMPLE XVI

In Example XVI mixed-filament yarns of varying filaments deniers were provided by combining filament bundles of two spin packs into a single bundle for ease of experimentation. Commercially, the mixed-filaments would be provided by use of a single spinneret where in the capillary dimensions (diameter D and Length L) are selected to prove the desired filament and yarn deniers by using the following relationship:

$$(dpf)_1 \times (L/D^4)_1 = (dpf)_2 \times (L/D^4)_2$$

$$N_1(dpf)_1 + N_2(dpf)_2 = \text{yarn denier.}$$

Maximum shrinkage S and STmax are found to depend of filament dpf, but in general for 0.65 IV homopolymer, the maximum S and STmax is in the spinning speed range of about 4500–5000 mpm. Because these filaments were predominately of high dpf, e.g., values of STmax were less than 0.2 g/d and many had values less than 0.15 g/d making them not suitable for developing bulk in wovens, but can be used for developing bulk in knits and are especialy suited for use as improved draw feed yarns for texturing. Details are given in Table 16.

EXAMPLE XVII

In Example 17 mixed-filaments yarns are warp-draw or permitted to relax to demonstrate pre-bulking of the mixed-filament A'/B yarns. Yarns that were relaxed by 0.93 provided bulk. Yarns that were relaxed and then slightly drawn in a second step so that the net draw is less than about 0.98, also provided bulk, but yarns with a net draw ratio of greater than about 1.02–1.03 did not provide bulk on heat relaxation. Drawing did provide for greater shrinkage yarns which, if permitted to relax in a 3rd step (i.e , in the fabric) would have generated bulk (such as Item 17A-4 with a net draw of 1.2 and a shrinkage of 19.3% and a $P_s$ of about 7.5 (g/d)%. If the warp (draw/relax) machine had been provided with 3 or more draw/relax zones, then bulk can be developed and enhanced by a relax-redraw-relax process (herein called provess Type VI). Such a process also is known to provide for increase in dyeability. Details are given in Table 17A,B.

EXAMPLE XVIII

In Example XVIII fabrics using 50 denier 47 filament textured yarns in the warp with a 70 denier 102 filament filling yarn comprised of 35 denier 34 filament high shrinkage component (Type B) having a 17% shrinkage and a 35 denier 68 filament low shrinkage microdenier component having a 4% shrinkage (Type A') and a 150 denier 168-filament filling comprised of 75 denier 68 filament high shrinkage component having a 15% shrinkage (Type B) and a 75 denier 100-filament microdenier low shrinkage component of about 4% (Type A'). The fabrics were relaxed scoured at 212 degrees F to allow development of bulk from the shrinkage of the mixed shrinkage filaments of the mixed-filament filling yarns. The fabrics were then dyed in a jet dyeing machine using normal polyester dyeing conditions necessitated by the higher dpf polyester warp. Heat setting at width was carried out at a lower than normal temperatures to maintain the bulk developed during scouring and jet dyeing and to enhance the overall aesthetics. Evaluation of fabric handle of these fabrics shows that the mixed-dpf mixed-shrinkage properties of the yarns add to the stiffness, bounce, crispness, and scroop, properties much desired in a microdenier fabric to simulate silk like handle. The bulk of the fabrics are the comparable to that of fabrics made with 100% textured warp and filling yarns. Data for the spinning of the various yarns are given in Table 18. Further improvements may be made by using three component $A'B_1B_2$ mixed-shrinkage yarn so to provide a wider (and uniform) distribution of shrinkage.

EXAMPLE XIX

In Example XIXA-D nylon POY are spun and warp-drawn to different elongations showing the feasibility of uniformly partial drawing of nylon, making it an acceptable co-draw companion yarns with A-filaments of the invention or as undrawn companions for treatment by processes of Type I or II followed by co-drawing by process Type III to given uniform mixed-shrinkage polyester/nylon filament yarns (Table XIX is taken from co-pending application Boles 07/532,529 and 07/753/769.

EXAMPLE XX

In Example XX, the RDDR as defined in Knox, but normalized herein to a dpf Df 1 instead of 2.25 (Knox RDDR-values × 1.5 = values herein), were measured for different spin speeds (items 1–6 and items 7–23), steam pressures (Items 24–31), hot tube temperatures (Items 1–23) and for drawn B-filament yarns (Items 13–23). The post-yield modulus based on $T_{20}$ and $T_7$-values were calculated for Items 1–12 and 24–31; but were calculated based on $T_{10}$ and $T_7$-values for Items 13–23 as noted by the *. The PYM-values from $T_{10}$ and $T_7$ are more variable than those from $T_{20}$ and $T_7$-values; but both show a general trend of increase in PYM a decrease in RDDR where there was not such a trend using $T_7$, $T_{10}$, or $T_{20}$ as a single parameter to estimate dye rate. The values for the various B-filaments (1–23) are compared to commercial yarns and in general are found to be greater. A value of RDDR of at least about 0.1 is preferred and a value at least about 0,150 is especially preferred. Such values (especially 0,150 and greater), are considered to be atmospheric dyeable without carriers for most shades, especially with low to medium energy dyes. Very deep shades (e.g., blacks) and use of high energy dyes for critical end-uses requiring excellent wash and light fastness, pressure dyeing without carriers may be required, but shorter dye cycles and/or lower pressures may be used for cost savings over that of convention spin/drawn yarns. The results of this analysis indicates that the dyeability decreases as the $T(ST_{max})$ increases and especially if greater than $T_{c,\frac{1}{2}}$; hence the yarns of the invention have a $T(ST_{max})$ less than about $T_c^o$ and preferably less than $T_1$ and especially less than about $T_{11}$; wherein the values of $T_{c,\frac{1}{2}}$, $T_c^o$, and $_{11}$ are calculated hereinbefore from the zero-shear melting point ($T_m^o$) of the polyester polymer. Details are summarized in Table 20.

EXAMPLE XXI

In Example XXI one mode of the process of the invention (i.e., using a heated tube) for providing high shrinkage polyester filament is compared to a prior art hot tube process, also for providing high shrinkage polyester filaments; namely as described in EPA-0207489 (referred to in this Example XXI as Shimazu). Shimazu taught use of polyester polymer of intrinsic viscosity (IV) broadly covering the range of 0.4 to 0.9, but also taught that his polymer should be melted at a temperature $T_p$ higher than 290° C. (page 12, line 25). In the process of the invention the polymer melt temperature ($T_p$) is selected based on the polymer's melting point ($T_m^o$), which is in turn dependent on the polymer composition, e.g., IV, whether modified with copolyesters or by the addition of ionic monomeric units for ionic dyeability, etc, and our polymers are of IV in the range of 0.5 to 0.7, and the $T_p$ is controlled within the range of 20° C. to 50° C. above the selected polyester polymer's melting point ($T_m^o$).

Shimazu extruded his melt directly into a heated zone (shroud) of about 15 cm in length for a delayed quench environment at temperatures at least about 200° C. (typically 250° C. to 285° C. was used in his Examples) before blowing cooling air (at 20° to 10° C.) along a length of 100 to 150 cm to cool his filaments to a preferred temperature lower than $T_g$+40° C. (i.e., less than about 105°–110° C. for the 0.64 IV polyester used in Examples - his teaching permits selection of yarn temperatures $T_y$ covering the range of $T_g$ to $T_{11}$, i.e., the "leather" region as represented in our FIG. 6 and which may be above the $T(ST_{max})$ of the yarn—in our opinion an unstable and variable structural condition for further processing).

In contrast, in the process of our invention, the polymer melt is extruded directly into a cooling chamber (preferably a radial cooling chamber fitted with a thin non-heat conductive gasket such that the distance between the point of extrusion, the face of spinneret (that is usually recessed slightly), and the point of air impingement is minimized to about 2–5 cm) where the cooling medium is typically air in the range of 10° C. to 25° C. We have found that attenuation is essentially completed prior to our A filaments (or A' filaments) exiting such cooling chamber into a "second quench zone" comprised of a protective open air chamber at room temperature or into a cross-flow air chamber to insure complete attenuation to temperatures less than the polymer $T_g$ (i.e., to a final stable structural state prior to convergence and application of finish and/or prior to any additional processing, i.e., by Type I or Type II heating and cooling. We believe the heated shroud used by Shimazu, retards crystallization and favors orientation, thereby providing filaments of higher orientation but of lower dyeability than filaments prepared by our process without such heated shroud.

After attenuation is complete (as defined by reaching a constant withdrawal speed only, rather than by the usual definition of constant withdrawal speed and yarn temperature less than $T_g$), Shimazu's filaments are "conditioned" in a heated chamber. Shimazu's conditioning chamber is a tube of 80 to 200 cm in length heated to 120° to 160° C. This is similar to one of the methods used in our process, except that our tube temperature and length are adjusted to maintain a yarn temperature $T_y$ between about $T_{11}$ and about $T_3$ to favor the kinetics of melting out intercrystalline small nuclei and permit the amorphous chains to assume higher orientation, as measured by higher shrinkage tension and reduced elongation to break, without eliminating the larger crystalline network formed by the combination of high withdrawal speeds and rapid filament quenching (e.g., by selection of air temperature, filament dpf/cross-section and filament to filament spacing). The yarns of both processes may be wound up at speeds in an overlapping range of 4000 to 6000 mpm, but the process of the invention may use lower withdrawal speeds, e.g., as low as 2000 mpm for spinning micro-denier filaments (e.g., less than 1 dpf).

The process differences from Shimazu's process include our further requirement that the yarn entering the conditioning zone, not only be at a temperature for structural stability and uniformity (i.e., less than polymer $T_g$), but also be a stabilized "textile yarn" (denoted herein as an A-filament yarn) of shrinkage S, such that $(1-S/S_m)$ is at least about 0.9.(i.e., less than about a nominal shrinkage S of about 10%). No such structural condition is required or disclosed by Shimazu.

Numerous and various applications are possible for the high shrinkage power "B" filaments and other higher shrinkage filaments of the invention, and the following Examples indicate some of these.

EXAMPLE A

In Example A the shrinkages S and ST(max) for the high $P_s$ B-filaments are compared with AB mixed-filament yarns. As expected the shrinkage S is determined by the higher shrinkage component (FIG. 24A-Line 1); but if the high shrinkage component has very low shrinkage tension, such as conventional POY, then the observed shrinkage S for the AB-filament yarns is significantly less that predicted from that of the high shrinkage component (FIG. 24A-Line 2). Shrinkage tension, however, is a weighted average of the contributions of A and B-filaments; that is, the expected $(ST_{max})_{AB}=[(\text{denier})_A\times((ST_{max})_A+(\text{denier})_B\times(ST_{max})_B]/[(\text{denier})_A+(\text{denier})_B$. In FIG. 24B the "scattered" data assumes that the shrinkage tension of a AB-filament yarn is equal to that of the filaments of the highest $ST_{max}$-values (Line 1); and Line 2 represents the calculated $(ST_{max})$AB values based on weighted values of the $ST_{max}$ values of the individual components. The mixed-filament yarns of the invention are characterized by a yarn average $ST_{max}$ of at least 0.1 g/d wherein the individual B-filaments have a $ST_{max}$ of at least about 0.15 g/d; preferably a yarn average $ST_{max}$ of at least about 0.15 g/d wherein the individual B-filaments have a STmax of at least about 0.2 g/d.

EXAMPLE B

In Example B filament yarns spun between 3000 and 6500 mpm were drawn false-twist textured at 220° C. and bulk of the textured yarns were measured according to Frankfort and Knox and plotted versus spinning speed of the draw feed yarn (See FIG. 23). Bulk is found to increase with spinning speed as previous taught by Frankfort and Knox. The bulk also increased with texturing speeds (at least for the case presented here from 700 to 800 mpm). The increase in bulk with spin speed is attributed to higher stress-induced orientation (SIO) which decreases the cold crystallization temperature $T_{cc}$ of the feed yarn (see FIG. 3A) and increases the rate of crystallization; further the crystal size increases 8–16 X in volume providing larger intercrystalline regions which permits greater mobility of the amorphous chains (i.e., of greater free-volume as supported by a decrease in the filament $T_g$ as measured by rheovibron and discussed in detail in Frankfort and Knox) and the increase in mobility of the amorphous chains facilitates crystallization (and thereby bulk development) in high speed texturing. The increase in bulk from going from 700 to 800 mpm is believed to be associated with a "pre-setting" phenomenon. If the structure has too low a $T_{cc}$, too high a rate of crystallization and too large of an intercrystalline region for a given residence time, the draw feed yarns under go "pre-setting" prior to development of the fully twisted state. This can be easily demonstrated by purposefully pre-treating the draw feed yarns to temperatures above $T_c^o$ prior to draw twisting. At some higher texturing speed the enhanced crystallization potential of the high speed spun yarns matches that of the process residence time (which is also dependent of temperature and textured draw stress levels) and no further shrinkage is observed. However, if the high speed spun low shrinkage crystalline spin-oriented yarns (Type A) are treated such to increase their shrinkage S levels then further increases in bulk are possible (see FIG. 23). It is therefore believed that the B-filament yarns of the invention with the proper level of interlace and spin finish would be superior draw texturing feed yarns especially at the higher texturing speeds (e.g., greater than 800 mpm).

EXAMPLE C

In Example C the A-filaments used as feed filaments in this invention may be combined with high speed spun nylon filaments (such as those prepared according to Knox et al in U.S. Pat. No. 5,137,666 and Boles et al in U.S. Pat. No.5,219,503 to provide a mixed polyester (A)/nylon (C') filament yarn which may be uniformly drawn with or without heat as taught by Boles et al in co-pending applications Ser. Nos. 07/753/529 and 07/753/769. A mixed-shrinkage post-bulkable yarn (BC') may be provided by treating the AC' mixed-filament yarn according to either Type I or Type II processes. The mixed-shrinkage BC' filament yarn could be pre-bulked, if desired, in a warping/slashing operation prior to winding onto a beam or directly being fed as a weftless warp sheet into the warp knit and weaving operations. Also the BC' yarns may be used as feed yarn in air-jet texturing wherein the combination of mixed-shrinkage and loop formation by the air-jet entanglement process would provide new aesthetic possibilities. If the polyester filaments are modified for dyeing with cationic dyes, then the polyester/nylon BC' mixed filament yarns would be compatible with the dyeing of elastomeric containing yarns and fabrics; e.g., as a covering or alternate course yarn in women's hosiery or to provide a "drier" hand in sports wear.

EXAMPLE D

In Example D the thermal properties of A, A', B, and C' filaments can be incorporated in a single filament, such as in an A'/A bicomponent polyester filament yarn that on treatment by either process Type I or Type II of the invention would yield an A'/B bicomponent filament yarn that on heat relaxation would provide a yarn comprised of torque-free helically crimped filaments; and such as in an A/C' biconstituent polyester/nylon filament yarn that on treatment by either process Type I or Type II of the invention would yield an B/C' biconstituent polyester/nylon filament yarn that on heat relaxation would provide a yarn comprised of torque-free helically crimped filaments. To further enhance the shrinkage power, the A'/B and B/C' filaments may be drawn by Processes Type III of the invention prior to heat relaxation. To "de-register" the helically coiled-filaments (i.e., to break-up the "follow-the-leader crimp" configuration) bicomponent and biconstituent filaments of different deniers and/or cross-section symmetry may be used. The bicomponent and biconstituent filament may have a side-by-side (SBS) or a sheath/core (S/C) structure. In the case of a sheath/core structure, a mixed-filament yarn comprised of polyester/nylon sheath core filaments and of nylon/polyester filaments may be prepared (especially for polyester modified for cationic dyeing) to provide for cross-dye effects. When spinning polyester/nylon SBS biconstituent filaments it is preferred to use antimony-free polyester as disclosed by Jennings in U.S. Pat. No. 4,702,875 or by incorporating in the polyamide dicarboxybenzene (—OC—$C_6H_4$—CO—) groups, for example, to improve the chemical compatibility at the polyester/polyamide interface so to prevent splitting of the filaments. Applying the theory of solubility parameters (e.g., additivity of group cohesive energy densities) may be used to design the chemical compositions of both the polyester and polyamide polymers in a more structured fashion versus empirical testing to provide the required surface tension for good adhesion of the dissimilar polymers.

In the case of the A'/A bicomponent filaments, the thermal stability of A' component may be increased over that of the A component by use of higher polymer LRV or the incorporation of chain branching agents in the A' polymer feed. Alternatively, for example the A' polymer feed may be modified to lessen its thermal stability (i.e., make A from A') by incorporating minor amounts of copolymer, for example, to reduce slightly the degree of crystallinity between A and A'. As higher spin speeds are used to prepare the A'/A biconstituent filaments, greater RV, chain branching, or copolymer modifications will be required to achieve the difference in thermal stability such that on treatment by process Type I or Type II A'/B bicomponent yarns may be prepared that on heat relaxation will provide torque-free helical crimped filaments. The A'/A and A/C' may be drawn a temperatures near the $T_{11}$ transition temperature of the polyester component to provide A'/B and B/C' filaments (as designated herein before as Process Type VII).

EXAMPLE E

In Example E filaments having an asymmetric structure are formed by first providing A-filaments by melt spinning at withdrawal speeds between 2 km/min to 6 km/min and treating the fully quenched filaments by a thermal deformation treatment, such as by pin as described in Frankfort U.S. Pat. Nos. 3,816,992, 3,861,133, and 3,905,077 or a heated surface may be used if residence time or lower surface friction is preferred. The treating of the thermally deformed A-filaments by treatment processes of Type I or Type II of the invention provides a filament comprised of "random" components of Type A' and of Type B shrinkage behavior. On heat relaxation the filaments will self-crimp forming torque-free helical crimped filaments. The frequency and amplitude of the helical crimped filaments may be changed by treating a yarn comprised of filaments of different deniers, for example.

EXAMPLE F

Spin-oriented polyester filaments of Type B, which on exposure to temperatures above $\{0.70(T_m^o+273)-273\}$ will self-helically crimp, may be provided from filaments of Type A by either heat treatment Type I or Type II; wherein the Type A filaments are of aymmetric hollow cross-section and are prepared by extruding the polyester polymer melt from a spinneret capillary orifice comprised of multiple segments arranged in a configuration such to form multiple melt streams which are withdrawn from the spinneret into a quench zone under conditions which cause self-coalescence of the multiple melt streams into a filament having an off-center longitudinal void of at least 10% by volume, preferably at least 20% by volume. The void side of the filament has shrinkage characteristics of a thermally Type A' filament, while the solid side of the filament may be prepared to have shrinkage S characteristic of a Type A filament. Heat treatments Type I or Type II transforms the asymmetric hollow "A/A'-filament" into a hollow "B/A'-filament" which on exposure to temperatures greater than about $\{0.70(T_m^o+273)-273\}$ will self helically crimp. Forming a multi-filament yarn of mixed dpf, cross-sectional shape, and void content, for example, will lead to crimped filaments of different helical frequency and amplitude and thereby disrupt the "follow-the-leader" crimp characteristic of helically crimped filament yarns and prvide higher yarn bulk and fabric cover (opacity).

EXAMPLE G

In Example G sheath/core filaments may be used as flat yarns (i.e., with little tendency to form along-end crimp) provided that the sheath/core configuration is used and is symmetric along-end. For example, a spin-oriented flat nylon-like filament may be prepared by forming a biconstituent filament having a nylon sheath and a polyester core. The polyester core serves at least two functions; 1) it reduces the ingredient costs of the "flat" filament and 2) provides filaments of a higher modulus than possible by spin-orientation of 100% nylon, at least at speeds less than about 8000–10,000 mpm.

Spin-oriented polyester filaments have a higher modulus for a spin speed than nylon spin-oriented filaments. Coupling the modulus of the the polyester core ($M_p$) and of the nylon sheath ($M_n$) provides a composite filament modulus ($M_c$) that falls between $M_p$ and $M_n$. Side-by-side and sheath/core configurations are well represented by the "parallel" model of coupling of two phases; that is, $M_c=XM_n+(1-X)M_p$, where X is the volume fraction of the sheath and (1-X) is the volume fraction of the core. For example, if $M_p=60$ g/d and $M_n=15$ g/d and the sheath (X) comprises 40% of the filament, the expected composite modulus $M_c=\{0.4(15)+0.6(60)\}=42$ g/d.

Direct spinning of of 65 RV nylon 66 polymer at 5300 mpm and a $T_p$ of 290° C. provides a nylon filaments having a modulus of about 15 g/d and a boil-off shrinkage of about 3–4%, while spinning a 21 LRV 2GT polyester under the same conditions provides polyester filaments of about 60 g/d modulus and a boil-off shrinkage of about 2–4%. If the moduli are additive according to the "parallel" coupling model, then to obtain a composite filament having a 30 g/d modulus, about 35% polyester core would be required; however, if the spun biconstituent S/C nylon/polyester filaments are treated according to the invention at temperatures about the $T_{c,\frac{1}{2}}$ of the polyester polymer, then lonly about 17% polyester core would be required or the same modulus with 35% polyester could could be obtained by spinning at a lower spin speed; e.g.,about 3500 mpm to obtain the same composite modulus of 30 g/d. This process of the invention permits for the first time to obtain "hard yarn" like nylon filaments at spin speeds in the 4000-5000 mpm range; nearly half the spin speed required for 100% nylon.

For textile uses as a flat yarn in warp knitting, for example, a modulus of at least 20 g/d is required (as based on ranking of nylon fabrics critically dyed with a large molecule acid dye as described by Boles, et al in U.S. Pat.. No. 5,219,503 and 25 g/d is preferred and 30 g/d is especially preferred.

To obtain the desired shrinkage for a given end-use; for example, high speed spin-oriented nylon 66 filament yarns have 3–6% and high speed spin-oriented nylon 6 filament yarns have 8–12% shrinkage. Commercial warp knit flat yarns are prepared by slow speed spin/-draw processes giving about 6–8% shrinkage for nylon 66. To increase the shrinkage of the composite nylon/-polyester filament yarns the nylon 66 may be modified with copolyamides, such as with 2-methyl pentadiamine (MPMD) as disclosed in U.S. Pat.. Nos. 5,137,447 and in U.S. Pat. No.5,219,503.

The polyester component treated athe higher temperatures of about $T_{c,\frac{1}{2}}$ will have similar shrinkage levels to that of drawn nylon 66 and 6. If lower shrinkages are required than the polyster RV many be increased slightly or higher spin speeds may be used. To maintain the balance between the shrinkage of the nylon sheath and the polyester core so to minimize along-end crimp development (for even uniform symmetric sheath/core cross-section filaments have a finite long-end variability), quenching air flow rates, patterns, and the convergence length are all carefully controlled to minimize threadline movement.

EXAMPLE H

In Example H several copolyesters are compared as to their elongation ($E_B$), shrinkage (S) and RDDR for spin speeds of 4100 and 4530 mpm. In this first set of samples, all filaments were spun at 4530 mpm using 15×60 mil capillaries at a spin pack temperature of 305° C. ( the actual polymer temperature was not measured, but is expected to be about 10° C. lower from previous studies) to provide 150 denier 80-filament SOY. The copolymers used were: 1 (control—no modifiers); 2–3% Glutarate; 3–8% Glutarate; 4–8% Glutarate with 0.06% TMP; 5–5% PEO with 0.06% TMP; 6–2% Cationic moiety; 7–1% trimethyl tetramesicate; and 8–0.04% TMP (trimethly propionate). The summary of the details are given in Table 21. Although low shrinkage and excellend dyeability were obtained for the copolyester A-filaments for use as precursors of the B-filaments of the invention, many of the copolyesters have RDR-values greater than 1.9. Higher spin speeds would be required if lower RDR-values are desired. For copolyesters the range of acceptable RDR-values is about 2.2 to 1.4 versus 1.9 to 1.4 for homopolymer.

EXAMPLE I

In Example I nylon 66 copolyamides were spun at 4000 and at 5000 mpm. All yarns were 50 denier 13-filaments spun at a nominal $T_p$ of 290° C. using 10×19 mil capillary spinnerets and quenched using cross-flow air and converged at about 135 cm from the spinneret. Details are given in Table 22. All the yarns had insufficient modulus for use as a direct-use flat yarn, but may be used as the sheath in a sheath/core polyamide/-polyester to provide flat SOY according to the invention.

EXAMPLE J

In Example J the DSC data for heat treated A-filaments of nominal 1.5 dpf and spun 4500 mpm. Details are given in Table 23. The decrease in the fiber $T_m$ with increasing tube temperature is consistent with a decrease in average crystal size and the melting out of the primary crystal structure (C) in addition to the mesophase (B) as represented in FIG. 21.

TABLE IA

| ITEM NO. | 1C | 2C | 3 | 4 | 5 | 6 | 7 | 8 | 9C | 10C |
|---|---|---|---|---|---|---|---|---|---|---|
| V, YPM | 4500 | 4500 | 4500 | 4500 | 4500 | 4500 | 4500 | 4500 | 4700 | 4700 |
| V, MPM | 4115 | 4115 | 4115 | 4115 | 4115 | 4115 | 4115 | 4115 | 4298 | 4298 |
| ANNEAL TYPE | STEAM | STEAM | STEAM | STEAM | STEAM | STEAM | STEAM | STEAM | STEAM | STEAM |
| , °C. | 245 | 245 | 245 | 245 | 245 | 245 | 245 | 245 | 245 | 245 |
| , LBS/IN | OFF | 40 | 60 | 80 | 100 | 120 | 140 | 160 | OFF | 40 |
| , KG/CM$^2$ | OFF | 2.8 | 4.2 | 5.6 | 7.0 | 8.4 | 9.8 | 11.2 | OFF | 2.8 |
| YARN DENIER | 35 | 35 | 35 | 35 | 35 | 35 | 35 | 35 | 35 | 35 |
| FILS/YARN | 17 | 17 | 17 | 17 | 17 | 17 | 17 | 17 | 17 | 17 |
| DPF | 2.1 | 2.1 | 2.1 | 2.1 | 2.1 | 2.1 | 2.1 | 2.1 | 2.1 | 2.1 |
| T7%, G/D | — | 0.99 | 1.18 | 1.32 | 1.41 | 1.46 | 1.69 | 1.74 | 0.94 | 1.23 |
| T20%, G/D | — | 1.23 | 1.43 | 1.71 | 1.88 | 2.00 | 2.36 | 2.44 | 1.25 | 1.60 |
| PYM, G/D | — | 3.2 | 3.5 | 4.9 | 5.7 | 6.4 | 7.8 | 8.2 | 3.79 | 4.63 |
| EB, % | — | 63.8 | 45.4 | 41.8 | 43.8 | 41.4 | 35.6 | 41.6 | 60.8 | 43.8 |
| RDR | — | 1.638 | 1.454 | 1.418 | 1.438 | 1.414 | 1.356 | 1.416 | 1.608 | 1.438 |
| TEN., G/D | — | 2.64 | 2.33 | 2.84 | 3.12 | 3.17 | 3.20 | 3.58 | 2.57 | 2.33 |
| TBK, G/DD | — | 4.32 | 3.39 | 4.03 | 4.49 | 4.48 | 4.34 | 5.07 | 4.13 | 3.35 |
| S, % | — | 8.0 | 18.5 | 59.0 | 48.0 | 30.0 | 14.0 | 12.0 | 3.5 | 5.5 |
| DHS, % | 3.9 | 7.7 | 38.3 | 49.0 | 35.5 | 19.9 | 13.1 | 11.3 | 3.6 | 7.3 |
| DHS-S, % | — | −0.3 | 19.8 | −10.0 | −12.5 | −10.1 | −0.9 | −0.7 | 0.1 | 1.8 |
| STmax, MG/D | — | — | — | — | — | — | 176 | 153 | 89 | 131 |
| T(STmax), C | — | — | — | — | — | — | 92 | 126 | 84 | 83 |
| NST, (G/D)/K | — | — | — | — | — | — | 0.48 | 0.38 | 0.25 | 0.37 |
| Ms, G/D | — | — | — | — | — | — | 1.3 | 1.3 | 2.54 | 2.38 |
| Ps, G/D | — | — | — | — | — | — | 2.5 | 1.8 | 0.3 | 0.7 |

| ITEM NO. | 11C | 12 | 13 | 14 | 15 | 16 | 17C | 18C | 19 | 20 |
|---|---|---|---|---|---|---|---|---|---|---|
| V, YPM | 4700 | 4700 | 4700 | 4700 | 4700 | 4700 | 4900 | 4900 | 4900 | 4900 |
| V, MPM | 4298 | 4298 | 4298 | 4298 | 4298 | 4298 | 4481 | 4481 | 4481 | 4481 |
| ANNEAL TYPE | STEAM | STEAM | STEAM | STEAM | STEAM | STEAM | STEAM | STEAM | STEAM | STEAM |
| , °C. | 245 | 245 | 245 | 245 | 245 | 245 | 245 | 245 | 245 | 245 |
| , LBS/IN | 60 | 80 | 100 | 120 | 140 | 160 | OFF | 40 | 60 | 80 |
| , KG/CM$^2$ | 4.2 | 5.6 | 7.0 | 8.4 | 9.8 | 11.2 | OFF | 3 | 4 | 6 |
| YARN DENIER | 35 | 35 | 35 | 35 | 35 | 35 | 35 | 35 | 35 | 35 |
| FILS/YARN | 17 | 17 | 17 | 17 | 17 | 17 | 17 | 17 | 17 | 17 |
| DPF | 2.1 | 2.1 | 2.1 | 2.1 | 2.1 | 2.1 | 2.1 | 2.1 | 2.1 | 2.1 |
| T7%, G/D | 1.17 | 1.16 | 1.36 | 1.44 | 1.60 | 1.74 | 1.05 | 1.18 | 1.10 | — |
| T20%, G/D | 1.47 | 1.45 | 1.78 | 1.94 | 2.20 | 2.41 | 1.40 | 1.51 | 1.43 | — |
| PYM, G/D | 3.92 | 4.32 | 5.21 | 6.03 | 7.11 | 7.89 | 4.3 | 4.2 | 4.1 | — |
| EB, % | 42.2 | 51.0 | 52.9 | 40.0 | 39. 7 | 31.2 | 61.7 | 53.0 | 66.9 | — |
| RDR | 1.422 | 1.510 | 1.529 | 1.400 | 1.397 | 1.312 | 1.62 | 1.53 | 1.67 | — |
| TEN., G/D | 2.25 | 2.58 | 3.46 | 3.03 | 3.21 | 3.03 | 2.78 | 2.72 | 3.03 | — |
| TBK, G/DD | 3.20 | 3.90 | 5.29 | 4.24 | 4.48 | 3.98 | 4.50 | 4.16 | 5.06 | — |
| S, % | 8.5 | 13.0 | 46.5 | 31.5 | 22.0 | 13.5 | 3.8 | 6.5 | 10.0 | 7.5 |

TABLE IA-continued

| | | | | | | | | | | |
|---|---|---|---|---|---|---|---|---|---|---|
| DHS, % | 12.0 | 15.8 | 35.8 | 19.9 | 13.6 | 10.2 | 3.8 | 5.0 | 5.5 | 7.5 |
| DHS-S, % | 3.5 | 2.8 | 46.5 | −11.6 | −8.4 | −3.3 | 0.0 | −1.5 | −4.5 | 0.0 |
| STmax, MG/D | 144 | 166 | 158 | 166 | 137 | 157 | 54 | 126 | 156 | 138 |
| T(STmax), C | 80 | 79 | 79 | 86 | 88 | 100 | 86 | 80 | 81 | 81 |
| NST, (G/D)/K | 0.41 | 0.47 | 0.45 | 0.46 | 0.38 | 0.42 | 0.15 | 0.36 | 0.44 | 0.39 |
| Ms, G/D | 1.69 | 1.28 | 0.34 | 0.53 | 0.62 | 1.16 | 1.4 | 1.9 | 1.6 | 18 |
| Ps, G/D | 1.2 | 2.2 | 7.3 | 5.2 | 3.0 | 2.1 | 0.20 | 0.82 | 1.56 | 1.04 |

TABLE 1B

| ITEM NO. | 1 | 2 | 3 | 4 | 5C | 6C | 7C | 8 | 9C | 10 |
|---|---|---|---|---|---|---|---|---|---|---|
| V, YPM | 4900 | 4900 | 4900 | 4900 | 5300 | 5300 | 5300 | 5300 | 5300 | 5300 |
| V, MPM | 4481 | 4481 | 4481 | 4481 | 4846 | 4846 | 4846 | 4846 | 4846 | 4846 |
| ANNEAL TYPE | STEAM | STEAM | STEAM | STEAM | STEAM | STEAM | STEAM | STEAM | STEAM | STEAM |
| , °C. | 245 | 245 | 245 | 245 | 245 | 245 | 245 | 245 | 245 | 245 |
| , LBS./IN | 100 | 120 | 140 | 160 | OFF | 40 | 60 | 80 | 100 | 120 |
| , KG/CM$^2$ | 7 | 8 | 10 | 11 | OFF | 3 | 4 | 6 | 7 | 8 |
| YARN DENIER | 35 | 35 | 35 | 35 | 50 | 50 | 50 | 50 | 50 | 50 |
| FILS/YARN | 17 | 17 | 17 | 17 | 17 | 17 | 17 | 17 | 17 | 17 |
| DPF | 2.1 | 2.1 | 2.1 | 2.1 | 2.9 | 2.9 | 2.9 | 2.9 | 2.9 | 2.9 |
| T7%, G/D | 1.12 | 1.64 | 1.87 | 1.93 | — | — | — | — | — | — |
| T20%, G/D | 1.45 | 2.25 | 2.58 | 2.70 | — | — | — | — | — | — |
| PYM, G/D | 4.1 | 7.2 | 8.4 | 9.0 | — | — | — | — | — | — |
| EB, % | 66.6 | 32.0 | 33.9 | 28.4 | — | — | — | — | — | — |
| RDR | 1.666 | 1.320 | 1.339 | 1.284 | — | — | — | — | — | — |
| TEN., G/D | 3.07 | 2.91 | 3.31 | 3.20 | — | — | — | — | — | — |
| TBK, G/DD | 5.11 | 3.84 | 4.43 | 4.11 | — | — | — | — | — | — |
| S, % | 11.5 | 35.0 | 18.5 | 17.0 | 4.0 | 7.9 | 5.9 | 7.2 | 7.1 | 10.5 |
| DHS, % | 8.8 | 24.6 | 14.3 | 10.0 | 4.5 | 5.0 | 5.4 | 6.9 | 7.1 | 11.1 |
| DHS-S, % | −3.7 | −10.4 | −4.2 | −7.0 | 0.5 | −2.9 | −0.5 | −0.3 | 0.0 | 0.6 |
| STMax, MG/D | 161 | 151 | 179 | 145 | 130 | 160 | 170 | 210 | 200 | 230 |
| T(STmax), C | 82 | 83 | 94 | 100 | 81 | 78 | 79 | 79 | 81 | 83 |
| NST, (G/D)/K | 0.45 | 0.42 | 0.49 | 0.39 | 0.37 | 0.46 | 0.48 | 0.60 | 0.56 | 0.65 |
| Ms, G/D | 1.4 | 0.4 | 1.0 | 0.9 | 3.25 | 2.03 | 2.88 | 2.92 | 2.82 | 2.19 |

| ITEM NO. | 11 | 12 | 13C | 14 | 15 | 16 | 17 | 18 | 19 | 20C | 21C |
|---|---|---|---|---|---|---|---|---|---|---|---|
| V, YPM | 5300 | 5300 | 4500 | 4500 | 4500 | 4500 | 4500 | 4500 | 4500 | 4700 | 4700 |
| V, MPM | 4846 | 4846 | 4115 | 4115 | 4115 | 4115 | 4115 | 4115 | 4115 | 4298 | 4298 |
| ANNEAL TYPE | STEM | STEAM | OFF | STEAM | STEAM | STEAM | STEAM | STEAM | STEAM | OFF | STEAM |
| , °C. | 245 | 245 | OFF | 245 | 245 | 245 | 245 | 245 | 245 | OFF | 245 |
| , LBS./IN | 140 | 160 | OFF | 40 | 60 | 80 | 100 | 120 | 140 | OFF | 40 |
| , KG/CM$^2$ | 10 | 11 | OFF | 2.8 | 4.2 | 5.6 | 7.0 | 8.4 | 9.8 | 11.2 | 2.8 |
| YARN DENIER | 50 | 50 | 50 | 50 | 50 | 50 | 50 | 50 | 50 | 50 | 50 |
| FILS/YARN | 17 | 17 | 17 | 17 | 17 | 17 | 17 | 17 | 17 | 17 | 17 |
| DPF | 2.9 | 2.9 | 2.94 | 2.94 | 2.94 | 2.94 | 2.94 | 2.94 | 2.94 | 2.94 | 2.94 |
| T7%, G/D | — | — | 0.92 | 0.90 | 1.14 | 1.46 | 1.61 | 1.15 | 1.25 | 0.89 | 0.95 |
| T20%, G/D | — | — | 0.99 | 1.02 | 1.41 | 1.93 | 2.14 | 1.52 | 1.72 | 1.13 | 1.16 |
| PYM, G/D | — | — | 2.4 | 2.0 | 3.6 | 5.8 | 6.5 | 4.6 | 4.8 | 3.1 | 2.89 |
| EB, % | — | — | 74.7 | 71.5 | 57.2 | 47.7 | 44.1 | 56.3 | 50.1 | 77.1 | 71.9 |
| RDR | — | — | 1.747 | 1.715 | 1.572 | 1.477 | 1.441 | 1.563 | 1.501 | 1.771 | 1.719 |
| TEN., G/D | — | — | 2.65 | 2.69 | 3.14 | 3.48 | 3.51 | 3.27 | 3.22 | 2.96 | 2.92 |
| TBK, G/DD | — | — | 4.63 | 4.61 | 4.94 | 5.14 | 5.06 | 5.11 | 4.83 | 5.24 | 5.02 |
| S, % | 13.6 | 10.8 | — | — | 44.5 | 55.7 | N/A | N/A | 20.0 | 3.6 | 8.1 |
| DHS, % | 10.8 | 11.6 | 4.4 | 12.7 | 47.2 | 58.0 | 47.0 | 27.7 | 19.3 | 6.0 | 5.7 |
| DHS-S, % | −2.8 | 0.8 | — | — | 2.7 | 2.3 | — | — | −0.7 | 2.4 | −2.4 |
| STMax, MG/D | 190 | 190 | 110 | 200 | 180 | 140 | 140 | 200 | 160 | 80 | 100 |
| T(STmax), C | 87 | 90 | 82 | 72 | 71 | 71 | 73 | 84 | 81 | 82 | 76 |
| NST, (G/D)/K | 0.53 | 0.52 | 0.31 | 0.58 | 0.52 | 0.41 | 0.41 | 0.56 | 0,45 | 0.22 | 0.29 |
| Ms, G/D | 0.64 | 1.76 | — | — | 0.4 | 0.3 | — | — | 0.8 | 2.2 | 1.23 |

TABLE IC

| ITEM NO. | 1 | 2 | 3 | 4 | 5 | 6 | 7C | 8C | 9C | 10 |
|---|---|---|---|---|---|---|---|---|---|---|
| V, YPM | 4700 | 4700 | 4700 | 4700 | 4700 | 4700 | 4900 | 4900 | 4900 | 4900 |
| V, MPM | 4298 | 4298 | 4298 | 4298 | 4298 | 4298 | 4481 | 4481 | 4481 | 4481 |
| ANNEAL | STEAM | STEAM | STEAM | STEAM | STEAM | STEAM | STEAM | STEAM | STEAM | STEAM |
| , °C. | 245 | 245 | 245 | 245 | 245 | 245 | 245 | 245 | 245 | 245 |
| , LBS/IN$^2$ | 60 | 80 | 100 | 120 | 140 | 160 | OFF | 40 | 60 | 80 |
| , KG/CM$^2$ | 4.2 | 5.6 | 7.0 | 8.4 | 9.8 | 11.2 | OFF | 2.8 | 4.2 | 5.6 |
| DENIER | 50 | 50 | 50 | 50 | 50 | 50 | 50 | 50 | 50 | 50 |
| NO. FILS | 17 | 17 | 17 | 17 | 17 | 17 | 17 | 17 | 17 | 17 |
| DPF | 2.94 | 2.94 | 2.94 | 2.94 | 2.94 | 2.94 | 2.94 | 2.94 | 2.94 | 2.94 |
| T7%, G/D | 0.96 | 1.03 | 1.19 | 1.18 | 1.24 | 1.37 | 0.94 | 0.95 | 1.02 | 1.10 |
| T20%, G/D | 1.17 | 1.23 | 1.56 | 1.58 | 1.68 | 1.93 | 1.24 | 1.22 | 1.28 | 1.36 |
| PYM, G/D | 2.90 | 2.88 | 4.61 | 4.87 | 5.30 | 6.54 | 3.7 | 3.4 | 3.4 | 3.5 |
| Eb, % | 66.6 | 66.1 | 50.9 | 49.1 | 54.2 | 41.2 | 65.8 | 68.4 | 75.5 | 61.4 |
| RDR | 1.666 | 1.661 | 1.509 | 1.491 | 1.542 | 1.412 | 1.658 | 1.684 | 1.755 | 1.614 |
| TEN., G/D | 2.79 | 3.03 | 3.12 | 3.00 | 3.41 | 3.02 | 2.78 | 2.90 | 3.18 | 2.88 |
| TBK, G/DD | 4.65 | 5.03 | 4.71 | 4.47 | 5.26 | 4.26 | 4.61 | 4.88 | 5.58 | 4.65 |

TABLE IC-continued

| | | | | | | | | | | |
|---|---|---|---|---|---|---|---|---|---|---|
| S, % | 19.5 | 22.6 | 54.9 | 35.4 | 24.1 | 10.7 | 3.5 | 5.5 | 6.5 | 14.0 |
| DHS, % | 11.3 | 23.2 | 48.7 | 29.3 | 15.1 | 10.2 | 4.3 | 6.6 | 7.8 | 9.8 |
| DHS-S, % | −8.2 | 0.6 | −6.2 | −6.1 | −9.0 | −0.5 | 0.8 | 1.1 | 1.3 | −4.2 |
| STmax, MG/D | 130 | 150 | 140 | 150 | 120 | 170 | 90 | 120 | 130 | 160 |
| T(STmax), C | 77 | 74 | 75 | 77 | 85 | 93 | 88 | 89 | 77 | 72 |
| NST, (G/D)/K | 0.37 | 0.43 | 0.40 | 0.43 | 0.34 | 0.46 | 0.25 | 0.33 | 0.37 | 0.46 |
| Ms, G/D | 0.67 | 0.66 | 0.26 | 0.42 | 0.50 | 1.59 | 2.6 | 2.2 | 2.0 | 1.1 |
| Ps, G/D | 2.5 | 3.4 | 7.9 | 5.3 | 2.9 | 1.8 | 0.3 | 0.7 | 0.8 | 2.2 |
| ITEM NO. | 11 | 12 | 13 | 14 | 15C | 16C | 17C | 18C | 19 | 20 |
| V, YPM | 4900 | 4900 | 4900 | 4900 | 5100 | 5100 | 5100 | 5100 | 5100 | 5100 |
| V, MPM | 4481 | 4481 | 4481 | 4481 | 4663 | 4663 | 4663 | 4663 | 4663 | 4663 |
| ANNEAL | STEAM | STEAM | STEAM | STEAM | STEAM | STEAM | STEAM | STEAM | STEAM | STEAM |
| , °C. | 245 | 245 | 245 | 245 | 245 | 245 | 245 | 245 | 245 | 245 |
| , LBS/IN$^2$ | 100 | 120 | 140 | 160 | OFF | 40 | 60 | 80 | 100 | 120 |
| , KG/CM$^2$ | 7.0 | 8.4 | 9.8 | 11.2 | OFF | 2.80 | 4.20 | 5.60 | 7.00 | 8.40 |
| DENIER | 50 | 50 | 50 | 50 | 50 | 50 | 50 | 50 | 50 | 50 |
| NO. FILS | 17 | 17 | 17 | 17 | 17 | 17 | 17 | 17 | 17 | 17 |
| DPF | 2.94 | 2.94 | 2.94 | 2.94 | 2.94 | 2.94 | 2.94 | 2.94 | 2.94 | 2.94 |
| T7%, G/D | 1.13 | 1.13 | 1.30 | 1.36 | — | 1.05 | 1.07 | 1.06 | 1.20 | 1.22 |
| T20%, G/D | 1.42 | 1.4 | 1.75 | 1.88 | — | 1.33 | 1.39 | 1.37 | 1.51 | 1.57 |
| PYM, G/D | 3.8 | 3.8 | 5.4 | 6.1 | — | 2.60 | 4.01 | 3.90 | 4.04 | 4.43 |
| Eb, % | 52.3 | 62.1 | 55.9 | 52.9 | — | 62.6 | 67.6 | 71.6 | 63.1 | 58.3 |
| RDR | 1.523 | 1.621 | 1.559 | 1.529 | — | 1.626 | 1.676 | 1.716 | 1.631 | 1.583 |
| TEN., G/D | 2.78 | 3.24 | 3.53 | 3.48 | — | 2.92 | 3.12 | 3.21 | 3.23 | 3.26 |
| TBK, G/DD | 4.23 | 5.25 | 5.50 | 5.32 | — | 4.75 | 5.23 | 5.51 | 5.27 | 5.16 |
| S, % | 20.1 | 26.7 | 23.5 | 15.0 | 3.9 | 4.5 | 7.8 | 7.5 | 15.1 | 21.6 |
| DHS, % | 16.1 | 25.6 | 17.3 | 10.2 | 4.5 | 4.4 | 5.9 | 6.9 | 11.3 | 16.7 |
| DHS-S, % | −4.0 | −1.1 | −6.2 | −4.8 | 0.6 | −0.1 | −1.9 | −0.6 | −3.8 | −4.9 |
| STmax, MG/D | 180 | 160 | 130 | 120 | 120 | 120 | 170 | 160 | 190 | 170 |
| T(STmax), C | 77 | 79 | 86 | 97 | 85 | 80 | 78 | 78 | 80 | 82 |
| NST, (G/D)/K | 0.51 | 0.45 | 0.36 | 0.32 | 0.34 | 0.34 | 0.48 | 0.46 | 0.54 | 0.48 |
| Ms, G/D | 0.9 | 0.6 | 0.6 | 0.8 | 3.1 | 2.7 | 2.2 | 2.1 | 1.3 | 0.8 |
| Ps, G/D | 3.6 | 4.3 | 3.1 | 1.8 | 0.5 | 0.5 | 1.3 | 1.2 | 2.9 | 3.7 |

TABLE 1D

| ITEM NO. | 1 | 2 | 3C | 4C | 5C | 6 | 7C | 8 | 9 |
|---|---|---|---|---|---|---|---|---|---|
| V, YPM | 5100 | 5100 | 5300 | 5300 | 5300 | 5300 | 5300 | 5300 | 5300 |
| V, MPM | 4663 | 4663 | 4846 | 4846 | 4846 | 4846 | 4846 | 4846 | 4846 |
| ANNEAL TYPE | STEAM | STEAM | STEAM | STEAM | STEAM | STEAM | STEAM | STEAM | STEAM |
| , °C. | 245 | 245 | 245 | 245 | 245 | 245 | 245 | 245 | 245 |
| , LBS/IN$^2$ | 140 | 160 | OFF | 40 | 60 | 80 | 100 | 120 | 140 |
| , KG/CM$^2$ | 9.80 | 11.20 | 0FF | 3 | 4 | 6 | 7 | 8 | 10 |
| YARN DENIER | 50 | 50 | 50 | 50 | 50 | 50 | 50 | 50 | 50 |
| FILS/YARN | 17 | 17 | 17 | 17 | 17 | 17 | 17 | 17 | 17 |
| DPF | 2.94 | 2.94 | 2.9 | 2.9 | 2.9 | 2.9 | 2.9 | 2.9 | 2.9 |
| S, % | 19.8 | 15.5 | 4.0 | 7.9 | 5.9 | 7.2 | 7.1 | 10.5 | 13.6 |
| DHS, % | 15.7 | 11.7 | 4.5 | 5.0 | 5.4 | 6.9 | 7.1 | 11.1 | 10.8 |
| DHS-S, % | −4.1 | −3.8 | 0.5 | −2.9 | −0.5 | −0.3 | 0.0 | 0.6 | −2.8 |
| STmax, MG/D | 200 | 220 | 130 | 160 | 170 | 210 | 200 | 230 | 190 |
| T(STmax), C | 93 | 92 | 81 | 78 | 79 | 79 | 81 | 83 | 87 |
| NST, (G/D)/K | 0.56 | 0.60 | 0.37 | 0.46 | 0.48 | 0.60 | 0.56 | 0.65 | 0.53 |
| Ms, G/D | 1.0 | 1.4 | 3.25 | 2.03 | 2.88 | 2.92 | 2.82 | 2.19 | 0.64 |
| Ps, G/D | 4.0 | 3.4 | 0.52 | 1.26 | 1.00 | 1.51 | 1.42 | 2.42 | 2.58 |
| ITEM NO. | 10 | 11C | 12C | 13 | 14 | 15 | 16 | 17 | 18 |
| V, YPM | 5300 | 4500 | 4500 | 4500 | 4500 | 4500 | 4500 | 4500 | 4500 |
| V, MPM | 4846 | 4115 | 4115 | 4115 | 4115 | 4115 | 4115 | 4115 | 4115 |
| ANNEAL TYPE | STEAM | STEAM | STEAM | STEAM | STEAM | STEAM | STEAM | STEAM | STEAM |
| , °C. | 245 | 245 | 245 | 245 | 245 | 245 | 245 | 245 | 245 |
| , LBS/IN$^2$ | 160 | OFF | 40 | 60 | 80 | 100 | 120 | 140 | 160 |
| , KG/CM$^2$ | 11 | OFF | 2.8 | 4.2 | 5.6 | 7.0 | 8.4 | 9.8 | 11.2 |
| YARN DENIER | 50 | 70 | 70 | 70 | 70 | 70 | 70 | 70 | 70 |
| FILS/YARN | 17 | 17 | 17 | 17 | 17 | 17 | 17 | 17 | 17 |
| DPF | 2.9 | 4.1 | 4.1 | 4.1 | 4.1 | 4.1 | 4.1 | 4.1 | 4.1 |
| S, % | 10.8 | 16.5 | 17.5 | 21.5 | 51.5 | 58.5 | 41.5 | 31.0 | 13.0 |
| DHS, % | 11.6 | 8.5 | 14.1 | 19.3 | 52.9 | 56.3 | 34.9 | 23.5 | 11.7 |
| DHS-S, % | 0.8 | −8.0 | −3.4 | −2.2 | 1.4 | −2.2 | −6.6 | −7.5 | −1.3 |
| STmax, MG/D | 190 | 90 | 80 | 90 | 100 | 110 | 100 | 100 | 190 |
| T(STmax), C | 90 | 80 | 77 | 75 | 72 | 72 | 78 | 78 | 88 |
| NST, (G/D)/K | 0.52 | 0.25 | 0.23 | 0.26 | 0.29 | 0.32 | 0.28 | 0.28 | 0.52 |
| Ms, G/D | 1.76 | 0.55 | 0.46 | 0.42 | 0.19 | 0.19 | 0.24 | 0.32 | 1.46 |
| Ps, G/D | 2.05 | 1.49 | 1.40 | 1.94 | 5.15 | 6.44 | 4.15 | 3.10 | 2.47 |

TABLE 1E

| ITEM NO. | 1C | 2C | 3C | 4C | 5C | 6 | 7 | 8 |
|---|---|---|---|---|---|---|---|---|
| V, YPM | 4900 | 4900 | 4900 | 4900 | 4900 | 4900 | 4900 | 4900 |

TABLE 1E-continued

| | | | | | | | | |
|---|---|---|---|---|---|---|---|---|
| V, MPM | 4481 | 4481 | 4481 | 4481 | 4481 | 4481 | 4481 | 4481 |
| ANNEAL TYPE | STEAM | STEAM | STEAM | STEAM | STEAM | STEAM | STEAM | STEAM |
| , °C. | 245 | 245 | 245 | 245 | 245 | 245 | 245 | 245 |
| , LBS/IN$^2$ | OFF | 40 | 60 | 80 | 100 | 120 | 140 | 160 |
| , KG/CM$^2$ | OFF | 2.8 | 4.2 | 5.6 | 7.0 | 8.4 | 9.8 | 11.2 |
| YARN DENIER | 70 | 70 | 70 | 70 | 70 | 70 | 70 | 70 |
| FILS/YARN | 17 | 17 | 17 | 17 | 17 | 17 | 17 | 17 |
| DPF | 4.1 | 4.1 | 4.1 | 4.1 | 4.1 | 4.1 | 4.1 | 4.1 |
| S, % | 6.0 | 6.0 | 6.0 | 5.5 | 10.5 | 16.0 | 23.0 | 17.0 |
| DHS, % | 5.5 | 5.6 | 5.6 | 6.3 | 7.0 | 13.0 | 16.6 | 13.8 |
| DHS-S, % | −0.5 | −0.4 | −0.4 | 0.8 | −3.5 | −3.0 | −6.4 | −3.2 |
| STmax, MG/D | 90 | 90 | 90 | 110 | 110 | 130 | 120 | 110 |
| T(STmax), C | 84 | 83 | 84 | 81 | 82 | 84 | 83 | 94 |
| NST, (G/D)/K | 0.25 | 0.25 | 0.24 | 0.31 | 0.31 | 0.36 | 0.34 | 0.30 |
| Ms, G/D | 1.50 | 1.50 | 1.50 | 2.00 | 1.05 | 0.81 | 0.52 | 0.65 |
| Ps, G/D | 0.54 | 0.54 | 0.54 | 0.61 | 1.16 | 2.08 | 2.76 | 1.87 |
| ITEM NO. | 9C | 10C | 11C | 12C | 13C | 14 | 15 | 16 |
| V, YPM | 5100 | 5100 | 5100 | 5100 | 5100 | 5100 | 5100 | 5100 |
| V, MPM | 4663 | 4663 | 4663 | 4663 | 4663 | 4663 | 4663 | 4663 |
| ANNEAL TYPE | STEAM | STEAM | STEAM | STEAM | STEAM | STEAM | STEAM | STEAM |
| , °C. | 245 | 245 | 245 | 245 | 245 | 245 | 245 | 245 |
| , LBS/IN$^2$ | OFF | 40 | 60 | 80 | 100 | 120 | 140 | 160 |
| , KG/CM$^2$ | OFF | 2.8 | 4.2 | 5.6 | 7.0 | 8.4 | 9.8 | 11.2 |
| YARN DENIER | 70 | 70 | 70 | 70 | 70 | 70 | 70 | 70 |
| FILS/YARN | 17 | 17 | 17 | 17 | 17 | 17 | 17 | 17 |
| DPF | 4.1 | 4.1 | 4.1 | 4.1 | 4.1 | 4.1 | 4.1 | 4.1 |
| S, % | 5.8 | 5.5 | 6.0 | 6.5 | 6.5 | 13.0 | 23.0 | 16.0 |
| DHS, % | 5.2 | 5.5 | 5.5 | 5.7 | 6.3 | 10.2 | 13.2 | 11.5 |
| DHS-S, % | −0.6 | 0.0 | −0.5 | −0.8 | −0.2 | −2.8 | −9.8 | −4.5 |
| STmax, MG/D | 110 | 100 | 100 | 110 | 120 | 140 | 140 | 130 |
| T(STmax), C | 88 | 86 | 84 | 82 | 84 | 82 | 86 | 89 |
| NST, (G/D)/K | 0.30 | 0.28 | 0.28 | 0.31 | 0.34 | 0.39 | 0.39 | 0.36 |
| Ms, G/D | 1.90 | 1.82 | 0.17 | 1.69 | 1.85 | 1.08 | 0.61 | 0.81 |
| Ps, G/D | 0.64 | 0.64 | 0.60 | 0.72 | 0.78 | 1.82 | 3.22 | 2.08 |
| ITEM NO. | 17C | 18C | 19C | 20C | 21C | 22C | 23 | 24C |
| V, YPM | 5300 | 5300 | 5300 | 5300 | 5300 | 5300 | 5300 | 5300 |
| V, MPM | 4846 | 4846 | 4846 | 4846 | 4846 | 4846 | 4846 | 4846 |
| ANNEAL TYPE | STEAM | STEAM | STEAM | STEAM | STEAM | STEAM | STEAM | STEAM |
| , °C. | 245 | 245 | 245 | 245 | 245 | 245 | 245 | 245 |
| , LBS/IN$^2$ | OFF | 40 | 60 | 80 | 100 | 120 | 140 | 160 |
| , KG/CM$^2$ | OFF | 2.8 | 4.2 | 5.6 | 7.0 | 8.4 | 9.8 | 11.2 |
| YARN DENIER | 70 | 70 | 70 | 70 | 70 | 70 | 70 | 70 |
| FILS/YARN | 17 | 17 | 17 | 17 | 17 | 17 | 17 | 17 |
| DPF | 4.1 | 4.1 | 4.1 | 4.1 | 4.1 | 4.1 | 4.1 | 4.1 |
| S, % | 3.4 | 4.2 | 5.5 | 4.5 | 7.0 | 8.0 | 7.4 | 7.3 |
| DHS, % | 3.8 | 4.8 | 5.4 | 5.0 | 6.6 | 7.0 | 6.7 | 7.0 |
| DHS-S, % | 0.4 | 0.6 | −0.1 | 0.5 | −0.4 | −1.0 | −0.7 | −0.3 |
| STmax, MG/D | 90 | 120 | 130 | 120 | 190 | 150 | 210 | 160 |
| T(STmax), C | 92 | 86 | 85 | 84 | 85 | 83 | 88 | 87 |
| NST, (G/D)/K | 0.25 | 0.33 | 0.36 | 0.34 | 0.53 | 0.42 | 0.56 | 0.44 |
| Ms, G/D | 2.65 | 2.86 | 2.36 | 2.67 | 2.71 | 1.88 | 2.84 | 2.19 |
| Ps, G/D | 0.30 | 0.50 | 0.72 | 0.54 | 1.33 | 1.20 | 1.55 | 1.17 |

TABLE 2A

| ITEM NO. | 1C | 2C | 3 | 4 | 5 | 6 | 7 | 8 | 9C | 10C |
|---|---|---|---|---|---|---|---|---|---|---|
| V, YPM | 4500 | 4500 | 4500 | 4500 | 4500 | 4500 | 4500 | 4500 | 4700 | 4700 |
| V, MPM | 4115 | 4115 | 4115 | 4115 | 4115 | 4115 | 4115 | 4115 | 4298 | 4298 |
| ANNEAL TYPE | STEAM | STEAM | STEAM | STEAM | STEAM | STEAM | STEAM | STEAM | STEAM | STEAM |
| , °C. | 245 | 245 | 245 | 245 | 245 | 245 | 245 | 245 | 245 | 245 |
| , LBS/IN | OFF | 40 | 60 | 80 | 100 | 120 | 140 | 160 | OFF | 40 |
| , KG/CM$^2$ | OFF | 2.8 | 4.2 | 5.6 | 7.0 | 8.4 | 9.8 | 11.2 | OFF | 2.8 |
| YARN DENIER | 35 | 35 | 35 | 35 | 35 | 35 | 35 | 35 | 35 | 35 |
| FILS/YARN | 27 | 27 | 27 | 27 | 27 | 27 | 27 | 27 | 27 | 27 |
| DPF | 1.3 | 1.3 | 1.3 | 1.3 | 1.3 | 1.3 | 1.3 | 1.3 | 1.3 | 1.3 |
| S, % | 4.0 | 4.0 | 10.5 | 17.5 | 25.0 | 17.0 | 16.0 | 13.0 | 3.0 | 6.5 |
| DHS, % | 3.7 | 5.1 | 10.4 | 14.2 | 28.8 | 15.1 | 12.4 | 11.0 | 3.5 | 5.0 |
| DHS-S, % | −0.3 | 1.1 | −0.1 | −3.3 | 3.8 | −1.9 | −3.6 | −2.0 | 0.5 | −1.5 |
| STmax, MG/D | — | — | — | — | — | — | 256 | 174 | 87 | 111 |
| T(STmax), C | — | — | — | — | — | — | 92 | 90 | 91 | 79 |
| NST, (G/D)/K | — | — | — | — | — | — | 0.70 | 0.48 | 0.24 | 0.32 |
| Ms, G/D | — | — | — | — | — | — | 1.60 | 1.34 | 2.90 | 1.71 |
| Ps, (G/D) % | — | — | — | — | — | — | 4.1 | 2.3 | 0.26 | 0.7 |
| ITEM NO. | 11 | 12 | 13 | 14 | 15 | 16 | 17C | 18C | 19C | 20C |
| V, YPM | 4700 | 4700 | 4700 | 4700 | 4700 | 4700 | 4900 | 4900 | 4900 | 4900 |
| V, MPM | 4298 | 4298 | 4298 | 4298 | 4298 | 4298 | 4481 | 4481 | 4481 | 4481 |
| ANNEAL TYPE | STEAM | STEAM | STEAM | STEAM | STEAM | STEAM | STEAM | STEAM | STEAM | STEAM |
| , °C. | 245 | 245 | 245 | 245 | 245 | 245 | 245 | 245 | 245 | 245 |

TABLE 2A-continued

| | | | | | | | | | | |
|---|---|---|---|---|---|---|---|---|---|---|
| , LBS/IN | 60 | 80 | 100 | 120 | 140 | 160 | OFF | 40 | 60 | 80 |
| , KG/CM$^2$ | 4.2 | 5.6 | 7.0 | 8.4 | 9.8 | 11.2 | OFF | 3 | 4 | 6 |
| YARN DENIER | 35 | 35 | 35 | 35 | 35 | 35 | 35 | 35 | 35 | 35 |
| FILS/YARN | 27 | 27 | 27 | 27 | 27 | 27 | 27 | 27 | 27 | 27 |
| DPF | 1.3 | 1.3 | 1.3 | 1.3 | 1.3 | 1.3 | 1.3 | 1.3 | 1.3 | 1.3 |
| S, % | 10.5 | 12.0 | 12.0 | 14.0 | 13.0 | 11.0 | 3.8 | 5.5 | 6.5 | 7.0 |
| DHS, % | 15.9 | 9.2 | 9.1 | 10.9 | 12.2 | 11.1 | 3.8 | 5.1 | 6.4 | 8.2 |
| DHS-S, % | 4.4 | −2.8 | −2.9 | −3.1 | −0.8 | 0.1 | 0.0 | −0.4 | −0.1 | 1.2 |
| STmax, MG/D | 164 | 161 | 207 | 286 | 189 | 237 | 109 | 119 | 184 | 167 |
| T(STmax), C | 81 | 80 | 84 | 88 | 87 | 99 | 83 | 79 | 82 | 81 |
| NST, (G/D)/K | 0.46 | 0.46 | 0.58 | 0.79 | 0.53 | 0.83 | 0.31 | 0.34 | 0.52 | 0.47 |
| Ms, G/D | 1.56 | 1.34 | 1.73 | 2.04 | 1.45 | 2.15 | 2.87 | 2.16 | 2.83 | 2.39 |
| Ps, (G/D) % | 1.72 | 1.93 | 2.48 | 4.00 | 2.46 | 2.61 | 0.41 | 0.65 | 1.20 | 1.17 |

TABLE 2B

| ITEM NO. | 1 | 2 | 3C | 4 | 5C | 6 | 7 | 8 | 9 | 10 |
|---|---|---|---|---|---|---|---|---|---|---|
| V, YPM | 4900 | 4900 | 4900 | 4900 | 4500 | 4500 | 4500 | 4500 | 4500 | 4500 |
| V, MPM | 4481 | 4481 | 4481 | 4481 | 4115 | 4115 | 4115 | 4115 | 4115 | 4115 |
| ANNEAL TYPE | STEAM | STEAM | STEAM | STEAM | OFF | STEAM | STEAM | STEAM | STEAM | STEAM |
| , °C. | 245 | 245 | 245 | 245 | NA | 245 | 245 | 245 | 245 | 245 |
| , LBS/IN | 100 | 120 | 140 | 160 | NA | 40 | 60 | 80 | 100 | 120 |
| , KG/CM$^2$ | 10 | 11 | 9.8 | 11.2 | NA | 2.8 | 4.2 | 5.6 | 7.0 | 8.4 |
| YARN DENIER | 35 | 35 | 35 | 35 | 50 | 50 | 50 | 50 | 50 | 50 |
| FILS/YARN | 27 | 27 | 27 | 27 | 27 | 27 | 27 | 27 | 27 | 27 |
| DPF | 1.3 | 1.3 | 1.3 | 1.3 | 1.85 | 1.85 | 1.85 | 1.85 | 1.85 | 1.85 |
| S, % | 9.5 | 11.5 | 8.5 | 8.0 | — | — | 58.6 | 49.2 | — | — |
| DHS, % | 9.1 | 8.2 | 10.1 | 7.9 | 4.5 | 12.1 | 68.0 | 51.8 | 41.2 | 33.0 |
| DHS-S, % | −0.4 | −3.3 | 1.6 | −0.1 | — | — | 9.4 | 2.6 | — | — |
| STmax, MG/D | 202 | 156 | 140 | 217 | 90 | 130 | 160 | 220 | 220 | 130 |
| T(STmax), C | 86 | 85 | 91 | 94 | 80 | 86 | 73 | 76 | 76 | 77 |
| NST, (G/D)/K | 0.56 | 0.44 | 0.38 | 0.59 | 0.00 | 0.36 | 0.46 | 0.63 | 0.63 | 0.37 |
| Ms, G/D | 2.13 | 1.36 | 1.65 | 2.71 | 2.0 | 1.1 | 0.3 | 0.4 | 0.5 | 0.4 |
| Ps, (G/D) | 2.77 | 1.79 | 1.19 | 1.74 | (0.4) | (1.6) | 9.4 | 10.8 | (9.1) | (4.3) |

| ITEM NO. | 11 | 12C | 13 | 14 | 15 | 16 | 17 | 18 | 19C |
|---|---|---|---|---|---|---|---|---|---|
| V, YPM | 4500 | 4700 | 4700 | 4700 | 4700 | 4700 | 4700 | 4700 | 4700 |
| V, MPM | 4115 | 4298 | 4298 | 4298 | 4298 | 4298 | 4298 | 4298 | 4298 |
| ANNEAL TYPE | STEAM | STEAM | STEAM | STEAM | STEAM | STEAM | STEAM | STEAM | STEAM |
| , °C. | 245 | 245 | 245 | 245 | 245 | 245 | 245 | 245 | 245 |
| , LBS/IN | 140 | OFF | 40 | 60 | 80 | 100 | 120 | 140 | 160 |
| , KG/CM$^2$ | 9.8 | OFF | 2.8 | 4.2 | 5.6 | 7.0 | 8.4 | 9.8 | 11.2 |
| YARN DENIER | 50 | 50 | 50 | 50 | 50 | 50 | 50 | 50 | 50 |
| FILS/YARN | 27 | 27 | 27 | 27 | 27 | 27 | 27 | 27 | 27 |
| DPF | 1.85 | 1.85 | 1.85 | 1.85 | 1.85 | 1.85 | 1.85 | 1.85 | 1.85 |
| S, % | 30.0 | 3.3 | 8.4 | 9.9 | 14.6 | 27.9 | 36.9 | 17.0 | 13.4 |
| DHS, % | 19.4 | 3.9 | 9.9 | 9.4 | 12.8 | 22.6 | 23.1 | 14.3 | 12.8 |
| DHS-S, % | 10.6 | 0.6 | 1.5 | −0.4 | −1.8 | −5.3 | −13.8 | −3.7 | −0.6 |
| STmax, MG/D | 160 | 100 | 160 | 210 | 210 | 230 | 210 | 160 | 100 |
| T(STmax), C | 82 | 86 | 75 | 76 | 78 | 81 | 86 | 94 | 98 |
| NST, (G/D)/K | 0.45 | 0.28 | 0.46 | 0.60 | 0.60 | 0.65 | 0.58 | 0.44 | 0.27 |
| Ms, G/D | 0.5 | 3.0 | 1.9 | 2.1 | 1.4 | 0.9 | 0.6 | 0.9 | 0.0 |
| Ps, (G/D) | 3.1 | 0.3 | 1.3 | 2.1 | 1.8 | 6.4 | 7.7 | 2.7 | 1.3 |

TABLE 2C

| ITEM NO. | 1C | 2 | 3 | 4 | 5 | 6 | 7 | 8 | 9C | 10C | 11C |
|---|---|---|---|---|---|---|---|---|---|---|---|
| V, YPM | 4900 | 4900 | 4900 | 4900 | 4900 | 4900 | 4900 | 4900 | 5100 | 5100 | 5100 |
| V, MPM | 4481 | 4481 | 4481 | 4481 | 4481 | 4481 | 4481 | 4491 | 4663 | 4663 | 4663 |
| ANNEAL TYPE | STEAM | STEAM | OFF | STEAM | STEAM | STEAM | STEAM | STEAM | STEAM | STEAM | OFF |
| , °C. | 245 | 245 | 245 | 245 | 245 | 245 | 245 | 245 | NA | 245 | 245 |
| , LBS/IN | OFF | 40 | 60 | 80 | 100 | 120 | 140 | 160 | NA | 40 | 80 |
| , KG/CM$^2$ | OFF | 3 | 4 | 6 | 10 | 11.2 | 8.4 | 9.8 | NA | 3.0 | 5.60 |
| YARN DENIER | 50 | 50 | 50 | 50 | 50 | 50 | 50 | 50 | 50 | 50 | 50 |
| FILS/YARN | 27 | 27 | 27 | 27 | 27 | 27 | 27 | 27 | 27 | 27 | 27 |
| DPF | 1.85 | 1.85 | 1.85 | 1.85 | 1.85 | 1.85 | 1.85 | 1.85 | 1.85 | 1.85 | 1.85 |
| S, % | 4.0 | 12.5 | 60.0 | 9.5 | 13.4 | 15.2 | 15.6 | 15.3 | 3.0 | 5.3 | 7.0 |
| DHS, % | 4.0 | 5.4 | 66.0 | 8.0 | 13.1 | 14.8 | 14.8 | 12.2 | 4.3 | 5.1 | 8.2 |
| DHS-S, % | 0.0 | −7.1 | 6.0 | −1.5 | −0.3 | −0.4 | −0.8 | −3.1 | 1.3 | −0.2 | 1.2 |
| STmax, MG/D | 130 | 180 | 180 | 210 | 210 | 230 | 250 | 220 | 130 | 170 | 190 |
| T(STmax), C | 85 | 79 | 78 | 80 | 82 | 87 | 89 | 95 | 87 | 81 | 78 |
| NST, (G/D)/K | 0.36 | 0.51 | 0.51 | 0.59 | 0.59 | 0.64 | 0.69 | 0.60 | 0.36 | 0.48 | 0.54 |
| Ms, G/D | 3.3 | 1.4 | 0.3 | 2.2 | 1.6 | 1.5 | 1.6 | 1.4 | 4.3 | 1.1 | 2.71 |
| Ps, (G/D) | 0.5 | 2.3 | 10.8 | 2.0 | 2.8 | 3.5 | 3.9 | 3.4 | 0.4 | 0.9 | 1.3 |

| ITEM NO. | 12 | 13 | 14 | 15 | 16C | 17C | 18C | 19 | 20 | 21 |
|---|---|---|---|---|---|---|---|---|---|---|
| V, YPM | 5100 | 5100 | 5100 | 5100 | 5300 | 5300 | 5300 | 5300 | 5300 | 5300 |
| V, MPM | 4663 | 4663 | 4663 | 4663 | 4846 | 4846 | 4846 | 4846 | 5836 | 4846 |
| ANNEAL TYPE | STEAM | STEAM | STEAM | STEAM | STEAM | STEAM | STEAM | STEAM | STEAM | STEAM |

TABLE 2C-continued

| | | | | | | | | | | |
|---|---|---|---|---|---|---|---|---|---|---|
| , °C. | 245 | 245 | 245 | 245 | OFF | 245 | 245 | 245 | 245 | 245 |
| , LBS/IN | 100 | 120 | 140 | 160 | OFF | 40 | 60 | 80 | 100 | 120 |
| , KG/CM$^2$ | 7.00 | 8.4 | 9.8 | 11.2 | OFF | 2.8 | 4.2 | 5.6 | 7.0 | 8.4 |
| YARN DENIER | 50 | 50 | 50 | 50 | 50 | 50 | 50 | 50 | 50 | 50 |
| FILS/YARN | 27 | 27 | 27 | 27 | 27 | 27 | 27 | 27 | 27 | 27 |
| DPF | 1.85 | 1.85 | 1.85 | 1.85 | 1.85 | 1.85 | 1.85 | 1.85 | 1.85 | 1.85 |
| S, % | 10.8 | 11.3 | 10.9 | 10.6 | 3.4 | 5.0 | 5.7 | 7.0 | 7.3 | 11.3 |
| DHS, % | 10.2 | 10.4 | 10.2 | 10.2 | 3.9 | 4.9 | 6.0 | 6.5 | 8.5 | 9.4 |
| DHS-S, % | −0.8 | −0.7 | −0.7 | −0.4 | −0.5 | −0.1 | 0.3 | 1.5 | 1.2 | 1.9 |
| STmax, MG/D | 270 | 190 | 240 | 260 | 150 | 210 | 250 | 210 | 300 | 290 |
| T(STmax), C | 84 | 86 | 89 | 94 | 84 | 80 | 80 | 81 | 82 | 96 |
| NST, (G/D)/K | 0.76 | 0.75 | 0.66 | 0.71 | 0.42 | 0.59 | 0.71 | 0.59 | 0.85 | 0.81 |
| Ms, G/D | 2.5 | 1.7 | 2.2 | 2.5 | 4.4 | 4.2 | 4.4 | 3.0 | 4.1 | 8.8 |
| Ps, (G/D) | 2.9 | 2.1 | 2.6 | 2.8 | 0.5 | 1.1 | 1.4 | 1.5 | 2.2 | 3.3 |

TABLE 2D

| | 1 | 2 | 3 | 4 | 5C | 6 | 7C | 8 | 9 | 10 | 11 |
|---|---|---|---|---|---|---|---|---|---|---|---|
| ITEM NO. | 5300 | 5300 | 4500 | 4500 | 4500 | 4500 | 4500 | 4500 | 4500 | 4500 | 4700 |
| V, YPM | 4846 | 4846 | 4115 | 4115 | 4115 | 4115 | 4115 | 4115 | 4115 | 4155 | 4298 |
| V, MPM | STEAM | STEAM | OFF | STEAM | STEAM | STEAM | STEAM | STEAM | STEAM | STEAM | OFF |
| ANNEAL | 245 | 245 | NA | 245 | 245 | 245 | 245 | 245 | 245 | 245 | NA |
| , °C. | 140 | 160 | NA | 40 | 60 | 80 | 100 | 120 | 140 | 160 | NA |
| , LBS/IN$^2$ | 9.8 | 11 | NA | 2.8 | 4.2 | 56.0 | 7.0 | 8.4 | 9.8 | 11.2 | NA |
| , KG/CM$^2$ | 50 | 50 | 70 | 70 | 70 | 70 | 70 | 70 | 70 | 70 | 70 |
| DENIER | 27 | 27 | 27 | 27 | 27 | 27 | 27 | 27 | 27 | 27 | 27 |
| NO. FILS | 1.85 | 1.85 | 2.59 | 2.59 | 2.59 | 2.59 | 2.59 | 2.59 | 2.59 | 2.59 | 2.59 |
| DPF | 10.7 | 12.0 | 5.5 | 11.5 | 16.5 | 53.0 | 56.5 | 37.0 | 24.5 | 16.5 | 4.0 |
| S, % | 11.2 | 10.7 | 4.8 | 7.8 | 12.2 | 37.5 | 54.0 | 23.7 | 13.9 | 13.1 | 4.8 |
| DHS, % | 0.5 | −1.3 | −0.7 | −4.7 | −4.3 | −15.5 | −1.5 | −13.3 | −10.6 | −2.4 | −0.8 |
| DHS-S, % | 290 | 280 | 80 | 100 | 140 | 130 | 150 | 130 | 110 | 110 | 90 |
| STmax, MG/D | 88 | 93 | 82 | 79 | 73 | 72 | 73 | 84 | 85 | 91 | 83 |
| T(STmax), C | 0.80 | 0.77 | 0.23 | 0.28 | 0.40 | 0.38 | 0.43 | 0.36 | 0.31 | 0.30 | 0.25 |
| NST, (G/D)/K | 27.1 | 23.3 | 1.5 | 0.9 | 0.8 | 0.3 | 0.3 | 0.4 | 0.4 | 0.7 | 2.3 |
| Ms, G/D | 3.2 | 3.4 | 0.4 | 1.2 | 2.3 | 4.9 | 1.7 | 4.8 | 2.7 | 1.8 | 0.4 |
| Ps, (G/D) | 4.32 | 5.25 | 3.64 | 2.86 | 0.32 | 1.50 | 0.80 | 2.47 | 2.21 | 3.04 | 1.92 |

| | 12 | 13C | 14C | 15 | 16 | 17 | 18 | 19C | 20 | 21C |
|---|---|---|---|---|---|---|---|---|---|---|
| ITEM NO. | 4700 | 4700 | 4700 | 4700 | 4700 | 4700 | 4700 | 4900 | 4900 | 4900 |
| V, YPM | 4298 | 4298 | 4298 | 4298 | 4298 | 4298 | 4298 | 4481 | 4481 | 4481 |
| V, MPM | STEAM | STEAM | STEAM | STEAM | STEAM | STEAM | STEAM | STEAM | STEAM | STEAM |
| ANNEAL | 245 | 245 | 245 | 245 | 245 | 245 | 245 | 245 | 245 | 245 |
| , °C. | 40 | 60 | 80 | 100 | 120 | 140 | 160 | OFF | 40 | 60 |
| , LBS/IN$^2$ | 2.8 | 4.2 | 5.6 | 7.0 | 8.4 | 9.8 | 11.2 | OFF | 2.8 | 4.2 |
| , KG/CM$^2$ | 70 | 70 | 70 | 70 | 70 | 70 | 70 | 70 | 70 | 70 |
| DENIER | 27 | 27 | 27 | 27 | 27 | 27 | 27 | 27 | 27 | 27 |
| NO. FILS | 2.59 | 2.59 | 2.59 | 2.59 | 2.59 | 2.59 | 2.59 | 2.59 | 2.59 | 2.59 |
| DPF | 7.5 | 8.0 | 16.5 | 27.0 | 35.0 | 26.0 | 22.0 | 3.5 | 11.5 | 5.0 |
| S, % | 6.3 | 8.5 | 12.5 | 21.2 | 21.0 | 15.4 | 14.5 | 4.3 | 6.1 | 8.4 |
| DHS, % | −0.8 | −0.5 | −4.0 | −5.8 | −14.0 | −10.6 | −7.5 | 0.8 | −5.40 | 3.40 |
| DHS-S, % | 140 | 150 | 180 | 160 | 150 | 140 | 130 | 90 | 130 | 160 |
| STmax, MG/D | 76 | 76 | 76 | 77 | 76 | 77 | 85 | 90 | 77 | 78 |
| T(STmax), C | 0.40 | 0.43 | 0.52 | 0.46 | 0.43 | 0.40 | 0.36 | 0.25 | 0.37 | 0.46 |
| NST, (G/D)/K | 1.87 | 1.98 | 1.09 | 0.59 | 0.43 | 0.54 | 5.91 | 2.57 | 1.13 | 3.20 |
| Ms, G/D | 1.1 | 1.2 | 3.0 | 4.32 | 5.25 | 3.64 | 2.86 | 0.32 | 1.50 | 0.80 |
| Ps, (G/D) | 2.08 | 0.41 | 0.70 | 4.32 | 5.25 | 3.64 | 2.86 | 0.32 | 1.50 | 0.80 |

TABLE 2E

| ITEM NO. | 1 | 2 | 3 | 4 | 5 | 6C | 7C | 8C | 9 | 10C |
|---|---|---|---|---|---|---|---|---|---|---|
| V, YPM | 4900 | 4900 | 4900 | 4900 | 4900 | 5100 | 5100 | 5100 | 5100 | 5100 |
| V, MPM | 4481 | 4481 | 4481 | 4481 | 4481 | 4663 | 4663 | 4663 | 4663 | 4663 |
| ANNEAL | STEAM | STEAM | STEAM | STEAM | STEAM | STEAM | STEAM | STEAM | STEAM | STEAM |
| , °C. | 245 | 245 | 245 | 245 | 245 | 245 | 245 | 245 | 245 | 245 |
| , LBS/IN$^2$ | 80 | 100 | 120 | 140 | 160 | OFF | 40 | 60 | 80 | 100 |
| , KG/CM$^2$ | 5.6 | 7.0 | 8.4 | 9.8 | 11.2 | OFF | 2.8 | 4.2 | 5.6 | 7.0 |
| DENIER | 70 | 70 | 70 | 70 | 70 | 70 | 70 | 70 | 70 | 70 |
| NO. FILS | 27 | 27 | 27 | 27 | 27 | 27 | 27 | 27 | 27 | 27 |
| DPF | 2.59 | 2.59 | 2.59 | 2.59 | 2.59 | 2.59 | 2.59 | 2.59 | 2.59 | 2.59 |
| S, % | 14.5 | 13.0 | 19.0 | 12.0 | 16.0 | 3.7 | 5.0 | 5.0 | 6.5 | 6.5 |
| DHS, % | 14.6 | 10.9 | 14.2 | 11.6 | 10.2 | 4.8 | 9.6 | 5.1 | 10.8 | 7.6 |
| DHS-S, % | 0.10 | −2.10 | −4.80 | −0.40 | −5.80 | 1.10 | 4.60 | 0.10 | 4.70 | 1.10 |
| STmax, MG/D | 170 | 170 | 160 | 160 | 130 | 110 | 140 | 150 | 150 | 160 |
| T(STmax), C | 79 | 80 | 86 | 85 | 97 | 88 | 81 | 78 | 81 | 83 |
| NST, (G/D)/K | 8.48 | 0.48 | 0.45 | 0.45 | 0.35 | 0.30 | 0.40 | 0.43 | 0.42 | 0.45 |
| Ms, G/D | 1.17 | 1.31 | 0.84 | 1.33 | 8.13 | 2.97 | 2.80 | 3.00 | 2.31 | 2.46 |
| Ps, (G/D) | 2.47 | 2.21 | 3.04 | 1.92 | 2.08 | 0.41 | 0.70 | 0.75 | 0.98 | 1.0 |

| ITEM NO. | 11 | 12 | 13 | 14C | 15C | 16C | 17C | 18C | 19C | 20C | 21C |
|---|---|---|---|---|---|---|---|---|---|---|---|

TABLE 2E-continued

| | | | | | | | | | | | |
|---|---|---|---|---|---|---|---|---|---|---|---|
| V, YPM | 5100 | 5300 | 5300 | 5300 | 5300 | 5300 | 5300 | 5300 | 5300 | 5300 | 5300 |
| V, MPM | 4663 | 4846 | 4846 | 4846 | 4846 | 4846 | 4846 | 4846 | 4846 | 4846 | 4846 |
| ANNEAL | STEAM | STEAM | STEAM | OFF | STEAM | STEAM | STEAM | STEAM | STEAM | STEAM | STEAM |
| , °C. | 245 | 245 | 245 | NA | 245 | 245 | 245 | 245 | 245 | 245 | 245 |
| , LBS/IN$^2$ | 120 | 140 | 160 | NA | 40 | 60 | 80 | 100 | 120 | 140 | 160 |
| , KG/CM$^2$ | 8.4 | 9.8 | 11.2 | NA | 2.8 | 4.2 | 5.6 | 7.0 | 8.4 | 9.8 | 11.2 |
| DENIER | 70 | 70 | 70 | 70 | 70 | 70 | 70 | 70 | 70 | 70 | 70 |
| NO. FILS | 27 | 27 | 27 | 27 | 27 | 27 | 27 | 27 | 27 | 27 | 27 |
| DPF | 2.59 | 2.59 | 2.59 | 2.59 | 2.59 | 2.59 | 2.59 | 2.59 | 2.59 | 2.59 | 2.59 |
| S, % | 15.0 | 17.0 | 14.0 | 4.9 | 4.6 | 4.8 | 4.4 | 5.4 | 4.8 | 9.0 | 9.0 |
| DHS, % | 16.5 | 13.0 | 11.3 | 4.8 | 4.7 | 5.0 | 5.8 | 5.5 | 5.7 | 8.2 | 9.0 |
| DHS-S, % | 1.50 | −4.00 | −2.70 | −0.1 | 0.1 | 0.2 | 1.4 | 0.1 | 0.9 | 0.8 | 0.0 |
| STmax, MG/D | 200 | 190 | 160 | 100 | 90 | 100 | 90 | 120 | 120 | 130 | 130 |
| T(STmax), C | 84 | 85 | 92 | 89 | 86 | 85 | 84 | 85 | 83 | 88 | 86 |
| NST, (G/D)/K | 0.56 | 0.53 | 0.44 | 0.28 | 0.25 | 0.28 | 0.25 | 0.34 | 0.34 | 0.36 | 0.36 |
| Ms, G/D | 1.33 | 1.12 | 1.14 | 2.04 | 1.96 | 2.08 | 2.05 | 2.22 | 2.50 | 1.44 | 1.44 |
| Ps, (G/D) | 3.0 | 3.23 | 2,24 | 0.49 | 0.41 | 0.48 | 0.40 | 0.65 | 0.58 | 1.17 | 1.17 |

TABLE 3A

| ITEM NO. | 1C | 2 | 3C | 4 | 5 | 6 | 7C |
|---|---|---|---|---|---|---|---|
| V, MPM | 3600 | 2600 | 4100 | 4100 | 4100 | 4100 | 4600 |
| ANNEAL | NA | STEAM | NA | STEAM | STEAM | STEAM | NA |
| , °C. | NA | 250 | NA | 245 | 245 | 245 | NA |
| , LBS/N$^2$ | NA | 80 | NA | 40 | 60 | 80 | NA |
| , KG/CM$^2$ | NA | 5.6 | NA | 2.8 | 4.2 | 5.6 | NA |
| DENIER | 73.0 | 72.6 | 68.8 | 70.5 | 70.3 | 69.3 | 70.0 |
| NO. FILS | 34 | 34 | 34 | 34 | 34 | 34 | 34 |
| DPF | 2.15 | 2.14 | 2.02 | 2.07 | 2.07 | 69.33 | 2.06 |
| EB, % | 95.0 | 51.0 | 88.0 | 68.0 | 68.0 | 60.0 | 85.0 |
| RDR | 1.95 | 1.51 | 1.88 | 1.68 | 1.68 | 1.60 | 1.85 |
| TEN., G/D | 2.90 | 2.90 | 3.10 | 3.20 | 3.30 | 3.40 | 3.30 |
| TBK, G/DD | 5.66 | 4.38 | 5.83 | 5.38 | 5.54 | 5.44 | 6.11 |
| S, % | 40.0 | 48.0 | 7.0 | 70.0 | 71.0 | 67.0 | 7.0 |
| DHS, % | 32.0 | 31.0 | 5.1 | 67.0 | 67.0 | 69.0 | 5.0 |
| DHS-S, % | −8.0 | −17.0 | −1.9 | −3.0 | −4.0 | 2.0 | −2.0 |
| STmax, MG/D | 80 | 122 | 87 | 127 | 141 | 143 | 101 |
| T(STmax), C | 73 | 81 | 83 | 69 | 70 | 73 | 73 |
| NST (G/D)/K | 0.23 | 0.34 | 0.24 | 0.37 | 0.41 | 0.41 | 0.29 |
| Ms, G/D | 0.20 | 0.25 | 1.24 | 0.18 | 0.20 | 0.21 | 1.44 |
| Ps, G/D | 3.20 | 5.86 | 0.61 | 8.89 | 10.01 | 9.58 | 0.71 |
| DEN., G/CC | 1.3486 | 1.3560 | 1.3583 | 1.3476 | 1.3484 | 1.3499 | 1.3560 |
| BIREF., ×1000 | 547 | 1030 | — | — | — | — | — |

| ITEM NO. | 8 | 9 | 10 | 11C | 12C | 13C | 14C |
|---|---|---|---|---|---|---|---|
| V, MPM | 4600 | 4600 | 4600 | 5000 | 5000 | 5000 | 5000 |
| ANNEAL | STEAM | STEAM | STEAM | NA | STEAM | STEAM | STEAM |
| , °C. | 245 | 245 | 245 | NA | 245 | 245 | 245 |
| , LBS/N$^2$ | 40 | 60 | 80 | NA | 40 | 60 | 80 |
| , KG/CM$^2$ | 2.8 | 4.2 | 5.6 | NA | 2.8 | 4.2 | 5.6 |
| DENIER | 70.0 | 70.1 | 69.7 | 69.9 | 70.5 | 69.9 | 70.3 |
| NO. FILS | 34 | 34 | 34 | 34 | 34 | 34 | 34 |
| DPF | 2.06 | 2.06 | 2.05 | 2.06 | 2.07 | 2.06 | 2.07 |
| EB, % | 63.0 | 60.0 | 53.0 | 66.0 | 66.0 | 65.0 | 62.0 |
| RDR | 1.63 | 1.60 | 1.53 | 1.66 | 1.66 | 1.65 | 1.62 |
| TEN., G/D | 3.60 | 3.70 | 3.60 | 3.80 | 3.60 | 3.70 | 3.60 |
| TBK, G/DD | 5.87 | 5.92 | 5.51 | 6.31 | 5.98 | 6.11 | 5.83 |
| S, % | 53.0 | 60.0 | 64.0 | 5.0 | 8.2 | 8.9 | 12.6 |
| DHS, % | 50.0 | 46.0 | 45.0 | 5.0 | 7.9 | 8.4 | 11.5 |
| DHS-S, % | −3.0 | −14.0 | −19.0 | 0.0 | −0.3 | −0.5 | −1.1 |
| STmax, MG/D | 185 | 161 | 168 | 101 | 210 | 240 | 2511 |
| T(STmax), C | 72 | 74 | 75 | 91 | 80 | 81 | 81 |
| NST (G/D)/K | 0.54 | 0.46 | 0.48 | 0.28 | 0.59 | 0.68 | 0.71 |
| Ms, G/D | 0.35 | 0.27 | 0.26 | 2.02 | 2.56 | 2.70 | 1.99 |
| Ps, G/D | 9.81 | 9.66 | 10.75 | 0.51 | 1.72 | 2.14 | 3.16 |
| DEN., G/CC | 1.3510 | 1.3496 | 1.3520 | 1.3817 | 1.3676 | 1.3678 | 1.3601 |
| BIREF., ×1000 | — | — | — | — | — | — | — |

TABLE 3B

| ITEM NO. | 1C | 2C | 3 | 4 | 5C | 6C | 7C | 8C | 9C | 10C |
|---|---|---|---|---|---|---|---|---|---|---|
| SPIN (YPM) | 4500 | 4500 | 4500 | 4500 | 5000 | 5000 | 5000 | 5000 | 5500 | 6000 |
| SPIN (MPM) | 4115 | 4115 | 4115 | 4115 | 4572 | 4572 | 4572 | 4572 | 5029 | 5486 |
| ANNEAL | NA | STEAM | STEAM | STEAM | NA | STEAM | STEAM | STEAM | NA | NA |
| , TEMP. | NA | 245 | 245 | 245 | NA | 245 | 245 | 245 | NA | NA |
| , PSI | NA | 40 | 60 | 80 | NA | 40 | 60 | 80 | NA | NA |
| , KG/CM | NA | 2.8 | 4.2 | 5.6 | NA | 2.8 | 4.2 | 5.6 | NA | NA |
| YARN DEITIER | 74.0 | 75.9 | 73.2 | 74.6 | 74.5 | 75.3 | 73.5 | 72.2 | 73.3 | 76.2 |
| # FILS | 34 | 34 | 34 | 34 | 34 | 34 | 34 | 34 | 34 | 34 |

TABLE 3B-continued

| ITEM NO. | 1C | 2C | 3 | 4 | 5C | 6C | 7C | 8C | 9C | 10C |
|---|---|---|---|---|---|---|---|---|---|---|
| DPF | 2.18 | 2.23 | 2.15 | 2.19 | 2.19 | 2.21 | 2.16 | 2.12 | 2.16 | 2.24 |
| MOD., G/D | 34.4 | 32.7 | 35.9 | 38.0 | 41.4 | 37.4 | 38.3 | 41.1 | 48.5 | 47.0 |
| T7%, G/D | 0.76 | 0.75 | 0.94 | 0.95 | 0.95 | 0.85 | 0.89 | 0.97 | 1.16 | 1.15 |
| EB, % | 79.3 | 79.3 | 63.2 | 64.5 | 70.2 | 75.7 | 73.3 | 72.5 | 62.1 | 63.6 |
| RDR | 1.793 | 1.793 | 1.632 | 1.645 | 1.702 | 1.757 | 1.733 | 1.725 | 1.621 | 1.636 |
| TEN., G/D | 3.09 | 3.07 | 2.99 | 3.11 | 3.44 | 3.25 | 3.29 | 3,45 | 3.67 | 3.70 |
| TBK, G/DD | 5.54 | 5.50 | 4.88 | 5.12 | 5.85 | 5.71 | 5.70 | 5.95 | 5.95 | 6.06 |
| S, % | 7.0 | 8.5 | 68.7 | 62.7 | 3.9 | 5.7 | 6.3 | 5.8 | 3.7 | 3.4 |
| DHS, % | 5.2 | 6.1 | 63.9 | 67.0 | 4.3 | 4.9 | 5.1 | 5.4 | 4.2 | 4.0 |
| DHS-S, % | −1.8 | −2.4 | −4.8 | 4.3 | 0.4 | −0.8 | −1.2 | −0.4 | 0.5 | 0.6 |
| STmax, G/D | 71 | 101 | 147 | 132 | 92 | 89 | 96 | 125 | 107 | 101 |
| T(STmax), C | 82 | 72 | 64 | 66 | 83 | 79 | 78 | 79 | 91 | 94 |
| NST, (G/D)/ | 0.20 | 0.29 | 0.44 | 0.39 | 0.26 | 0.25 | 0.27 | 0.36 | 0.25 | 0.28 |
| Ms, G/D | 1.0 | 1.2 | 0.2 | 0.2 | 2.4 | 1.6 | 1.5 | 2.2 | 2.9 | 3.0 |
| Ps, G/D | 0.50 | 0.86 | 10.10 | 8.28 | 0.36 | 0.51 | 0.60 | 0.73 | 0.40 | 0.38 |
| DEN., G/CC | 1.3618 | 1.3596 | 1.3480 | 1. 3493 | 1.3716 | 1.3645 | 1.3651 | 1.3711 | 1.3783 | 1.4022 |

TABLE 4

| ITEM NO. | 1 | 2 | 3C | 4C | 5C | 6C | 7C | 8 | 9 |
|---|---|---|---|---|---|---|---|---|---|
| V, MPM | 4100 | 4100 | 4600 | 4600 | 4100 | 4100 | 4100 | 4100 | 4100 |
| ANNEAL | NA | STEAM | NA | STEAM | NA | STEAM | STEAM | STEAM | STEAM |
| , °C. | NA | 250 | NA | 250 | NA | 130 | 180 | 205 | 245 |
| , LBS/IN$^2$ | NA | 80 | NA | 80 | NA | 15 | 15 | 15 | 15 |
| , KG/CM$^2$ | NA | 5.6 | NA | 5.6 | NA | 1.1 | 1.1 | 1.1 | 1.1 |
| DENIER | 71.2 | 71.2 | 71.0 | 70.8 | 70.6 | 70.1 | 70.0 | 69.5 | 70.4 |
| NO. FILS | 34 | 34 | 34 | 34 | 34 | 34 | 34 | 34 | 34 |
| DPF | 2.09 | 2.09 | 2.09 | 2.08 | 2.08 | 2.06 | 2.06 | 2.04 | 2.07 |
| EB, % | 58.0 | 49.0 | 61.0 | 42.0 | 79.0 | 73.0 | 76.0 | 73.0 | 70.0 |
| RDR | 1.58 | 1.49 | 1.61 | 1.42 | 1.79 | 1.73 | 1.76 | 1.73 | 1.70 |
| TEN., G/D | 3.00 | 3.40 | 2.80 | 3.40 | 3.10 | 3.10 | 3.10 | 3.10 | 3.10 |
| TBK, G/DD | 4.74 | 5.07 | 4.51 | 4.83 | 5.55 | 5.36 | 5.46 | 5.36 | 5.27 |
| S, % | 25.0 | 51.0 | 12.0 | 48.0 | 24.0 | 53.0 | 58.0 | 61.0 | 63.0 |
| DHS, % | 20.0 | 33.0 | 8.6 | 29.0 | 16.0 | 50.0 | 54.0 | 63.0 | 63.0 |
| DHS-S, % | −5.0 | −18.0 | −3.4 | −19.0 | −8.0 | −3.0 | −4.0 | 2.0 | 0.0 |
| STmax, MG/D | 99 | 146 | 116 | 173 | 86 | 111 | 104 | 121 | 120 |
| T(STmax), C | 76 | 85 | 76 | 90 | 78 | 70 | 70 | 69 | 69 |
| NST (G/D)/K | 0.28 | 0.41 | 0.33 | 0,48 | 0.25 | 0.32 | 0.30 | 0.35 | 0.35 |
| Ms, G/D | 0.40 | 0.29 | 0.97 | 0.36 | 0.36 | 0.21 | 0.18 | 0.20 | 0.19 |
| Ps, G/D | 2.48 | 7.45 | 1.39 | 8.30 | 2.06 | 5.88 | 6.03 | 7.38 | 7.56 |
| DEN., G/CC | 1.3563 | 1.3574 | 1.3551 | 1.3571 | 1.3512 | 1.3472 | 1.3472 | 1.3475 | 1.3491 |
| BIREF., ×1000 | 638 | 1079 | 747 | 1184 | — | — | — | — | — |

| ITEM NO. | 10 | 11C | 12C | 13C | 14 | 15 | 16C | 17C |
|---|---|---|---|---|---|---|---|---|
| V, Mpm | 5000 | 5000 | 5000 | 5000 | 5000 | 4100 | 4600 | 5000 |
| ANNEAL | NA | STEAM | STEAM | STEAM | STEAM | STEAM | STEAM | STEAM |
| , °C. | NA | 245 | 245 | 245 | 245 | 247 | 247 | 247 |
| , LBS/IN$^2$ | NA | 15 | 20 | 25 | 30 | 20 | 20 | 20 |
| , KG/CM$^2$ | NA | 1.1 | 2.8 | 1.8 | 2.1 | 1.4 | 1.4 | 1.4 |
| DENIER | 69.9 | 71.7 | 71.8 | 71.8 | 71.8 | 40.1 | 40.1 | 39.9 |
| NO. FILS | 34 | 34 | 34 | 34 | 34 | 17 | 17 | 17 |
| DPF | 2.06 | 2.11 | 2.11 | 2.11 | 2.11 | 2.36 | 2.36 | 2.35 |
| EB, % | 66.0 | 66.0 | 66.0 | 66.0 | 64.0 | 68.0 | 69.0 | 67.0 |
| RDR | 1.66 | 1.66 | 1.66 | 1.66 | 1.64 | 1.68 | 1.69 | 1.67 |
| TEN., G/D | 3.80 | 3.70 | 3.70 | 3.60 | 3.60 | 3.20 | 3.40 | 3.60 |
| TBK, G/DD | 6.31 | 6.14 | 6.14 | 5.98 | 5.90 | 5.38 | 5.75 | 6.01 |
| S, % | 5.0 | 7.4 | 6.2 | 7.1 | 8.2 | 57.0 | 8.0 | 4.7 |
| DHS, % | 5.0 | 6.7 | 5.9 | 6.7 | 7.3 | 58.0 | 10.0 | 5.0 |
| DHS-S, % | 0.0 | −0.7 | −0.3 | −0.4 | −0.9 | 1.0 | 2.0 | 1.7 |
| STmax, MG/D | 101 | 181 | 178 | 178 | 203 | 144 | 180 | 163 |
| T(STmax), C | 73 | 79 | 80 | 79 | 79 | 68 | 77 | 83 |
| NST (G/D)/K | 0.29 | 0.51 | 0.50 | 0.51 | 0.58 | 0.42 | 0.51 | 0.46 |
| Ms, G/D | 2.02 | 2.45 | 2.87 | 2.51 | 2.48 | 0.25 | 2.25 | 3.47 |
| Ps, G/D | 0.51 | 1.34 | 1.10 | 1.26 | 1.66 | 8.21 | 1.44 | 0.77 |
| DEN., G/CC | — | 1.3670 | 1.3670 | 1.3653 | 1.3738 | 1.3481 | 1.3582 | 1.3738 |
| BIREF., ×1000 | — | — | — | — | — | — | — | — |

TABLE 5A

| ITEM NO. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| V, MPM | 3750 | 3750 | 3750 | 3750 | 3750 | 3750 | 3750 | 3750 | 4000 | 4000 | 4000 | 4000 | 4000 | 4000 | 4000 | 4000 |
| ANNEAL | AIR | AIR | AIR | AIR | AIR | AIR | AIR | AIR | AIR | AIR | AIR | AIR | AIR | AIR | AIR | AIR |
| ANNEAL, C | 120 | 150 | 120 | 135 | 150 | 180 | 120 | 150 | 120 | 150 | 120 | 135 | 150 | 180 | 120 | 150 |
| DENIER | 40 | 40 | 60 | 60 | 60 | 60 | 80 | 80 | 40 | 40 | 60 | 60 | 60 | 60 | 80 | 80 |
| DPF | 1.18 | 1.18 | 1.76 | 1.76 | 1.76 | 1.76 | 2.35 | 2.35 | 1.18 | 1.18 | 1.76 | 1.76 | 1.76 | 1.76 | 2.35 | 2.35 |
| MOD., G/D | 51.1 | 65.0 | 43.2 | 43.5 | 58.7 | 59.2 | 34.6 | 58.4 | 49.1 | 68.0 | 43.0 | 51.1 | 63.5 | 59.2 | 36.7 | 58.1 |
| T7%, G/D | 1.76 | 3.00 | 1.25 | 1.27 | 2.55 | 2.82 | 0.99 | 2.24 | 1.66 | 3.23 | 1.29 | 1.33 | 2.72 | 2.82 | 1.08 | 2.38 |
| EB, % | 43.5 | 32.9 | 59.3 | 59.8 | 36.3 | 33.4 | 72.6 | 41.9 | 41.5 | 28.3 | 57.4 | 60.8 | 35.5 | 33.4 | 67.2 | 42.2 |

TABLE 5A-continued

| ITEM NO. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| RDR | 1.435 | 1.329 | 1.593 | 1.598 | 1.363 | 1.334 | 1.726 | 1.419 | 1.415 | 1.283 | 1.574 | 1.608 | 1.355 | 1.334 | 1.672 | 1.422 |
| TEN., G/D | 3.54 | 4.57 | 3.39 | 3.41 | 4.27 | 4.55 | 3.24 | 4.23 | 3.29 | 4.62 | 3.47 | 3.74 | 4.46 | 4.55 | 3.37 | 4.46 |
| TBK, G/DD | 5.08 | 6.07 | 5.40 | 5.45 | 5.82 | 6.07 | 5.59 | 6.00 | 4.66 | 5.93 | 5.46 | 6.01 | 6.04 | 6.07 | 5.63 | 6.34 |
| S, % | 51.9 | 8.2 | 52.0 | 48.1 | 8.7 | 5.5 | 49.3 | 10.3 | 44.7 | 8.2 | 47.4 | 51.1 | 9.2 | 5.5 | 48.9 | 10.8 |
| DHS, % | 60.7 | 9.5 | 72.4 | 73.6 | 9.8 | 7.7 | 68.1 | 10.6 | 57.7 | 9.9 | 62.1 | 66.9 | 10.0 | 7.7 | 58.3 | 11.0 |
| DHS-S, % | 8.8 | 1.3 | 20.4 | 25.5 | 0.9 | 2.2 | 36.8 | 0.3 | 13.0 | 1.7 | 14.7 | 15.8 | 0.8 | 2.2 | 9.6 | 0.2 |
| STmax, MG/D | 200 | 390 | 130 | 140 | 290 | 340 | 110 | 240 | 210 | 340 | 160 | 150 | 330 | 340 | 130 | 200 |
| T(STmax), C | 77 | 150 | 72 | 73 | 141 | 170 | 73 | 133 | 72 | 160 | 73 | 72 | 147 | 170 | 73 | 133 |
| NST, (G/D)/K | 0.57 | 0.92 | 0.38 | 0.40 | 0.70 | 0.77 | 0.32 | 0.59 | 0.61 | 0.79 | 0.46 | 0.43 | 0.79 | 0.77 | 0.27 | 0.49 |
| Ms, G/D | 0.39 | 4.76 | 0.25 | 0.29 | 3.33 | 6.18 | 0.23 | 1.29 | 0.47 | 0.41 | 0.34 | 0.29 | 0.36 | 3.09 | 0.49 | 1.85 |
| Ps, G/D | 10.4 | 3.2 | 6.8 | 6.7 | 2.5 | 1.9 | 5.4 | 2.5 | 9.4 | 2.8 | 7.6 | 7.7 | 3.3 | 2.6 | 7.6 | 2.2 |

TABLE 5B

| ITEM NO. | 1 | 2 | 3 | 4 | 5C | 6 | 7 | 8 | 9 | 10 |
|---|---|---|---|---|---|---|---|---|---|---|
| V, MPH | 4500 | 4500 | 4500 | 4500 | 4500 | 4500 | 4500 | 4500 | 5000 | 5000 |
| ANNEAL | AIR | AIR | AIR | AIR | AIR | AIR | AIR | AIR | AIR | AIR |
| ANNEAL, C | 120 | 150 | 120 | 135 | 150 | 180 | 120 | 150 | 120 | 120 |
| YARN DENIER | 40 | 40 | 60 | 60 | 60 | 60 | 80 | 80 | 40 | 60 |
| DPF | 1.18 | 1.18 | 1.76 | 1.76 | 1.76 | 1.76 | 2.35 | 2.35 | 1.18 | 1.76 |
| MOD., G/D | 53.1 | 70.4 | 48.2 | 48.3 | 59.4 | 61.7 | 60.5 | 59.4 | 67.0 | 53.3 |
| T7%, G/D | 1.90 | 3.60 | 1.50 | 1.59 | 2.95 | 3.12 | 2.63 | 2.95 | 2.29 | 1.76 |
| EB, % | 44.3 | 25.4 | 53.5 | 54.1 | 28.9 | 31.6 | 37.1 | 28.9 | 40.9 | 51.5 |
| RDR | 1.443 | 1.254 | 1.535 | 1.541 | 1.289 | 1.316 | 1.371 | 1.289 | 1.409 | 1.515 |
| TEN., G/D | 3.68 | 4.85 | 3.44 | 3.79 | 4.47 | 4.87 | 4.56 | 4.47 | 3.91 | 3.75 |
| TBK, G/DD | 5.31 | 6.08 | 5.28 | 5.84 | 5.76 | 6.41 | 6.25 | 5.76 | 5.51 | 5.68 |
| S, % | 23.6 | 8.6 | 23.9 | 28.7 | 10.0 | 6.1 | 11.4 | 10.0 | 13.5 | 10.6 |
| DHS, % | 24.7 | 9.6 | 22.8 | 28.6 | 10.6 | 7.4 | 11.8 | 10.6 | 11.5 | 9.2 |
| DHS-S, % | 1.1 | 1.0 | −1.1 | −0.1 | 0.6 | 1.3 | 0.4 | 0.6 | −2.0 | −1.4 |
| STmax, MG/D | 200 | 430 | 200 | 200 | 110 | 380 | 310 | 360 | 330 | 170 |
| T(STmax), °C. | 77 | 172 | 77 | 75 | 150 | 177 | 138 | 150 | 80 | 84 |
| NST, (G/D)/K | 0.57 | 0.97 | 0.57 | 0.57 | 0.38 | 0.84 | 0.75 | 0.85 | 0.93 | 0.48 |
| Ms, G/D | 0.8 | 5.0 | 0.8 | 0.7 | 1.1 | 6.2 | 2.7 | 3.6 | 2.4 | 1.6 |
| Ps, G/D | 4.7 | 3.7 | 4.6 | 5.7 | 1.1 | 2.3 | 3.5 | 3.6 | 4.5 | 1.8 |

| ITEM NO. | 11 | 12 | 13 | 14C | 15 | 16 | 17 | 18 | 19 |
|---|---|---|---|---|---|---|---|---|---|
| V, MPH | 5000 | 5000 | 5000 | 5000 | 5500 | 5500 | 5500 | 6000 | 6000 |
| ANNEAL | AIR | AIR | AIR | AIR | AIR | AIR | AIR | AIR | AIR |
| ANNEAL, C | 135 | 150 | 180 | 120 | 120 | 135 | 180 | 120 | 135 |
| YARN DENIER | 60 | 60 | 60 | 80 | 80 | 80 | 80 | 80 | 80 |
| DPF | 1.76 | 1.76 | 1.76 | 2.35 | 2.35 | 2.35 | 2.35 | 2.35 | 2.35 |
| MOD., G/D | 53.2 | 60.5 | 70.7 | 47.9 | 70.5 | 65.3 | 80.5 | 61.8 | 78.3 |
| T7%, G/D | 1.79 | 2.63 | 3.00 | 1.57 | 2.56 | 2.47 | 3.17 | 3.03 | 2.95 |
| EB, % | 54.1 | 37.1 | 33.3 | 53.8 | 31.0 | 34.3 | 28.4 | 23.8 | 24.6 |
| RDR | 1.541 | 1.371 | 1.333 | 1.538 | 1.310 | 1.343 | 1.284 | 1.238 | 1.246 |
| TEN., G/D | 3.79 | 4.56 | 4.75 | 3.64 | 3.79 | 3.96 | 4.44 | 3.90 | 3.95 |
| TBK, G/DD | 5.84 | 6.25 | 6.33 | 5.60 | 5.0 | 5.3 | 5.7 | 4.83 | 4.92 |
| S, % | 11.0 | 11.4 | 5.2 | 6.2 | 15.7 | 12.6 | 5.7 | 11.4 | 12.5 |
| DHS, % | 9.5 | 11.8 | 6.8 | 5.6 | 13.3 | 12.5 | 7.3 | 9.8 | 11.9 |
| DHS-S, % | −1.5 | 0.4 | 1.6 | −0.6 | −2.4 | −0.1 | 1.6 | −1.6 | −0.6 |
| STmax, MG/D | 230 | 310 | 440 | 160 | 460 | 310 | 540 | 410 | 380 |
| T(STmax), °C. | 83 | 138 | 177 | 85 | 80 | 81 | 153 | 84 | 80 |
| NST, (G/D)/K | 0.65 | 0.75 | 0.98 | 0.45 | 1.30 | 0.88 | 1.27 | 1.15 | 1.08 |
| Ms, G/D | 2.1 | 2.7 | 8.5 | 2.6 | 2.9 | 2.5 | 9.5 | 3.6 | 3.0 |
| Ps, G/D | 2.5 | 3.5 | 2.3 | 1.0 | 7.2 | 3.9 | 3.1 | 4.7 | 4.8 |

TABLE 6

| ITEM NO. | 1C | 2C | 3C | 4 | 5 | 6C | 7 | 8 | 9 | 10C | 11 |
|---|---|---|---|---|---|---|---|---|---|---|---|
| V, MPM | 3000 | 3000 | 3000 | 3500 | 3500 | 4000 | 4000 | 4000 | 4000 | 4550 | 4550 |
| ANNEAL | AIR | AIR | AIR | AIR | AIR | AIR | AIR | AIR | AIR | AIR | AIR |
| ANNEAL, C | OFF | 165 | 180 | OFF | 180 | OFF | 150 | 165 | 180 | OFF | 150 |
| DENIER | 62.2 | 63.0 | 62.4 | 62.7 | 62.9 | 62.0 | 61.6 | 60.0 | 62.6 | 62.4 | 62.2 |
| EB, % | 122.9 | 71.0 | 66.7 | 105.4 | 59.2 | 90.7 | 56.0 | 55.7 | 56.9 | 85.0 | 63.3 |
| RDR | 2.23 | 1.71 | 1.67 | 2.05 | 1.59 | 1.91 | 1.56 | 1.56 | 1.57 | 1.85 | 1.63 |
| TEN., G/D | 2.78 | 3.62 | 3.42 | 3.00 | 2.96 | 3.05 | 3.97 | 3.95 | 3.94 | 3.30 | 3.45 |
| TBK, G/DD | 6.20 | 3.74 | 5.70 | 6.15 | 4.71 | 5.83 | 6.19 | 6.15 | 6.18 | 6.11 | 5.63 |
| S, % | 38.3 | 6.4 | 8.6 | 22.4 | 8.4 | 7.5 | 31.5 | 15.1 | 9.3 | 5.3 | 22.0 |
| DHS, % | 40.4 | 6.8 | 8.1 | 18.2 | 8.1 | 6.3 | 32.8 | 13.8 | 9.0 | 5.0 | 22.2 |
| DHS-S, % | 1.9 | 0.4 | −0.5 | −4.2 | −0.3 | −1.2 | 0.7 | −1.3 | −0.3 | −0.3 | 0.2 |
| STmax, MG/D | 69 | 140 | 157 | 95 | 170 | 128 | 210 | 219 | 228 | 180 | 257 |
| T(STmax), C | 72 | 92 | 86 | 71 | 90 | 75 | 77 | 89 | 92 | 75 | 79 |
| NST, (G/D)/K | 0.20 | 0.38 | 0.44 | 0.28 | 0.47 | 0.37 | 0.60 | 0.60 | 0.62 | 0.52 | 0.73 |
| Ms, G/D | 2.64 | 2.19 | 1.83 | 0.42 | 2.02 | 1.71 | 0.67 | 1.45 | 2.45 | 3.40 | 1.17 |
| Ps, G/D | 0.18 | 0.90 | 1.35 | 2.13 | 1.43 | 0.96 | 6.62 | 3.31 | 2.12 | 0.95 | 5.65 |

| ITEM NO. | 12 | 13 | 14C | 15C | 16C | 17 | 18C | 19 | 20 | 21C | 22 |
|---|---|---|---|---|---|---|---|---|---|---|---|
| V, MPM | 4550 | 4550 | 5060 | 5060 | 5060 | 5060 | 5060 | 5060 | 5060 | 5610 | 5610 |

TABLE 6-continued

| ANNEAL | AIR | AIR | AIR | AIR | AIR | AIR | AIR | AIR | AIR | AIR | AIR |
|---|---|---|---|---|---|---|---|---|---|---|---|
| ANNEAL, C | 165 | 180 | OFF | 120 | 130 | 140 | 150 | 165 | 180 | OFF | 180 |
| DENIER | 61.8 | 62.0 | 62.0 | 62.0 | 62.0 | 61.7 | 62.2 | 62.2 | 61.7 | 62.3 | 61.9 |
| EB, % | 53.3 | 50.9 | 71.4 | 76.6 | 76.5 | 73.2 | 69.9 | 70.8 | 67.1 | 61.1 | 63.4 |
| RDR | 1.53 | 1.51 | 1.71 | 1.77 | 1.77 | 1.73 | 1.70 | 1.71 | 1.67 | 1.61 | 1.63 |
| TEN., G/D | 3.85 | 4.06 | 3.28 | 3.25 | 3.37 | 3.41 | 3.37 | 3.57 | 3.63 | 3.22 | 3.64 |
| TBK, G/DD | 5.90 | 6.13 | 5.61 | 5.74 | 5.95 | 5.91 | 5.73 | 6.10 | 6.07 | 5.18 | 5.89 |
| S, % | 23.9 | 11.3 | 4.1 | 3.7 | 4.2 | 5.6 | 6.1 | 10.2 | 12.3 | 4.4 | 8.0 |
| DHS, % | 21.3 | 11.4 | 4.1 | 4.0 | 4.6 | 5.6 | 6.5 | 9.3 | 11.3 | 5.0 | 8.0 |
| DHS-S, % | −2.6 | 0.1 | 0.0 | 0.3 | 0.4 | 0.0 | 0.4 | −0.9 | −1.0 | 0.6 | 0.0 |
| STmax, MG/D | 285 | 257 | 187 | 166 | 220 | 268 | 227 | 288 | 306 | 197 | 315 |
| T(STmax), C | 82 | 94 | 80 | 82 | 78 | 77 | 81 | 83 | 87 | 86 | 88 |
| NST, (G/D)/K | 0.80 | 0.70 | 0.53 | 0.47 | 0.63 | 0.77 | 0.64 | 0.81 | 0.85 | 0.55 | 0.87 |
| Ms, G/D | 1.19 | 2.27 | 4.56 | 4.49 | 5.24 | 4.79 | 3.72 | 2.82 | 3.14 | 4.48 | 3.94 |
| Ps, G/D | 6.81 | 2.90 | 0.77 | 0.61 | 0.92 | 1.50 | 1.38 | 2.94 | 3.76 | 0.87 | 2.52 |

TABLE 7

| ITEM NO. | 1 | 2 | 3 | 4 | 5 | 6 | 7 | 8 | 9 | 10 | 11 | 12 | 13C | 14C | 15C |
|---|---|---|---|---|---|---|---|---|---|---|---|---|---|---|---|
| SPEED, MPM | 3429 | 3429 | 3429 | 3429 | 3658 | 3658 | 3658 | 3658 | 4115 | 4115 | 4115 | 4115 | 4572 | 4572 | 4572 |
| TREAT., C | 135 | 135 | 135 | 135 | 180 | 180 | 180 | 180 | 135 | 135 | 135 | 135 | 120 | 120 | 120 |
| DR(1) | 1.00 | 1.09 | 1.18 | 1.22 | 1.00 | 1.11 | 1.19 | 1.24 | 1.00 | 1.09 | 1.18 | 1.22 | 1.00 | 1.02 | 1.06 |
| DRAW TEMP., | OFF | OFF | OFF | OFF | OFF | OFF | OFF | OFF | OFF | OFF | OFF | OFF | OFF | OFF | OFF |
| RELAX, C | OFF | OFF | OFF | OFF | OFF | OFF | OFF | OFF | OFF | OFF | OFF | OFF | OFF | OFF | OFF |
| DENIER | 60.0 | 44.4 | 51.5 | 50.1 | 60.0 | 55.4 | 52.4 | 50.8 | 59.8 | 56.6 | 51.8 | 50.7 | 58.3 | 60.1 | 58.8 |
| MOD., G/D | 44.4 | 64.3 | 73.4 | 73.9 | 44.4 | 70.1 | 87.5 | 87.7 | 54.1 | 56.6 | 51.8 | 50.7 | 58.3 | 81.0 | 84.8 |
| EB, % | 53.3 | 51.5 | 37.4 | 35.3 | 55.3 | 29.3 | 32.0 | 27.7 | 52.6 | 43.5 | 33.6 | 28.7 | 32.5 | 33.7 | 32.9 |
| RDR | 1.533 | 1.515 | 1.374 | 1.353 | 1.553 | 1.293 | 1.320 | 1.277 | 1.526 | 1.435 | 1.336 | 1.287 | 1.325 | 1.337 | 1.329 |
| TEN., G/D | 3.18 | 3.67 | 3.74 | 4.06 | 4.02 | 3.89 | 4.36 | 4.37 | 3.81 | 3.87 | 4.28 | 4.49 | 4.47 | 4.47 | 4.41 |
| T7, G/D | 1.29 | 1.50 | 2.04 | 2.27 | 1.62 | 2.13 | 2.70 | 3.09 | 1.86 | 2.17 | 2.90 | 3.26 | 3.09 | 3.09 | 3.19 |
| S, % | 43.6 | 62.5 | 63.3 | 62.3 | 15.6 | 44.6 | 42.7 | 40.3 | 9.7 | 12.7 | 16.0 | 16.1 | 5.5 | 5.1 | 4.9 |
| DHS, % | 73.6 | 75.0 | 73.9 | 70.7 | 8.0 | 40.2 | 36.6 | 29.9 | 8.6 | 11.0 | 13.4 | 14.2 | 7.3 | 8.6 | 8.6 |
| DHS-S, % | 30.0 | 12.5 | 10.6 | 8.4 | −7.6 | −4.4 | −6.1 | −30.4 | −0.9 | −1.7 | −2.6 | −1.9 | 1.8 | 3.5 | 3.7 |
| STmax, MG/D | 98 | 155 | 187 | 192 | 174 | 187 | 253 | 233 | 199 | 190 | 399 | 404 | 377 | 304 | 240 |
| T(STmax), C | 72 | 68 | 68 | 68 | 75 | 73 | 72 | 74 | 83 | 83 | 79 | 77 | 166 | 172 | 158 |
| NST, (G/D)/K | 0.28 | 0.45 | 0.55 | 0.56 | 0.50 | 0.54 | 0.73 | 0.67 | 0.70 | 0.53 | 1.13 | 1.15 | 0.86 | 0.68 | 0.56 |
| Ms, G/D | 0.22 | 0.25 | 0.30 | 0.31 | 1.12 | 0.42 | 0.59 | 0.58 | 2.05 | 1.50 | 2.49 | 2.51 | 6.85 | 5.96 | 4.90 |
| Ps, G/D | 4.27 | 9.69 | 11.84 | 11.96 | 2.71 | 8.34 | 10.80 | 9.39 | 1.93 | 2.53 | 6.38 | 6.50 | 2.07 | 1.55 | 1.18 |

TABLE 8

| ITEM NO. | 1C | 2C | 3C | 4C | 5C | 6C | 7 | 8 | 9 | 10 | 11 |
|---|---|---|---|---|---|---|---|---|---|---|---|
| SPEED, MPH | NA | 200 | 200 | 200 | 200 | NA | 200 | 200 | NA | 200 | 200 |
| DR(1) | NA | 1.01 | 1.03 | 1.01 | 1.03 | NA | 1.10 | 1.20 | NA | 1.10 | 1.20 |
| DR(2) | NA | 1.00 | 1.00 | 1.00 | 1.00 | NA | 1.00 | 1.00 | NA | 1.00 | 1.00 |
| DR(1) × DR(2) | NA | 1.01 | 1.03 | 1.01 | 1.03 | NA | 1.10 | 1.20 | NA | 1.10 | 1.20 |
| PLATE 1, °C. | NA | 110 | 110 | 180 | 180 | NA | 180 | 180 | NA | 180 | 180 |
| PLATE 2, °C. | NA | 27 | 27 | 27 | 27 | NA | 27 | 27 | NA | 27 | 27 |
| DENIER | 35.0 | 34.6 | 31.1 | 34.7 | 34.0 | — | 32.3 | 29.7 | — | — | 32.2 |
| EB, % | — | 59.4 | 60.0 | 59.7 | 57.5 | — | 32.8 | 32.5 | — | 53.1 | 40.3 |
| RDR | — | 1.59 | 1.600 | 1.597 | 1.575 | — | 1.328 | 1.325 | — | 1.531 | 1.403 |
| S, % | 4.0 | 4.7 | 6.5 | 3.2 | 2.9 | 4.0 | 3.9 | 4.0 | 10.5 | 4.0 | 3.8 |
| DHS, % | 3.7 | 4.9 | 5.0 | 4.0 | 4.3 | 7.7 | 5.5 | 5.6 | 10.4 | 6.7 | 6.1 |
| DHS-S, % | −0.3 | 0.2 | −1.5 | 0.8 | 1.4 | 3.7 | 1.6 | 1.6 | −0.1 | 2.7 | 2.3 |
| STmax, MG/D | (80) | 129 | 157 | 128 | 140 | — | 209 | 251 | — | 402 | 467 |
| T(STmax), °C. | 91 | 84 | 82 | 85 | 90 | — | 110 | 188 | — | 155 | 194 |
| NST, (G/D)/K | (0.22) | 0.50 | 0.44 | 0.36 | 0.39 | — | 0.55 | 0.54 | — | 0.94 | 1.00 |
| Ms, G/D | (0.32) | 0.6 | 1.0 | 0.4 | 0.4 | — | 0.8 | 1.0 | — | 1.6 | 1.8 |
| Ps, (G/D)/K | (2.0) | 2.7 | 2.4 | 4.0 | 4.8 | — | 5.4 | 6.3 | — | 10.0 | 12.3 |

| ITEM NO. | 12 | 13 | 14 | 15 | 16 | 17 | 18 | 19C | 20C | 21C |
|---|---|---|---|---|---|---|---|---|---|---|
| SPEED, MPH | NA | 200 | 200 | NA | 200 | 200 | NA | 200 | 300 | 400 |
| DR(1) | NA | 1.10 | 1.20 | NA | 1.10 | 1.20 | NA | 0.91 | 0.91 | 0.91 |
| DR(2) | NA | 1.00 | 1.00 | NA | 1.00 | 1.00 | NA | 1.00 | 1.00 | 1.00 |
| DR(1) × DR(2) | NA | 1.10 | 1.20 | NA | 1.10 | 1.20 | NA | 0.91 | 0.91 | 0.91 |
| PLATE 1, °C. | NA | 180 | 180 | NA | 180 | 180 | NA | 200 | 200 | 200 |
| PLATE 2, °C. | NA | 27 | 27 | NA | 27 | 180 | NA | 27 | 27 | 27 |
| DENIER | — | 32.2 | 29.8 | — | — | 29.8 | — | 75.5 | 75.4 | 75.6 |
| EB, % | — | 33.8 | 23.5 | — | 27.8 | 14.5 | — | 51.7 | 48.1 | 49.2 |
| RDR | — | 1.338 | 1.235 | — | 1.278 | 1.145 | — | 1.517 | 1.481 | 1.492 |
| S, % | 17.0 | 4.3 | 4.0 | 16.0 | 4.9 | 3.9 | 14.0 | 2.5 | 2.9 | 3.4 |
| DHS, % | 15.1 | 6.1 | 6.4 | 12.4 | 7.7 | 8.0 | 10.9 | 3.8 | 4.9 | 4.4 |
| DHS-S, % | −1.9 | 1.8 | 2.4 | −3.6 | 2.8 | 4.1 | −3.1 | 1.3 | 2.0 | 1.0 |
| STmax, MG/D | — | 357 | 490 | — | 590 | 647 | 286 | 60 | 73 | 46 |
| T(STmax), °C. | — | 173 | 192 | — | 172 | 192 | — | 84 | 86 | 84 |
| NST, (G/D)/K | — | 0.80 | 0.11 | — | 1.33 | 1.39 | — | 0.17 | 0.20 | 0.13 |
| Ms, G/D | — | 1.5 | 2.0 | — | 28.9 | 25.2 | — | 0.2 | 0.2 | 0.2 |
| Ps, (G/D)/K | — | 8.3 | 12.3 | — | 12.0 | 16.6 | — | 2.4 | 2.5 | 1.4 |

TABLE 9

| ITEM NO. | 1C | 2C | 3C | 4C | 5 | 6C | 7C | 8C | 9C | 10C |
|---|---|---|---|---|---|---|---|---|---|---|
| YARN TYPE | DUY | FDY | PDY | PDY | PDY | PDY | FDY | FDY | PDY | FDY |
| DRAW-RATIO | 1.00 | 1.34 | 1.18 | 1.18 | 1.18 | 1.30 | 1.47 | 1.54 | 1.34 | 1.00 |
| DRAW, C | OFF | 95 | 95 | 95 | OFF | OFF | OFF | 95 | OFF | OFF |
| SET, C | OFF | 170 | 170 | 195 | OFF | OFF | OFF | 170 | OFF | OFF |
| RELAX, C | OFF | OFF | OFF | OFF | OFF | 195 | 195 | OFF | OFF | OFF |
| DENIER | 108.0 | 81.8 | 91.5 | 92.2 | 93.9 | 93.2 | 83.6 | 70.6 | 81.4 | 70.0 |
| T7, GID | 0.90 | 2.20 | 1.70 | 1.80 | 1.40 | 1.30 | 4.00 | 3.40 | 1.40 | 3.10 |
| EB, % | 74.90 | 25.40 | 42.80 | 40.00 | 48.40 | 45.40 | 30.70 | 24.20 | 48.10 | 25.20 |
| S2, % | −0.3 | 1.2 | 0.7 | 1.2 | −0.6 | 0.2 | 1.1 | 6.8 | −7.2 | 5.3 |
| S, % | 3.4 | 5.9 | 4.4 | 2.3 | 8.9 | 2.0 | 1.7 | 6.8 | 25.8 | 7.0 |
| STmax, MG/D | 70 | 420 | 240 | 220 | 170 | 30 | 40 | 410 | 180 | 220 |
| Ms, G/D | 2.06 | 7.12 | 5.45 | 9.57 | 0.35 | 15.00 | 23.53 | 6.03 | 0.70 | 3.14 |
| Ps, (G/D) % | 0.24 | 2.48 | 1.06 | 0.51 | 1.51 | 0.06 | 0.07 | 2.79 | 4.64 | 1.54 |
| DEN., G/CC | 1.3624 | 1.3810 | 1.3869 | 1.3988 | 1.3815 | 1.3864 | 1.3880 | 1.3838 | 1.3590 | 1.3764 |
| CS, Angstrom | 66 | 75 | 73 | 71 | 64 | 71 | 72 | 58 | <30 | 44 |
| RDDR, ×1000 (1 dpf) | 237 | 140 | 148 | 182 | 231 | 194 | 98 | 74 | 186 | 66 |

TABLE 10

| YARN ID DPF | ITEM NO. | DRAW RATIO | DRAW TEM | BOS % | STmax MG/D | Tmax DEG. C. | Ps (G/D) % | Ms (G/D) |
|---|---|---|---|---|---|---|---|---|
| A - 0.80 | 1 | 1.60 | 25 | 40.3 | — | — | — | — |
| | 2 | ↓ | 115 | 8.7 | — | — | — | — |
| | 3 | ↓ | 180 | 4.4 | — | — | — | — |
| B - 0.64 | 4 | 1.40 | 25 | 21.2 | — | — | — | — |
| | 5 | ↓ | 115 | 7.8 | — | — | — | — |
| | 6 | ↓ | 180 | 3.8 | — | — | — | — |
| C - 0.86 | 7A | 1.00 | OFF | 49.9 | — | — | | |
| | 7 | 1.64 | 25 | 48.1 | 395 | 74 | 19.00 | 0.82 |
| | 9 | ↓ | 110 | 11.7 | 371 | 110 | 4.33 | 0.94 |
| | 10 | ↓ | 115 | 10.3 | 425 | 124 | 4.38 | 4.13 |
| | 11 | ↓ | 120 | 9.8 | 365 | 152 | 3.58 | 3.72 |
| | 12 | ↓ | 130 | 8.3 | 357 | 140 | 2.96 | 4.30 |
| | 13 | ↓ | 140 | 7.4 | 447 | 152 | 3.31 | 6.04 |
| | 14 | ↓ | 150 | 6.6 | 385 | 156 | 2.54 | 5.83 |
| | 15 | ↓ | 160 | 6.2 | 384 | 170 | 2.15 | 6.19 |
| | 16 | ↓ | 170 | 5.6 | 408 | 160 | 2.28 | 7.29 |
| | 17 | ↓ | 180 | 5.4 | 376 | 175 | 2.03 | 6.96 |
| D - 3.44 | 17A | 1.00 | OFF | 56.4 | — | — | — | — |
| | 18 | 1.64 | 25 | 60.8 | 260 | 72 | 15.81 | 0.43 |
| | 19 | ↓ | 110 | 46.8 | 150 | 76 | 4.02 | 0.32 |
| | 20 | ↓ | 115 | 32.5 | 169 | 85 | 5.49 | 0.52 |
| | 21 | ↓ | 120 | 20.5 | 141 | 88 | 2.89 | 0.69 |
| | 22 | ↓ | 130 | 18.1 | 185 | 108 | 3.35 | 1.02 |
| | 23 | ↓ | 140 | 10.3 | 206 | 115 | 2.11 | 2.00 |
| | 24 | ↓ | 150 | 8.5 | 213 | 110 | 1.81 | 2.51 |
| | 25 | ↓ | 160 | 7.4 | 207 | 120 | 1.53 | 2.80 |
| | 26 | ↓ | 170 | 6.7 | 205 | 132 | 1.37 | 1.97 |
| | 27 | ↓ | 180 | 6.5 | 157 | 117 | 1.02 | 1.80 |

TABLE 11

| ITEM NO. | 1C | 2C | 3C | 4C | 5C | 6C | 7C | 8C | 9C | 10C | 11C |
|---|---|---|---|---|---|---|---|---|---|---|---|
| ANNEALED | OFF | FREE | FREE | FREE | FREE | FREE | TAUT | TAUT | TAUT | TAUT | TAUT |
| TEMP., C. | RT | 60 | 100 | 120 | 160 | 220 | 60 | 100 | 120 | 160 | 220 |
| DENIER | 196 | 200 | 203 | 203 | 206 | 211 | 198 | 197 | 194 | 192 | 184 |
| MOD., G/D | 79.4 | 67.4 | 57.1 | 69.5 | 69.5 | 59.2 | 70.2 | 74.9 | 75.5 | 77.9 | 86.6 |
| T20%, G/D | 1.87 | 1.78 | 1.79 | 1.74 | 1.87 | 1.96 | 1.85 | 2.08 | 2.11 | 2.40 | 2.88 |
| EB, % | 51.6 | 51.9 | 53.5 | 53.6 | 57.6 | 57.9 | 53.4 | 51.7 | 50.6 | 46.0 | 40.8 |
| RDR | 1.516 | 1.519 | 1.535 | 1.536 | 1.576 | 1.579 | 1.534 | 1.517 | 1.506 | 1.460 | 1.408 |
| TEN., G/D | 3.76 | 3.27 | 3.18 | 3.13 | 3.43 | 3.34 | 3.43 | 3.48 | 3.62 | 3.60 | 3.85 |
| TBK, G/DD | 5.70 | 4.97 | 4.88 | 4.81 | 5.41 | 5.27 | 5.26 | 5.28 | 5.45 | 5.26 | 5.42 |
| DHS, % | 3.5 | 3.5 | 3.2 | 3.0 | 5.3 | 5.3 | 1.0 | 0.6 | −1.1 | −2.1 | −6.5 |
| S, % | 3.6 | 0.2 | 0.1 | −0.2 | −0.1 | −0.2 | 3.7 | 3.2 | 3.0 | 1.6 | 1.3 |
| DEN., G/CC | 1.3810 | 1.3794 | 1.3852 | 1.3875 | 1.3941 | 1.4044 | 1.3794 | 1.3859 | 1.3873 | 1.3949 | 1.4040 |
| SV, KM/SEC | 2.70 | 2.76 | 2.84 | 2.82 | 2.78 | 2.61 | 2.78 | 2.91 | 2.97 | 3.12 | 3.23 |
| Msonic* | 10.1 | 10.5 | 11.2 | 11.0 | 10.8 | 9.6 | 10.7 | 11.7 | 12.2 | 13.6 | 14.7 |
| COA, ° | 11.0 | 13.5 | 13.0 | 13.5 | 12.0 | 14.0 | 12.5 | 13.0 | 13.5 | 13.0 | 14.0 |
| CS, A | 73 | 66 | 61 | 64 | 75 | 75 | 74 | 65 | 70 | 70 | 76 |
| LPS, A | 374 | 318 | 318 | 116 | 117 | 145 | 318 | 318 | 318 | 120 | 146 |

*10 ^10 Dynes/CM$^2$; A = Angstroms

TABLE 12A

| Yarn Code | Treatment Temp. °C. | Density gm/cm | $\chi_\rho$ | Δn | Δna* | % S | Den. | Mod gpd | Ten. gpd | Elong. % | $T_7$ gpd | Rec. % | Sh. Ten. gpd |
|---|---|---|---|---|---|---|---|---|---|---|---|---|---|
| A60 | 60 | 1.3710 | .319 | .0173 | .024 | 0.6 | 76.0 | 38.8 | 2.87 | 91.0 | 0.85 | 83.5 | .018 |
| A70 | 70 | 1.3794 | .391 | .0844 | .016 | 2.2 | 77.2 | 43.5 | 3.04 | 94.2 | 0.95 | 86.6 | .013 |
| A100 | 100 | 1.3877 | .461 | .1024 | .027 | 3.2 | 77.9 | 40.7 | 2.88 | 86.9 | 1.02 | 80.1 | .018 |
| A140 | 140 | 1.3964 | .534 | .1192 | .037 | 3.2 | 77.9 | 53.6 | 3.05 | 84.2 | 1.18 | 80.5 | .016 |
| A160 | 160 | 1.3977 | .544 | .1218 | .039 | 1.9 | 76.9 | 53.5 | 2.90 | 85.4 | 1.05 | 81.6 | .012 |
| 1A | 120 | 1.3832 | .423 | .0908 | .017 | 2.0 | 77.0 | 42.5 | 2.85 | 83.0 | 0.94 | 81.7 | .020 |
| 2A | 160 | 1.3907 | .486 | .1154 | .044 | 1.7 | 76.8 | 50.8 | 2.86 | 81.4 | 1.13 | 82.3 | .018 |
| 3A | 180 | 1.3936 | .510 | .1220 | .050 | 2.1 | 77.1 | 51.0 | 2.86 | 76.5 | 1.18 | 80.9 | .019 |
| 4A | 220 | 1.4052 | .606 | .1380 | .057 | 2.1 | 77.1 | 51.3 | 3.10 | 78.2 | 1.22 | 80.8 | .017 |
| 5A | 240 | 1.4132 | .676 | .1481 | .061 | 4.2 | 78.7 | 54.2 | 2.95 | 72.1 | 1.16 | 75.7 | .010 |

TABLE 12B

| Yarn Code | Treatent Temp, °C. | Density gm/cm³ | $\chi_\rho$ | Δn | Δna* | Mod. gpd | Ten. gpd | Elong. % | $T_7$ gpd | Rec. % | Sh. Ten. gpd |
|---|---|---|---|---|---|---|---|---|---|---|---|
| B60 | 60 | 1.3822 | .415 | .0923 | .022 | 47.3 | 2.75 | 67.6 | 1.05 | — | .016 |
| B70 | 70 | 1.3850 | .438 | .0990 | .027 | 44.2 | 2.72 | 79.3 | 1.07 | 88.6 | .021 |
| B100 | 100 | 1.3862 | .448 | .1006 | .027 | 46.0 | 2.92 | 85.2 | 1.09 | 86.9 | .020 |
| B140 | 140 | 1.3947 | .520 | .1191 | .040 | 48.8 | 2.89 | 81.4 | 1.13 | 85.6 | .018 |
| B160 | 160 | 1.3988 | .554 | .1262 | .046 | 52.4 | 2.75 | 72.9 | 1.18 | 85.6 | .024 |
| 1 | 120 | 1.3772 | .372 | .0803 | .015 | 43.5 | 2.81 | 81.0 | 0.93 | 86.2 | .044 |
| 2 | 160 | 1.3884 | .467 | .1044 | .029 | 51.3 | 2.99 | 78.9 | 1.13 | 85.7 | .043 |
| 3 | 180 | 1.3908 | .487 | .1087 | .031 | 52.8 | 2.99 | 81.2 | 1.16 | 87.8 | .034 |
| 4 | 220 | 1.3951 | .523 | .1198 | .042 | 55.6 | 3.12 | 81.4 | 1.23 | 87.9 | .034 |
| 5 | 240 | 1.4020 | .580 | .1357 | .060 | 60.1 | 3.05 | 72.3 | 1.30 | 86.2 | .036 |

TABLE 13

| | 1 | 2 | 3 | 4 | 5 | 6 | 7 | 8 | 9 |
|---|---|---|---|---|---|---|---|---|---|
| Draw Ratio | — | RELAX | RELAX | TAUT | TAUT | 1.05 | 1.05 | 1.10 | 1.10 |
| Draw Temperature (°C.) | — | 100 | 180 | 100 | 180 | 95 | 180 | 95 | 180 |
| Wet/Dry | — | WET | DRY | WET | DRY | WET | DRY | WET | DRY |
| Density, ρ (g/cm³)* | 1.3719 | 1.3877 | 1.3936 | 1.3962 | 1.3908 | 1.3756 | 1.3976 | 1.3801 | 1.391 |
| Birefringence ($\Delta_n$) | 0.071 | 0.102 | 0.122 | 0.101 | 0.109 | 0.081 | 0.121 | 0.099 | 0.121 |
| Crystal Size, CS (Å) | 72 | 75 | 72 | 66 | 72 | 68 | 75 | — | — |
| Modulus, M (g/d) | 48.5 | 40.7 | 51.0 | 46.0 | 52.8 | 48.4 | 58.3 | 54.6 | 66.6 |
| Tenacity at 7%, $T_7$ (g/d) | 0.9 | 1.0 | 1.2 | 1.1 | 1.2 | 1.1 | 1.3 | 1.3 | 1.3 |
| Elongation, $E_B$ (%) | 89.1 | 86.9 | 76.5 | 85.2 | 81.2 | 66.7 | 60.2 | 56.1 | 47.8 |
| Tenacity, T (g/d) | 3.0 | 2.9 | 2.9 | 2.9 | 3.0 | 2.9 | 3.0 | 3.0 | 3.0 |
| Shrinkage Tension, ST (g/d) | 0.07 | 0.02 | 0.02 | 0.02 | 0.03 | 0.14 | 0.09 | 0.20 | 0.17 |
| Dye Uptake (K/S) | 17.7 | — | — | 15.6 | 16.3 | 16.7 | 12.2 | 16.8 | 10.7 |

TABLE 14A

| | 1 | 2 | 3 | 4 | 5 | 6 | 7 | 8 |
|---|---|---|---|---|---|---|---|---|
| SPIN SPEED, YPM | 4500 | 4500 | 4000 | 4000 | 5000 | 5000 | 4500 | 4500 |
| SPIN SPEED, MPM | 4115 | 4115 | 3658 | 3658 | 4572 | 4572 | 4115 | 4115 |
| (n) | 0.65 | 0.65 | 0.73 | 0.73 | 0.59 | 0.59 | 0.65 | 0.65 |
| Tp, °C. | 302 | 302 | 302 | 302 | 302 | 302 | 302 | 302 |
| CAP. (D × L), MILS | 10 × 40 | 15 × 60 | 10 × 40 | 15 × 60 | 10 × 40 | 10 × 40 | 9 × 50 | 15 × 72 |
| NO. FILAMENTS | 34 | 34 | 34 | 34 | 34 | 34 | 34 | 34 |
| DPF | 2.88 | 2.90 | 2.86 | 2.89 | 2.89 | 2.90 | 2.89 | 2.92 |
| SHAPE | RND | RND | RND | RND | RND | RND | RND | TRI |
| QUENCH | XF | XF | XF | XF | XF | XF | XF | XF |
| MODULUS, G/D | 44.7 | 48.2 | 40.6 | 45.1 | 53.3 | 51.6 | 42.0 | 46.4 |
| ELNG. (Eb), % | 76.3 | 78.8 | 88.4 | 84.2 | 68.4 | 68.5 | 80.6 | 73.0 |
| TENACITY, G/D | 3.12 | 3.23 | 3.04 | 3.07 | 3.34 | 3.32 | 3.15 | 2.88 |
| S1, % | 13.8 | 5.4 | 9.2 | 4.8 | 13.1 | 5.5 | 30.0 | 4.7 |
| DHS, % | 9.0 | 4.4 | 7.1 | 4.3 | 9.4 | 4.5 | 24.6 | 4.0 |
| (DHS-S1), % | −4.8 | −1.0 | −2.1 | −0.5 | −3.7 | −1.0 | −5.5 | −0.7 |
| STmax, MG/D | 91 | 85 | 52 | 65 | 87 | 92 | 73 | 72 |
| Ms, G/D | 0.60 | 1.57 | 0.57 | 1.35 | 0.66 | 1.67 | 0.53 | 1.53 |
| Ps, G/D | 1.26 | 0.46 | 0.48 | 0.31 | 1.14 | 0.51 | 1.01 | 0.34 |
| DENSITY, G/CC | 1.353 | 1.359 | 1.353 | 1.356 | 1.351 | 1.356 | 1.348 | 1.359 |
| RDDR, ×1000 | 120 | 98 | 145 | 139 | 109 | 99 | 119 | 147 |

| | 9 | 10 | 11 | 12 | 13 | 14 | 15 |
|---|---|---|---|---|---|---|---|
| SPIN SPEED, YPM | 4500 | 4500 | 4500 | 4500 | 4500 | 5500 | 5500 |
| SPIN SPEED, MPM | 4115 | 4115 | 4115 | 4115 | 4115 | 5029 | 5029 |
| (n) | 0.65 | 0.65 | 0.65 | 0.65 | 0.65 | 0.65 | 0.65 |
| Tp, °C. | 302 | 296 | 296 | 302 | 302 | 305 | 297 |
| CAP. (D × L), MILS | 15 × 72 | 9 × 50 | 15 × 72 | 10 × 40 | 15 × 60 | 9 × 50 | 9 × 36 |
| NO. FILAMENTS | 34 | 68 | 34 | 40 | 34 | 34 | 34 |
| DPF | 4.34 | 2.22 | 3.06 | 2.45 | 2.90 | 5.20 | 4.90 |
| SHAPE | TRI | RND | OCTA | RND | RND | RND | RND |

TABLE 14A-continued

| | | | | | | | |
|---|---|---|---|---|---|---|---|
| QUENCH | XF | 4RAD | 2RAD | XF | XF | 4XF | XF |
| MODULUS, G/D | 43.4 | 36.9 | 51.1 | 43.8 | 48.2 | 53.3 | 45.6 |
| ELNG. (Eb), % | 73.8 | 87.0 | 71.4 | 78.8 | 78.8 | 60.8 | 65.8 |
| TENACITY, G/D | 2.82 | 3.04 | 2.98 | 3.18 | 3.23 | 3.96 | 3.56 |
| S1, % | 15.3 | 20.1 | 3.4 | 7.6 | 5.4 | 9.1 | 3.4 |
| DHS, % | 10.1 | 13.6 | 3.3 | 6.9 | 4.4 | 8.0 | 3.7 |
| (DHS-S1), % | −5.2 | −6.5 | −0.1 | −0.7 | −1.0 | −1.1 | 0.3 |
| STmax, MG/D | 62 | 78 | 75 | 76 | 85 | 65 | 76 |
| Ms, G/D | 0.41 | 0.39 | 2.21 | 1.00 | 1.57 | 0.71 | 2.24 |
| Ps, G/D | 0.95 | 1.57 | 0.26 | 0.58 | 0.46 | 0.59 | 0.26 |
| DENSITY, G/CC | 1.352 | 1.352 | 1.371 | 1.356 | 1.359 | 1.354 | 1.371 |
| RDDR, ×1000 | 115 | 139 | 202 | 101 | 98 | N/A | 100 |

TABLE 14B

| | 1 | 2 | 3 | 4 | 5 | 6 | 7 | 8 | 9 |
|---|---|---|---|---|---|---|---|---|---|
| YARN TYPE | 1-HIGH | 1-LOW | 1-MIX | 2-HIGH | 2-LOW | 2-MIX | 3-HIGH | 3-LOW | 3-MIX |
| SPIN SPEED, YPM | 4500 | 4500 | 4500 | 4500 | 4500 | 4500 | 4000 | 4000 | 4000 |
| SPIN SPEED, MPM | 4115 | 4115 | 4115 | 4115 | 4115 | 4115 | 3658 | 3658 | 3658 |
| (n) | 0.65 | 0.65 | 0.65 | 0.65 | 0.65 | 0.65 | 0.65 | 0.65 | 0.65 |
| Tp, °C. | 302 | 302 | 302 | 302 | 302 | 302 | 288 | 288 | 288 |
| CAP. (D × L), MILS | 9 × 50 | 15 × 72 | N/A | 9 × 50 | 15 × 72 | N/A | 9 × I2 | 15 × 60 | N/A |
| NO. FILAMENTS | 34 + 34 | 40 + 40 | 34 + 40 | 34 + 34 | 34 + 34 | 34 + 34 | 17 + 17 | 34 + 34 | 17 + 34 |
| DPF | 2.2 | 1.9 | N/A | 2.2 | 2.2 | N/A | 3.9 | 2.0 | N/A |
| SHAPE | RND | OCTA | N/A | RND | TRI | N/A | RND | RND | RND |
| QUENCH | XF | XF | XF | XF | XF | XF | XF | XF | XF |
| MODULUS, G/D | 43.3 | 53.8 | 50.5 | 43.4 | 49.7 | 49.7 | 30.9 | 38.6 | 28.8 |
| ELNG. (Eb), % | 82.0 | 80.9 | 76.6 | 82.0 | 71.7 | 72.7 | 98.0 | 90.0 | 102.0 |
| TENACITY, G/D | 3.15 | 3.39 | 3.07 | 3.15 | 2.96 | 2.92 | 2.80 | 2.90 | 2.80 |
| S1, % | 12.5 | 3.9 | 11.0 | 12.5 | 3.9 | 10.6 | 16.7 | 5.9 | 16.5 |
| DES, % | 9.4 | 3.7 | 8.8 | 9.4 | 4.2 | 7.4 | 16.3 | 5.3 | 16.0 |
| (DHS-S1), % | −3.1 | −0.2 | −2.2 | −3.1 | 0.3 | −3.2 | −0.4 | −0.6 | −0.5 |
| STmax, MG/D | 75 | 86 | 81 | 75 | 77 | 76 | 77 | 97 | 73 |
| Ms, G/D | 0.60 | 2.21 | 0.74 | 0.60 | 1.97 | 0.72 | 0.46 | 1.64 | 0.44 |
| Ps, G/D | 0.94 | 0.34 | 0.89 | 0.94 | 0.30 | 0.81 | 1.29 | 0.57 | 1.20 |
| DENSITY, G/CC | 1.3514 | 1.3627 | 1.3570 | 1.3514 | 1.3620 | 1.3573 | 1.3484 | 1.3600 | 1.3561 |
| RDDR, ×1000 | 119 | 126 | 123 | 119 | 139 | 129 | — | — | 195 |
| DFL (DHS), % | 0.0 | 0.0 | 5.1 | 0.0 | 0.0 | 5.2 | 0.0 | 0.0 | 11.0 |
| REL. BULK, % | 3.1 | 0.2 | 8.8 | 3.1 | 0.3 | 8.3 | 0.4 | 0.6 | 11.4 |

TABLE 15

| ITEM NO. | YARN COUNT | DPF | BOS, % | STmax (G/D) | Ps (G/D) % | BULK-IN FABRIC |
|---|---|---|---|---|---|---|
| 1A | 75–34 | 2.20 | 12.00 | 0.15 | 1.80 | YES |
| 1B | 50–34 | 1.47 | 11.00 | 0.21 | 2.31 | YES |
| 2A | 75–68 | 1.10 | 9.50 | 0.13 | 1.24 | NO |
| 2B | 50–68 | 0.73 | 12.00 | 0.17 | 2.04 | YES |
| 2C | 35–68 | 0.51 | 9.00 | 0.20 | 1.80 | YES |
| 3A | 75–100 | 0.75 | 11.00 | 0.11 | 1.21 | NO |
| 3B | 50–100 | 0.50 | 12.00 | 0.19 | 2.28 | YES |

TABLE 15-continued

| ITEM NO. | YARN COUNT | DPF | BOS, % | STmax (G/D) | Ps (G/D) % | BULK-IN FABRIC |
|---|---|---|---|---|---|---|
| 4A | 75–68 | 1.10 | 11.00 | 0.10 | 1.10 | NO |
| 4B | 50–68 | 0.73 | 8.00 | 0.12 | 0.96 | NO |
| 4C | 35–68 | 0.51 | 6.00 | 0.32 | 1.96 | YES |
| 5A | 50–68R | 0.73 | 9.00 | 0.14 | 1.26 | NO |
| 5B | 50–50T | 1.00 | 11.00 | 0.14 | 1.54 | YES |

R = ROUND; T = TRILIOBAL

TABLE 16

| Yarn Count (A + B) Bundle Denier A Bundle Denier B | STEAM PRESSURE (PSI) | ← BOIL-OFF SHRINKAGE (S), → 140/85 70/68 70/17 | 140/95 70/68 70/27 | 140/117 70/100 70/17 | 140/127 70/100 70/27 | ← SHRINKAGE TENSION (STmax), G/D → 140/85 70/68 70/17 | 140/95 70/68 70/27 | 140/117 70/100 70/17 | 140/127 70/100 70/27 |
|---|---|---|---|---|---|---|---|---|---|
| 4500 ypm | 40 | 18 | 18 | 23 | 9 | 90 | 90 | 100 | 90 |
| | 60 | 31 | 16 | 27 | 28 | 80 | 80 | 90 | 100 |
| | 80 | 61 | 57 | 60 | 58 | 80 | 90 | 80 | 100 |
| | 100 | 55 | 54 | 59 | 55 | 100 | 90 | 90 | 90 |
| | 120 | 54 | 29 | 48 | 43 | 90 | 100 | 90 | 90 |
| | 140 | 34 | 32 | 30 | 32 | 90 | 80 | 90 | 90 |
| | 160 | 12 | 17 | 18 | 29 | 90 | 90 | 90 | 100 |
| 4700 ypm | 40 | 10 | 8 | 8 | 7 | 90 | 100 | 80 | 90 |
| | 60 | 11 | 9 | 11 | 12 | 90 | 100 | 100 | 100 |
| | 80 | 26 | 27 | 17 | 15 | 110 | 120 | 90 | 90 |
| | 100 | 50 | 11 | 28 | 39 | 150 | 110 | 90 | 110 |
| | 120 | 35 | 11 | 21 | 32 | 130 | 130 | 90 | 90 |
| | 140 | 24 | 12 | 10 | 23 | 140 | 110 | 80 | 110 |
| | 160 | 12 | 12 | 4 | 16 | 140 | 90 | 90 | 110 |
| 4900 ypm | 40 | 4 | 7 | 15 | 6 | 110 | 90 | 130 | 110 |
| | 60 | 7 | 7 | 17 | 6 | 100 | 100 | 160 | 120 |
| | 80 | 7 | 9 | 19 | 11 | 130 | 100 | 170 | 120 |
| | 100 | 8 | 24 | 24 | 13 | 120 | 100 | 160 | 130 |
| | 120 | 30 | 26 | 22 | 30 | 120 | 150 | 180 | 140 |
| | 140 | 32 | 10 | 23 | 4 | 150 | 160 | 150 | 140 |
| | 160 | 4 | 5 | 4 | 4 | 100 | 100 | 100 | 100 |

TABLE 16-continued

| Yarn Count (A + B) Bundle Denier A Bundle Denier B | STEAM PRESSURE (PSI) | ← BOIL-OFF SHRINKAGE (S), → 140/85 70/68 70/17 | 140/95 70/68 70/27 | 140/117 70/100 70/17 | 140/127 70/100 70/27 | ← SHRINKAGE TENSION (STmax), G/D → 140/85 70/68 70/17 | 140/95 70/68 70/27 | 140/117 70/100 70/17 | 140/127 70/100 70/27 |
|---|---|---|---|---|---|---|---|---|---|
| 5100 ypm | 40 | 5 | 3 | 8 | 5 | 100 | 110 | 90 | 110 |
| | 60 | 4 | 4 | 5 | 5 | 100 | 120 | 100 | 120 |
| | 80 | 6 | 5 | 8 | 7 | 100 | 120 | 90 | 120 |
| | 100 | 8 | 5 | 22 | 15 | 110 | 120 | 10 | 120 |
| | 120 | 9 | 13 | 29 | 13 | 100 | 150 | 10 | 150 |
| | 140 | 10 | 9 | 23 | 13 | 110 | 130 | 90 | 130 |
| | 160 | 12 | 9 | 18 | 13 | 110 | 140 | 100 | 140 |
| 5300 ypm | 40 | 5 | 4 | 5 | 4 | 110 | 80 | 100 | 80 |
| | 60 | 5 | 4 | 5 | 4 | 90 | 100 | 90 | 100 |
| | 80 | 5 | 5 | 4 | 3 | 10 | 90 | 100 | 90 |
| | 100 | 6 | 6 | 7 | 9 | 90 | 110 | 90 | 110 |
| | 120 | 5 | 5 | 7 | 5 | 110 | 130 | 100 | 130 |
| | 140 | 6 | 8 | 8 | 8 | 140 | 100 | 140 | 100 |
| | 160 | 8 | 12 | 6 | 4 | 130 | 100 | 110 | 100 |

TABLE 17A

| ITEM NO. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| SPEED, MPM | NA | 200 | 200 | 200 | 200 | 200 | 200 | 200 | NA | 200 | 200 | NA | 200 | 200 | NA | 200 |
| DR(1) | 1.00 | 1.00 | 1.03 | 1.20 | 0.93 | 0.93 | 0.93 | 0.93 | 1.00 | 1.10 | 1.20 | 1.00 | 1.10 | 1.20 | 1.00 | 0.91 |
| DR(2) | 1.00 | 1.00 | 1.00 | 1.00 | 1.00 | 1.03 | 1.05 | 1.10 | 1.00 | 1.00 | 1.00 | 1.00 | 1.00 | 1.00 | 1.00 | 1.00 |
| DR(1) × DR(2) | 1.00 | 1.00 | 1.03 | 1.20 | 0.93 | 0.96 | 0.98 | 1.02 | 1.00 | 1.10 | 1.20 | 1.00 | 1.10 | 1.20 | 1.00 | 0.91 |
| PLATE 1, °C. | OFF | 110 | 110 | 27 | 200 | 180 | 180 | 180 | OFF | 180 | 180 | OFF | 180 | 180 | OFF | 200 |
| PLATE 2, °C. | OFF | 27 | 27 | 27 | 27 | 27 | 27 | 27 | OFF | 27 | 27 | OFF | 27 | 27 | OFF | 27 |
| DENIER | 70.0 | 68.9 | 67.9 | 59.5 | 73.6 | 75.4 | 72.0 | 69.7 | 35.0 | 63.3 | 63.6 | 35.0 | 32.2 | 29.8 | 35.0 | 75.5 |
| EB, % | 52.0 | 51.8 | 44.1 | 36.1 | 61.0 | 70.8 | 60.6 | 57.3 | 56.0 | 53.1 | 40.3 | 41.2 | 27.8 | 14.5 | 66.7 | 51.7 |
| RDR | 1.520 | 1.518 | 1.441 | 1.361 | 1.610 | 1.708 | 1.606 | 1.573 | 1.560 | 1.531 | 1.403 | 1.412 | 1.278 | 1.145 | 1.667 | 1.517 |
| TEN., G/D | 2.9 | 3.1 | 3.1 | 3.4 | 3.1 | 2.8 | 3.1 | 3.2 | 3.0 | — | 4.1 | 3.7 | 4.7 | 5.2 | 2.8 | 3.3 |
| TBK, G/DD | 4.5 | 4.6 | 4.5 | 4.7 | 5.0 | 4.8 | 4.9 | 5.0 | 4.7 | — | 5.7 | 5.2 | 6.0 | 6.0 | 4.6 | 4.9 |
| S, % | 36.1 | 7.5 | 8.0 | 19.3 | 2.1 | 3.3 | 4.2 | 6.6 | 16.9 | 6.7 | 6.1 | 16.0 | 7.7 | 8.0 | 14.0 | 3.8 |
| DHS, % | 31.0 | 7.6 | 7.6 | 15.2 | 3.5 | 2.7 | 5.0 | 6.4 | 19.3 | 4.0 | 3.8 | 13.1 | 4.9 | 3.9 | 10.9 | 2.5 |
| DHS-S, % | 32.0 | 32.0 | 32.0 | 32.0 | 32.0 | 32.0 | 32.0 | 32.0 | 0.0 | 0.0 | 0.0 | 0.0 | 0.0 | 0.0 | 0.0 | 0.0 |
| STmax, MG/D | 153 | 187 | 278 | 392 | 76 | 64 | 124 | 257 | 210 | 402 | 467 | 250 | 590 | 647 | 286 | 60 |
| T(STmax), C | 88 | 98 | 98 | 77 | 86 | 80 | 85 | 83 | 81 | 155 | 194 | 98 | 172 | 192 | 98 | 84 |
| NST, (G/D)/K | 0.42 | 0.50 | 0.75 | 1.12 | 0.21 | 0.18 | 0.35 | 0.72 | 0.59 | 0.94 | 1.00 | 0.67 | 1.33 | 1.39 | 0.79 | 0.17 |
| Ms, G/D | 0.5 | 2.5 | 3.5 | 2.0 | 3.6 | 1.9 | 3.0 | 3.9 | 1.2 | 10.0 | 12.3 | 1.6 | 7.7 | 8.1 | 2.0 | 1.6 |

TABLE 17B

| ITEM NO. | 1 | 2 | 3 | 4 | 5 | 6 | 7 | 9 | 10 | 11 | 12 | 13 | 14 |
|---|---|---|---|---|---|---|---|---|---|---|---|---|---|
| SPEED, MPM | 100 | 150 | 200 | 200 | 200 | 200 | 200 | 200 | 200 | 200 | 200 | 200 | 200 |
| DR(1) | 0.93 | 0.93 | 0.93 | 0.93 | 0.93 | 0.93 | 0.93 | 1.10 | 1.10 | 1.00 | 1.20 | 1.20 | 1.20 |
| DR(2) | 1.00 | 1.00 | 1.00 | 1.00 | 1.05 | 1.10 | 1.20 | 1.00 | 0.93 | 1.02 | 1.00 | 0.93 | 1.02 |
| DR(1) × DR(2) | 1.00 | 0.93 | 0.93 | 0.93 | 0.98 | 1.02 | 1.12 | 1.10 | 1.02 | 1.02 | 1.20 | 1.12 | 1.22 |
| PLATE 1, °C. | 110 | 150 | 200 | 180 | 180 | 180 | 180 | 27 | 27 | 27 | 27 | 27 | 27 |
| PLATE 2, °C. | 27 | 27 | 27 | 27 | 27 | 27 | 27 | 27 | 180 | 110 | 27 | 180 | 110 |
| DENIER | 71.4 | 72.0 | 73.3 | 72.1 | 70.9 | 68.5 | 63.3 | 63.6 | 64.4 | 61.5 | 58.6 | 61.1 | 56.5 |
| EB, % | 68.4 | 65.5 | 64.6 | 62.8 | 59.0 | 54.2 | 40.7 | 46.4 | 44.5 | 39.5 | 34.5 | 39.2 | 30.6 |
| RDR | 1.684 | 1.655 | 1.646 | 1.628 | 1.590 | 1.542 | 1.407 | 1.464 | 1.445 | 1.395 | 1.345 | 1.392 | 1.306 |
| S, % | 6.2 | 2.9 | 2.6 | 2.9 | 3.9 | 6.6 | 8.1 | 4.7 | 7.3 | 19.5 | 20.0 | 5.3 | 6.3 |
| DHS, % | 4.8 | 3.3 | 3.2 | 3.2 | 4.4 | 6.6 | 8.6 | 2.1 | 5.9 | 15.7 | 16.1 | 2.9 | 8.3 |
| DHS-S, % | −1.4 | 0.4 | 0.6 | 0.3 | 0.5 | 0.0 | 0.5 | −2.6 | −1.4 | −3.8 | −3.9 | −2.4 | 2.0 |
| STmax, MG/D | 73 | 76 | 75 | 68 | 142 | 282 | 385 | 365 | 50 | 413 | 340 | 102 | 621 |
| NST, (G/D)/K | 0.50 | 0.21 | 0.21 | 0.19 | 0.40 | 0.79 | 1.08 | 1.04 | 0.13 | 1.06 | 0.96 | 0.28 | 1.59 |
| T(STmax), °C. | 77 | 84 | 82 | 82 | 82 | 82 | 84 | 77 | 100 | 118 | 80 | 96 | 118 |
| Ms, G/D | 1.2 | 2.6 | 2.9 | 2.3 | 3.6 | 4.3 | 4.8 | 7.8 | 0.7 | 2.1 | 1.7 | 1.9 | 9.9 |
| Ps, G/D | 0.5 | 0.2 | 0.2 | 0.2 | 0.6 | 1.9 | 3.1 | 1.7 | 0.4 | 8.1 | 6.8 | 0.5 | 3.9 |

TABLE 18

| ITEM NO. | 1 | 2 | 3 |
|---|---|---|---|
| SPIN SPEED, MPM | 4526 | 4526 | 4526 |
| WIND-UP, MPM | 4115 | 4115 | 4115 |
| POLYMER TEMP., C | 293 | 293 | 298 |
| SPRT - A | 68 | 68 | 34 |
| SPRT - B | 100 | 47 | 68 |
| DENIER - A | 75 | 50 | 35 |
| DENIER - B | 75 | 50 | 35 |
| UNTREATED | | | |
| AVG. BOS,. % | ← | 4.5 | → |
| AVG. STmax, G/D | ← | 0.190 | → |
| AVG. Ps, (G/D) % | ← | 0.86 | → |
| AVG. Ms, G/D | ← | 4.2 | → |

TABLE 18-continued

| ITEM NO. | 1 | 2 | 3 |
|---|---|---|---|
| TREATED (245C, 80 PSI) | | | |
| AVG. BOS, % | 19.0 | 17.0 | 17.0 |
| AVG. STmax, G/D | 0.30 | 0.30 | 0.31 |
| AVG. Ps, (G/D) % | 5.70 | 5.10 | 5.30 |
| AVG. Ms, G/D | 1.00 | 1.76 | 1.82 |
| T(STmax), C | <100 | <100 | <100 |
| AVG. EB, % | 77.0 | 77.9 | 70.1 |
| AVG. TEN., G/D | 3.17 | 3.33 | 3.15 |
| AVG. WORK, G*CM | 3650 | 3880 | 1603 |

TABLE 19A

| | 1 | 2 | 3 | 4 |
|---|---|---|---|---|
| FEED YARN ID. | A | B | C | D |
| POLYMER | N66 | N66 | 66 | N6/66 |
| POLYMER RV | 50 | 50 | 65 | 65 |
| SPIN SPEED, MPM | 3909 | 3954 | 5300 | 5300 |
| YARN DENIER | 55 | 52 | 50.5 | 50 |
| DPF | 3.23 | 3.05 | 3.84 | 3.84 |
| CROSS-SECTION | TRI | RND | RND | RND |
| $E_b$, % | 85 | 78 | 73.5 | 76.1 |

TABLE 19B

| | 1 | 2 | 3 | 4 | 5 | 6 |
|---|---|---|---|---|---|---|
| DRAW RATIO | 1.316 | 1.316 | 1.447 | 1.447 | 1.608 | 1.608 |
| HTR TEMP., °C. | 130 | 160 | 130 | OFF | OFF | 130 |
| RELAX ($T_r$), °C. | 118 | 143 | 118 | 22 | 22 | 118 |
| DENIER | 43.8 | 43.7 | 40.0 | 40.2 | 36.1 | 35.8 |

TABLE 19B-continued

| | 1 | 2 | 3 | 4 | 5 | 6 |
|---|---|---|---|---|---|---|
| $E_b$, % | 53.1 | 51.9 | 39.8 | 43.6 | 30.5 | 22.8 |
| MOD., GPD | 15.2 | 16.2 | 17.9 | 29.2 | 23.9 | 47.0 |
| $S_1$, % | 6.1 | 6.2 | 7.4 | 6.6 | 7.3 | 7.6 |
| DYE RATING | + | + | + | + | + | − |

TABLE 19C

| | 1 | 2 | 3 | 4 | 5 | 6 | 7 | 8 | 9 | 10 | 11 |
|---|---|---|---|---|---|---|---|---|---|---|---|
| DRAW RATIO | 1.15 | 1.15 | 1.30 | 1.30 | 1.30 | 1.45 | 1.45 | 1.45 | 1.45 | 1.60 | 1.60 |
| HTR TEMP., °C. | 160 | OFF | 160 | 130 | OFF | 160 | 130 | 100 | OFF | 160 | OFF |
| RELAX ($T_r$), °C. | 143 | 22 | 143 | 118 | 22 | 118 | 118 | 94 | 22 | 143 | 22 |
| DENIER | 49 | 49.5 | 44 | 43.5 | 44.5 | 40 | 39 | 39.5 | 40 | 35.5 | 35.5 |
| $E_b$, % | 64 | 71 | 39 | 44 | 45 | 27 | 34 | 38.5 | 30 | 23 | 22 |
| $S_1$, % | 4.0 | NA | 6.6 | 5.9 | 7.0 | 7.3 | 6.2 | 6.7 | 8.3 | 6.9 | 6.6 |
| DYE RATING | + | + | − | + | + | − | − | + | + | − | − |

TABLE 19D

| | 1 | 2 | 3 | 4 | 5 | 6 | 7 | 8 |
|---|---|---|---|---|---|---|---|---|
| DRAW RATIO | 1.15 | 1.15 | 1.30 | 1.30 | 1.35 | 1.35 | 1.45 | 1.45 |
| HTR TEMP., °C. | 160 | OFF | 160 | OFF | 160 | OFF | 160 | OFF |
| RELAX ($T_r$), °C. | 143 | 22 | 143 | 22 | 143 | 22 | 143 | 22 |
| DENIER | 46 | 46.5 | 41.1 | 41.9 | 40 | 40.2 | 36.8 | 37.2 |
| $E_b$, % | 58.9 | 47 | 39.1 | 41.6 | 36 | 41.2 | 28.3 | 29.5 |
| MOD., GPD | 19 | 20.9 | 25.3 | 22.8 | 26 | 23.4 | 28.6 | 30.7 |
| $S_1$, % | 4.9 | 5.9 | 6.7 | 5.9 | 6.9 | 6.4 | 7.2 | 6.9 |
| DYE RATING | + | + | + | + | − | + | + | + |

TABLE 19E

| | 1 | 2 | 3 | 4 | 5 | 6 | 7 |
|---|---|---|---|---|---|---|---|
| DRAW RATIO | 1.15 | 1.30 | 1.30 | 1.30 | 1.45 | 1.45 | 1.45 |
| HTR TEMP., °C. | 160 | OFF | 130 | 160 | OFF | 130 | 160 |
| RELAX ($T_r$), °C. | 143 | 22 | 118 | 143 | 22 | 118 | 143 |
| DENIER | 44.7 | 40.5 | 39.5 | 39.8 | 36.5 | 35.6 | 35.4 |
| $E_b$, % | 60.3 | 49.8 | 41.7 | 43.2 | 36.4 | 33.2 | 30.5 |
| MOD,. GPD | 18.4 | 21.8 | 21.8 | 23.5 | 21.3 | 29.2 | 26.6 |
| $S_1$, % | 5.9 | 6.9 | 7.5 | 7.6 | 8.1 | 8.6 | 8.3 |
| DYE RATING | − | − | +/− | − | + | + | − |

TABLE 20

| ITEM NO. | SPIN MPM | PROCESS PSI | PROCESS DEG. C. | BOS % | T7% G/D | T20% G/D | PYM G/D | DDR ×1000 | RDDR ×1000 |
|---|---|---|---|---|---|---|---|---|---|
| 1 | 3750 | OFF | 120 | 52.0 | 1.23 | 1.56 | 4.27 | 106 | 169 |
| 2 | 4000 | OFF | 120 | 47.4 | 1.29 | 1.66 | 4.70 | 134 | 205 |
| 3 | 4500 | OFF | 120 | 23.9 | 1.56 | 2.20 | 5.80 | 163 | 207 |
| 4 | 5000 | OFF | 120 | 10.6 | 1.76 | 2.31 | 6.83 | 165 | 194 |
| 5 | 5500 | OFF | 120 | 15.7 | 2.36 | 3.06 | 8.81 | 144 | 174 |
| 6 | 6000 | OFF | 120 | 11.4 | 3.07 | 3.81 | 9.88 | 124 | 146 |
| 7 | 4000 | OFF | 150 | 9.2 | 2.75 | 3.64 | 10.95 | 75 | 87 |
| 8 | 4500 | OFF | 150 | 10.0 | 2.91 | 3.92 | 12.22 | 69 | 81 |
| 9 | 5000 | OFF | 150 | 9.8 | 3.33 | 4.44 | 13.60 | 68 | 79 |
| 10 | 4000 | OFF | 180 | 5.5 | 2.92 | 3.87 | 11.70 | 69 | 79 |
| 11 | 4500 | OFF | 180 | 6.1 | 3.06 | 3.91 | 10.90 | 76 | 87 |
| 12 | 5000 | OFF | 180 | 5.7 | 3.20 | 4.04 | 10.94 | 86 | 98 |
| 13* | 3750 | OFF | 135 | 75.0 | 1.50 | 1.55 | 3.33 | 79 | 175 |
| 14* | 3750 | OFF | 135 | 73.9 | 2.04 | 2.15 | 6.07 | 83 | 194 |
| 15* | 3750 | OFF | 135 | 70.7 | 2.27 | 2.47 | 9.60 | 98 | 200 |
| 16* | 4000 | OFF | 180 | 5.1 | 2.84 | 3.09 | 12.00 | 57 | 65 |
| 17* | 4000 | OFF | 180 | 4.9 | 2.97 | 3.19 | 11.00 | 62 | 72 |
| 18* | 4500 | OFF | 135 | 44.6 | 2.13 | 2.20 | 4.69 | 112 | 215 |
| 19* | 4500 | OFF | 135 | 42.7 | 2.70 | 2.86 | 8.56 | 122 | 167 |
| 20* | 4500 | OFF | 135 | 40.3 | 3.07 | 3.23 | 8.93 | 133 | 175 |
| 21* | 5000 | OFF | 120 | 12.7 | 2.17 | 2.17 | 8.32 | 117 | 130 |
| 22* | 5000 | OFF | 120 | 16.0 | 2.90 | 3.05 | 8.40 | 123 | 139 |
| 23* | 5000 | OFF | 120 | 16.1 | 3.26 | 3.31 | 12.10 | 131 | 149 |
| 24 | 4700 | OFF | 245 | 3.5 | 0.89 | 0.99 | 7.30 | 96 | 165 |
| 25 | 4700 | 40 | 245 | 8.1 | 0.95 | 1.16 | 2.90 | 109 | 193 |
| 26 | 4700 | 60 | 245 | 19.5 | 0.96 | 1.17 | 2.90 | 126 | 239 |
| 27 | 4700 | 80 | 245 | 22.6 | 1.03 | 1.23 | 2.90 | 125 | 242 |
| 28 | 4700 | 100 | 245 | 54.9 | 1.19 | 1.56 | 2.90 | 126 | 320 |
| 29 | 4700 | 120 | 245 | 35.9 | 1.18 | 1.58 | 4.12 | 110 | 234 |
| 30 | 4700 | 140 | 245 | 24.1 | 1.24 | 1.68 | 5.10 | 104 | 203 |

TABLE 20-continued

| ITEM NO. | SPIN MPM | PROCESS PSI | PROCESS DEG. C. | BOS % | T7% G/D | T20% G/D | PYM G/D | DDR ×1000 | RDDR ×1000 |
|---|---|---|---|---|---|---|---|---|---|
| 31 | 4700 | 160 | 245 | 10.70 | 1.37 | 1.93 | 6.50 | 88 | 158 |

*PYM BASED ON T10% AND T7%

| | |
|---|---|
| FDY 1000 YPM 3.5× DRAW COMMERCIAL YARN | 55 |
| FDY 4750 MPM POY 1.2× DRAW RATIO PER 4,134,882 | 105 |
| HOY SPUN AT 6400 MPM PER U.S. PAT. NO. 4,134,882 | 130 |
| FTT/HOY PER U.S. PAT. NO. 4,134,882 | 110 |
| FTT/POY 3000 MPM COMMERCIAL YARN PER U.S. PAT. NO. 3,772,872 | 90 |
| DRAW-RELAX-REDRAW FDY PER U.S. PAT. NO. 4,134,882 | 115 |
| DUY SPUN AT 4100 MPM PER U.S. PAT. NO. 4,156,071 | 150 |
| COMMERCIAL LOW SPEED SPUN/DRAWN STAPLE | 55 |
| UNDRAWN, CRIMPED HOY SPUN AT 6500 MPM PER U.S. PAT. NO. 4,134,882 | 160 |

TABLE 21

| Item No. | 1 | 2 | 3 | 4 | 5 | 6 | 7 | 8 |
|---|---|---|---|---|---|---|---|---|
| LRV | 20.9 | 22.5 | 23.9 | 21.8 | 21.4 | 10.0 | 21.0 | 21.9 |
| $T_m$°, C. | 258 | 249 | 239 | 243 | 250 | 243 | — | — |
| $E_B$, % | 74.2 | 75.8 | 79.0 | 111 | 115 | 115 | 116 | 101 |
| S, % | 4 | 5 | 6.7 | 7 | 5.7 | 6 | 6.7 | 3.7 |
| $\Delta_n$, ×1000 | 97 | 74 | 68 | 48 | 66 | 66 | 51 | 65 |
| DDR, ×1000 | 117 | 109 | 214 | 200 | 210 | 210 | — | — |
| RDDR,245 ×1000 | 158 | 312 | 293 | 309 | 305 | — | — | |

TABLE 22

| Polymer | 1A | 1B | 2 | 3 | 4 | 5 |
|---|---|---|---|---|---|---|
| RV | 43.9 | 43.9 | — | 42.5 | 48.1 | 42.7 |
| | 49.7 | 49.7 | 51.1 | 47.5 | 50.7 | 45 |
| | 55.8 | 55.8 | — | 57.4 | 61.3 | 51.9 |
| | 66.5 | 66.5 | 62.6 | 65.5 | 73.0 | 62.5 |
| $E_b$, % | 98.4 | 55.8 | — | 113.2 | 96.5 | 75.9 |
| | 101. | 96.5 | 94.8 | 103 | 96.8 | 83.8 |
| | 61.1 | 49.7 | — | 92.4 | 73.2 | 95.3 |
| | 102.1 | 43.3 | 97.9 | 112.9 | 72.5 | 94.7 |
| Modulus, g/d | 9.9 | 12.2 | — | 15.7 | 10.6 | 12.1 |
| | 15.7 | 15.4 | 14.0 | 13.7 | 12.9 | 13.2 |
| | 15.4 | 12.7 | — | 13.8 | 16.1 | 11.0 |
| | 7.3 | 9.8 | 17.1 | 11.6 | 23.4 | 10.1 |

1A = 4000 mpm/66 w/0.075% TREN/5% MPMD
1B = 5000 mpm/66 w/0.075% TREN/5% MPMD
2 = 66 w/3% Isophthalate/2% MPMD
3 = 66 w/3% isophthalate/2% MPMD/0.075% TREN
4 = 66 w/5% 6T
5 = 66 w/4.4% 612

TABLE 23

| Item No | 1 | 2 | 3 | 4 |
|---|---|---|---|---|
| Tube, C | 120 | 135 | 150 | 180 |
| Tc, onset C | 84.8 | 82.3 | 73.6 | 78.6 |
| Tc, peak C | 100.8 | 101.0 | 101.4 | 107.9 |
| $\Delta H_c$, J/g | 5.87 | 11.2 | 10.2 | 11.3 |
| Tm, onset C | 249.3 | 258.5 | 250.5 | 248.6 |
| Tm, peak C | 262.5 | 262.2 | 256.5 | 260 |
| $\Delta H_m$, J/g | 40.7 | 40.9 | 42.5 | 44.3 |
| S, % | 24 | 29 | 10 | 6.1 |
| STmax, mg/d | 200 | 200 | 360 | 380 |
| T(STmax), C | 77 | 73 | 150 | 177 |

What is claimed is:

1. A process for preparing spin-oriented polyester filaments (B), that are of high boil-off shrinkage (S) and high shrinkage power ($P_s$), involving first melt-spinning a polyester polymer having a glass transition temperature ($T_g$) of 40° to 80° C. and a zero-shear polymer melting point ($T_M^o$) of 240° to 280° C. at a withdrawal speed in the range of 2 to 6 Km/min, and quenching to a temperature below said temperature ($T_g$), to form polyester filaments (A) of low shrinkage (S), followed by treating said filaments (A) by rapidly heating to a treatment temperature above said temperature ($T_g$) and up to [0.775($T_M^o$+273)−273], and then immediately and rapidly cooling the filaments to below said temperature ($T_g$), wherein said heating and cooling are carried out at rates sufficiently rapid to provide filaments (B) characterized by:

i) a residual draw-ratio (RDR) of 1.4 to 1.9, a post yield modulus ($M_{py}$) of less than 12 g/dd, and high shrinkage (S) such that the value of (1-S/$S_m$) is between 0.25 and 0.9; where RDR is (1+100/$E_B$,%), $E_B$ being the elongation-to-break, and $S_m$ is [(6.5-RDR)/6.5]×100%;

ii) a high maximum shrinkage tension ($ST_{max}$) of 0.1 g/d to 0.5 g/d at a peak shrinkage tension temperature T($ST_{max}$) between [0.65($T_M^o$+273)−273] and [0.725($T_M^o$+273) −273]; and iii) a shrinkage modulus ($M_s$) of up to 5 g/d; and high shrinkage power ($P_s$) of 1.5 to 12 (g/d) %;

and wherein said filaments (A) are characterized by:

iv) a residual draw-ratio (RDR) between 1.4 and 1.9 and low shrinkage (S) such that the value of (1-S/$S_m$) is at least 0.9; and v) a maximum shrinkage tension ($ST_{max}$) less than 0.15 g/d at a peak shrinkage tension temperature T($ST_{max}$) less than [0.70($T_M^o$+273)−273].

2. A process according to claim 1, wherein said filaments (A) are melt spun at said withdrawal speed and are immediately treated in a coupled process by said rapidly heating and cooling to provide said filaments (B) that are wound up at a speed between about 2 and 6 km/min.

3. A process according to claim 1 or 2, comprising spinning a bundle of filaments (A) and splitting said bundle into two smaller filament bundles, treating one of said smaller filament bundles by said rapidly heating and cooling to provide said filaments (B), and later recombining into a single bundle so as to provide a mixed-shrinkage polyester filament yarn comprising filaments (A) and filaments (B).

4. A process according to claim 1 or 2, wherein, before said filaments (A) are rapidly heated, they are mixed with filaments selected from the group consisting of thermally stable polyester filaments (A') and polyamide filaments (C') to form a mixed-filament yarn that is treated by being rapidly heated and cooled to provide a mixed-shrinkage filament yarn comprising said filaments (B) and filaments selected from the group consisting of thermally stable polyester filaments (A') and polyamide filaments (C').

5. A process according to claim 1 or 2, comprising splitting a melt stream of said polyester polymer into at least two, modifying the polymer in one of the resulting split streams to change its ability to undergo stress-induced crystallization, spinning both the resulting modified polymer and the polyester polymer that has not been so modified to form filaments (A') from the modified polymer and of filaments (A) from such unmodified polymer at a withdrawal speed in the range of 2 to 6 Km/min, and quenching to a temperature below said temperature (Tg), to form a bundle of said polyester filaments (A) of low shrinkage (S) and of thermally stable polyester filaments (A') of low shrinkage (S) from the said modified polymer, heating said bundle to a treatment temperature above said temperature (Tg) and up to [0.775 ($TM^o$+273)–273], and then immediately and rapidly cooling to below said temperature (Tg), to provide a mixed-shrinkage polyester filament yarn comprising filaments (A') and filaments (B), wherein said heating and cooling are carried out at rates sufficiently rapid to convert said filaments (A) into filaments (B) characterized by:

i) a residual draw-ratio (RDR) of 1.4 to 1.9, a post yield modulus ($M_{py}$) of less than 12 g/dd, and high shrinkage (S) such that the value of ($1-S/S_m$) is between 0.25 and 0.9; where RDR is ($1+100/E_B$,%), $E_B$ being the elongation-to-break, and $S_m$ is [(6.5-RDR)/6.5]×100%;

ii) a high maximum shrinkage tension ($ST_{max}$) of 0.1 g/d to 0.5 g/d at a peak shrinkage tension temperature $T(ST_{max})$ between [0.65($T_M{}^o$+273)–273] and [0.725($T_M{}^o$+273 )–273]; and iii) a shrinkage modulus ($M_s$) of up to 5 g/d; and high shrinkage power ($P_s$) 1.5 to 12 (g/d)%;

and wherein said filaments (A) and (A') are characterized by:

iv) a residual draw-ratio (RDR) between 1.4 and 1.9 and low shrinkage (S) such that the value of ($1-S/S_m$) is at least 0.90; and v) a maximum shrinkage tension ($ST_{max}$) less than 0.15 g/d at a peak shrinkage tension temperature $T(ST_{max})$ less than [0.70($T_M{}^o$+273)–273].

6. A process according to claim 3, comprising heat-relaxing said mixed-shrinkage filament yarn to provide a mixed-filament bulky yarn.

7. A process according to claim 4, comprising heat-relaxing said mixed-shrinkage filament yarn to provide a mixed-filament bulky yarn.

8. A process according to claim 5, comprising heat-relaxing said mixed-shrinkage filament yarn to provide a mixed-filament bulky yarn.

9. A process according to claim 3, comprising air-jet texturing said mixed-shrinkage filament yarn and heat-relaxing during or after air-jet texturing to provide a textured yarn.

10. A process according to claim 4, comprising air-jet texturing said mixed-shrinkage filament yarn and heat-relaxing during or after air-jet texturing to provide a textured yarn.

11. A process according to claim 5, comprising air-jet texturing said mixed-shrinkage filament yarn and heat-relaxing during or after air-jet texturing to provide a textured yarn.

12. A process according to claim 3, comprising draw-texturing said mixed-shrinkage filament yarn at a draw ratio selected so as to provide a textured yarn of residual elongation $E_B$ of 15% to 45%.

13. A process according to claim 4, comprising draw-texturing said mixed-shrinkage filament yarn at a draw ratio selected so as to provide a textured yarn of residual elongation $E_B$ of 15% to 45%.

14. A process according to claim 5, comprising draw-texturing said mixed-shrinkage filament yarn at a draw ratio selected so as to provide a textured yarn of residual elongation $E_B$ of 15% to 45%.

15. A process according to claim 1 or 2, comprising draw-texturing said filaments (B) at a draw ratio selected so as to provide a textured yarn of residual elongation $E_B$ 15% to 45%.

16. A process for preparing spin-oriented polyester bicomponent filaments (A'B) from a polyester polymer having a glass transition temperature ($T_g$) of 40 to 80° C. and a zero-shear polymer melting point ($T_M{}^o$) of 240° to 280° C., comprising splitting a melt stream of said polyester polymer into at least two, modifying the polymer in one of the resulting split streams to change its ability to undergo stress-induced crystallization, recombining the split stream in an adjoining relationship into a single melt stream, spinning the single melt stream into filaments at a withdrawal speed in the range of 2 to 6 Km/min, and quenching to a temperature below said temperature ($T_g$), to form polyester bicomponent filaments (A'A) of low shrinkage (S) followed by rapidly heating said bicomponent filaments (A'A) to a treatment temperature above said temperature ($T_g$) and up to [0.775($T_M{}^o$+273)–273], and then immediately and rapidly cooling the filaments to below said temperature ($T_g$), wherein said heating and cooling are carried out at rates sufficiently rapid to provide bicomponent filaments (A'B) characterized by:

i) a residual draw-ratio (RDR) of 1.4 to 1.9, and high shrinkage (S) such that the value of ($1-S/S_m$) is greater than 0.7, where RDR is ($1+100/E_B$,%), $E_B$ being the elongation-to-break, and $S_m$ is [(6.5-RDR)/6.5]×100%;

ii) a high maximum shrinkage tension ($ST_{max}$) of 0.1 g/d to 0.5 g/d at a peak shrinkage tension temperature $T(ST_{max})$ between [0.65($T_M{}^o$+273)–273] and [0.725($T_M{}^o$+273)–273]; and iii) a shrinkage modulus ($M_s$) of up to 5 g/d; and high shrinkage power ($P_s$) of 1.5 to 12 (g/d)%;

and wherein said bicomponent filaments (A'A) are characterized by:

iv) a residual draw-ratio (RDR) between 1.4 and 1.9 and low shrinkage (S) such that the value of ($1-S/S_m$) is at least 0.9; and v) a maximum shrinkage tension ($ST_{max}$) less than 0.15 g/d at a peak shrinkage tension temperature $T(ST_{max})$ less than [0.70($T_M{}^o$+273)–273].

17. A process according to claim 1 or 2, comprising melt-spinning said filaments (A) from a spinneret capillary orifice comprised of multiple segments arranged in a configuration such as to form multiple melt streams which are withdrawn from the spinneret into a quench zone under conditions which cause self-coalescence of the multiple melt streams into a filament having an off-center longitudinal void of at least 10% by volume.

18. A process according to claim 1 or 2, comprising passing said filaments (A) over a surface of sufficient friction to provide irregular, asymmetric filaments before they are rapidly heated.

19. A process according to claim 1 or 2, wherein filaments (A), having an asymmetric cross-section with one side larger than the other, are spun through a capillary of configuration selected to provide such asymmetric cross-section.

20. A process according to claim 1 or 2, comprising drawing the resulting filaments (B) at a temperature $T_D$ between [0.65($T_M{}^o$+273)–273] and [0.725($T_M{}^o$+27-

3)–273] to a drawn residual draw ratio $(RDR)_D$ between 1.2 and 1.4 under conditions selected to maintain $T(ST_{max})$ in the range {0.65($TM^o$+273)–273} and {0.725($TM^o$+273)–273}, shrinkage modulus (Ms) less than 5 g/d, and (1-$S/S_m$) greater than 0.7; and to provide a maximum shrinkage tension ($ST_{max}$) of 0.3 to 0.7 g/d, shrinkage power ($P_s$) of 5 to 12 (g/d)% and post-yield modulus ($M_{py}$) less than 12 g/dd.

21. A process according to claim 3, comprising drawing the resulting mixed-shrinkage filament yarn at a temperature $T_D$ between [0.65($T_M{}^o$+273)-273] and [0.725($T_M{}^o$+273)–273] to a drawn residual draw ratio $(RDR)_D$ between 1.2 and 1.4 under conditions selected to maintain $T(ST_{max})$ in the range {0.65($TM^o$+27-3)–273} to {0.725($TM^o$+273)–273}, shrinkage modulus ($M_s$) less than 5 g/d, and (1-$S/S_m$) greater than 0.7; and to provide a maximum shrinkage tension ($ST_{max}$) of 0.3 to 0.7 g/d, shrinkage power ($P_s$) of 5 to 12 (g/d)% and post-yield modulus ($M_{py}$) less than 12 g/dd.

22. A process according to claim 4, comprising drawing the resulting mixed-shrinkage filament yarn at a temperature $T_D$ between [0.65($T_M{}^o$+273)–273]and [0.725($T_M{}^o$+273)–273] to a drawn residual draw ratio $(RDR)_D$ between 1.2 and 1.4 under conditions selected to maintain $T(ST_{max})$ in the range {0.65($TM^o$+27-3)–273} to {0.725($TM^o$+273)–273}, shrinkage modulus ($M_s$) less than 5 g/d, and (1-$S/S_m$) greater than 0.7; and to provide a maximum shrinkage tension ($ST_{max}$) of 0.3 to 0.7 g/d, shrinkage power ($P_s$) of 5 to 12 (g/d)% and post-yield modulus ($M_{py}$) less than 12 g/dd.

23. A process according to claim 5, comprising drawing the resulting mixed-shrinkage filament yarn at a temperature $T_D$ between [0.65 ($T_M{}^o$+273)–273 ] and [0.725($T_M{}^o$+273)–273] to a drawn residual draw ratio $(RDR)_D$ between 1.2 and 1.4 under conditions selected to maintain $T(ST_{max})$ in the range {0.65($TM^o$+27-3)–273} to {0.725($TM^o$+273)–273}, shrinkage modulus ($M_s$) less than 5 g/d, and (1-$S/S_m$) greater than 0.7; and to provide a maximum shrinkage tension ($ST_{max}$) of 0.3 to 0.7 g/d, shrinkage power ($P_s$) of 5 to 12 (g/d)% and post-yield modulus ($M_{py}$) less than 12 g/dd.

24. A process according to claim 16, comprising drawing the resulting bicomponent filaments at a temperature $T_D$ between [0.65($T_M{}^o$+273)–273] and [0.725 ($T_M{}^o$+273)–273 ] to a drawn residual draw ratio $(RDR)_D$ between 1.2 and 1.4 under conditions selected to maintain $T(ST_{max})$ in the range {0.65($TM^o$+27-3)–273} to {0.725($TM^o$+273)–273}, shrinkage modulus ($M_s$) less than 5 g/d, and (1-$S/S_m$) greater than 0.7; and to provide a maximum shrinkage tension ($ST_{max}$) of 0.3 to 0.7 g/d, shrinkage power ($P_s$) of 5 to 12 (g/d)% and post-yield modulus ($M_{py}$) less than 12 g/dd.

25. A process for preparing thermally stable spin-oriented polyester filaments (A′), involving first melt-spinning a polyester polymer having a glass transition temperature ($T_g$) of 40° to 80° C. and a zero-shear polymer melting point ($T_M{}^o$) of 240° to 280° C. at a withdrawal speed in the range of 2 to 6 Km/min, and quenching to a temperature below said temperature ($T_g$), to form polyester filaments (A) of low shrinkage (S), followed by treating said filaments (A) by rapidly heating to a treatment temperature above said temperature ($T_g$) and up to [0.775($T_M{}^o$+273)–273], and then immediately and rapidly cooling the filaments to below said temperature ($T_g$), wherein said heating and cooling are carried out at rates sufficiently rapid to provide filaments (A′) characterized by:

i) a residual draw-ratio (RDR) of 1.4 to 1.9, a post yield modulus ($M_{py}$) of less than 12 g/dd, and shrinkage (S) such that the value of (1-$S/S_m$) is between 0.95 and 0.9; where RDR is (1+100/$E_B$,%), $E_B$ being the elongation-to-break, and $S_m$ is [(6.5-RDR)/6.5×100%;

ii) a high maximum shrinkage tension ($ST_{max}$) of 0.15 g/d to 0.5 g/d at a peak shrinkage tension temperature $T(ST_{max})$ between [0.65($T_M{}^o$+273)–273] and [0.725 ($T_M{}^o$+273)–273 ]; and iii) a shrinkage modulus ($M_s$) of 1.5 to 5 g/d; and high shrinkage power ($P_s$) of 1.5 to 5 (g/d)%;

and wherein said filaments (A) are characterized by:

iv) a residual draw-ratio (RDR) between 1.4 and 1.9 and low shrinkage (S) such that the value of (1-$S/S_m$) is at least 0.9; and v) a maximum shrinkage tension ($ST_{max}$) less than 0.15 g/d at a peak shrinkage tension temperature $T(ST_{max})$ less than [0.70($T_M{}^o$+273)–273].

26. A process according to claim 25, wherein said filaments (A) are melt spun at said withdrawal speed and are immediately treated in a coupled process by said rapidly heating and cooling to provide said filaments (A′) that are wound up at a speed between about 2 and 6 km/min.

* * * * *

UNITED STATES PATENT AND TRADEMARK OFFICE

CERTIFICATE OF CORRECTION

PATENT NO. : 5,384,082

DATED : January 24, 1995

INVENTOR(S) : Hans R. E. Frankfort, Benjamin H. Knox, Girish A. Pai

It is certified that error appears in the above-indentified patent and that said Letters Patent is hereby corrected as shown below:

Corrections to Table 2D are as follows:-

(1) "ITEM NO." should be lined up with the numbers (1, 2, 3, ...) and likewise down through the whole of Table 2D, and the bottom lines of numbers should be deleted from Table 2D.

(2) After making correction no. (1), 1st and 2nd values "27.1" and "23.3" in the line for $M_S$ should be corrected to read "2.71" and "2.33", respectively.

Signed and Sealed this

Fourth Day of July, 1995

Bruce Lehman

*Attest:*

BRUCE LEHMAN

*Attesting Officer*

*Commissioner of Patents and Trademarks*